US011739893B2

(12) United States Patent
Cohen

(10) Patent No.: US 11,739,893 B2
(45) Date of Patent: Aug. 29, 2023

(54) LIGHT FIXTURE

(71) Applicant: Brandon Cohen, Vernon, CA (US)

(72) Inventor: Brandon Cohen, Vernon, CA (US)

(73) Assignee: AMP Plus, Inc., Vernon, CA (US)

( * ) Notice: Subject to any disclaimer, the term of this patent is extended or adjusted under 35 U.S.C. 154(b) by 0 days.

(21) Appl. No.: 17/834,881

(22) Filed: Jun. 7, 2022

(65) Prior Publication Data

US 2022/0307659 A1 Sep. 29, 2022

Related U.S. Application Data

(63) Continuation-in-part of application No. 29/775,487, filed on Mar. 23, 2021, and a continuation-in-part of
(Continued)

(51) Int. Cl.
*F21S 8/02* (2006.01)
*F21V 23/00* (2015.01)
(Continued)

(52) U.S. Cl.
CPC ..... *F21S 8/02* (2013.01); *F21V 21/04* (2013.01); *F21V 23/007* (2013.01);
(Continued)

(58) Field of Classification Search
CPC ..... F21S 8/02; F21S 8/026; F21S 8/00; F21S 8/04; F21S 8/03; F21S 8/033;
(Continued)

(56) References Cited

U.S. PATENT DOCUMENTS 1,133,535 A 3/1915 Cain
1,471,340 A 10/1923 Knight
(Continued)

FOREIGN PATENT DOCUMENTS

EP 3521688 A1 7/2019
WO WO2010051985 A1 5/2010
(Continued)

OTHER PUBLICATIONS

US 10,816,169 B1, 10/2020, Danesh (withdrawn)
(Continued)

*Primary Examiner* — Bao Q Truong
(74) *Attorney, Agent, or Firm* — Eric Kelly

(57) ABSTRACT

A light fixture is configured for mounting within a given housing-can. The light fixture may have a driver assembly, a heat-sink and a trim-casing assembly. The driver assembly may have a driver-printed-circuit-board, a lumen-switch, a color-temperature-switch, and a driver-box. The driver-printed-circuit-board, the lumen-switch, and the color-temperature-switch may be at least partially housed within the driver-box. With the lumen-switch a lumen output of the light fixture may be selected. With the color-temperature-switch a light color-temperature output of the light fixture may be selected. The trim-casing assembly may have a light-emitting-diode-circuit, a reflector, a lens, a can-attachment-means (e.g., a spring-clip), and a trim-casing-member. The light-emitting-diode-circuit, the reflector, and the lens may be housed within the trim-casing-member. The can-attachment-means may be attached to an exterior of the trim-casing-member and is for securing the light fixture to an inside of the housing-can. The heat-sink may be disposed between the driver assembly and the trim-casing-assembly.

20 Claims, 30 Drawing Sheets

Related U.S. Application Data application No. 29/775,488, filed on Mar. 23, 2021, and a continuation-in-part of application No. 17/246,272, filed on Apr. 30, 2021, now Pat. No. 11,384,910.

(51) Int. Cl.

| | |
|---|---|
| ***F21V 29/77*** | (2015.01) |
| ***F21V 21/04*** | (2006.01) |
| ***F21V 23/04*** | (2006.01) |
| *F21Y 115/10* | (2016.01) |

(52) U.S. Cl.

CPC ..... *F21V 23/0464* (2013.01); *F21V 29/773* (2015.01); *F21Y 2115/10* (2016.08)

(58) Field of Classification Search

CPC ..... F21V 29/773; F21V 21/04; F21V 23/007; F21V 23/0464; F21V 29/777; F21V 21/047; F21V 23/006; F21V 23/04; F21V 29/503; F21V 29/508; F21V 29/70; F21Y 2115/10; H05B 45/20

See application file for complete search history.

(56) References Cited

U.S. PATENT DOCUMENTS

| | | | | |
|---|---|---|---|---|
| 1,856,356 | A | 5/1932 | Owen | |
| 2,352,913 | A | 7/1944 | Parker | |
| 2,758,810 | A | 8/1956 | Good | |
| 2,802,933 | A | 8/1957 | Broadwin | |
| 3,104,087 | A | 9/1963 | Budnick | |
| 3,773,968 | A | 11/1973 | Copp | |
| 3,913,773 | A | 10/1975 | Copp | |
| 4,880,128 | A | 11/1989 | Jorgensen | |
| 4,919,292 | A | 4/1990 | Hsu | |
| 5,303,894 | A | 4/1994 | Deschamps | |
| 5,420,376 | A | 5/1995 | Rajecki | |
| 5,673,997 | A * | 10/1997 | Akiyama | F21S 8/02 362/147 |
| 5,957,573 | A | 9/1999 | Wedekind | |
| 6,521,833 | B1 | 2/2003 | DeFreitas | |
| 6,967,284 | B1 | 11/2005 | Gretz | |
| 7,784,754 | B2 | 8/2010 | Nevers | |
| 7,857,275 | B2 | 12/2010 | de la Borbolla | |
| 7,950,832 | B2 | 5/2011 | Tanaka | |
| 7,959,332 | B2 * | 6/2011 | Tickner | F21S 8/026 362/345 |
| 8,235,549 | B2 | 8/2012 | Gingrich, III | |
| 8,322,897 | B2 | 12/2012 | Blincoe | |
| 8,545,064 | B2 | 10/2013 | Blincoe | |
| 8,641,243 | B1 * | 2/2014 | Rashidi | F21V 23/06 362/249.02 |
| 8,845,144 | B1 | 9/2014 | Davis | |
| 8,926,133 | B2 | 1/2015 | Booth | |
| 9,039,254 | B2 | 5/2015 | Danesh | |
| 9,151,457 | B2 | 10/2015 | Pickard | |
| 9,404,639 | B2 | 8/2016 | Bailey | |
| 9,523,493 | B2 | 12/2016 | Chen | |
| 9,605,842 | B1 | 3/2017 | Davis | |
| 9,673,597 | B2 | 6/2017 | Lee | |
| 9,696,021 | B2 | 7/2017 | Wronski | |
| 9,702,516 | B1 * | 7/2017 | Vasquez | F21V 17/166 |
| 9,797,562 | B2 | 10/2017 | Dabiet | |
| 9,854,642 | B2 | 12/2017 | Kashani | |
| 9,890,942 | B2 | 2/2018 | Lin | |
| 9,945,548 | B2 | 4/2018 | Williams | |
| 9,964,266 | B2 | 5/2018 | Danesh | |
| 10,072,805 | B2 | 9/2018 | Bailey | |
| D832,218 | S | 10/2018 | Wronski | |
| D833,977 | S | 11/2018 | Danesh | |
| 10,139,059 | B2 | 11/2018 | Danesh | |
| 10,244,607 | B1 | 3/2019 | Kashani | |
| D847,414 | S | 4/2019 | Danesh | |
| D847,415 | S | 4/2019 | Danesh | |
| 10,247,390 | B1 | 4/2019 | Kopitzke | |
| D848,375 | S | 5/2019 | Danesh | |
| D851,046 | S | 6/2019 | Peng | |
| 10,378,738 | B1 | 8/2019 | Davis | |
| 10,408,395 | B2 | 9/2019 | Danesh | |
| 10,408,396 | B2 | 9/2019 | Wronski | |
| D864,877 | S | 10/2019 | Danesh | |
| 10,488,000 | B2 | 11/2019 | Danesh | |
| 10,551,044 | B2 | 2/2020 | Peng | |
| 10,563,850 | B2 | 2/2020 | Danesh | |
| D877,957 | S | 3/2020 | Kopitzke | |
| 10,591,120 | B2 | 3/2020 | Bailey | |
| 10,609,785 | B1 | 3/2020 | Fardadi | |
| 10,616,968 | B2 | 4/2020 | Wang | |
| 10,663,127 | B2 | 5/2020 | Danesh | |
| 10,663,153 | B2 | 5/2020 | Nikooyan | |
| 10,753,558 | B2 | 8/2020 | Danesh | |
| 10,805,997 | B2 | 10/2020 | Wang | |
| 10,816,148 | B2 | 10/2020 | Danesh | |
| D901,398 | S | 11/2020 | Danesh | |
| D902,871 | S | 11/2020 | Danesh | |
| D903,605 | S | 12/2020 | Danesh | |
| D905,327 | S | 12/2020 | Williams | |
| D907,284 | S | 1/2021 | Danesh | |
| 10,914,465 | B2 * | 2/2021 | Cohen | F21V 23/007 |
| 10,975,570 | B2 | 4/2021 | Shen | |
| 10,982,829 | B2 | 4/2021 | Danesh | |
| 10,989,390 | B2 | 4/2021 | Lotfi | |
| 11,022,259 | B2 | 6/2021 | Bailey | |
| 11,028,982 | B2 | 6/2021 | Danesh | |
| 11,047,538 | B2 | 6/2021 | Danesh | |
| D924,467 | S | 7/2021 | Danesh | |
| D925,109 | S | 7/2021 | Danesh | |
| 11,060,705 | B1 | 7/2021 | Danesh | |
| 11,067,231 | B2 | 7/2021 | Lotfi | |
| 11,085,597 | B2 | 8/2021 | Danesh | |
| 11,092,326 | B2 * | 8/2021 | Cohen | F21V 19/003 |
| 11,118,768 | B2 | 9/2021 | Danesh | |
| 11,384,910 | B1 * | 7/2022 | Cohen | F21V 29/777 |
| 2014/0254177 | A1 | 9/2014 | Danesh | |
| 2015/0009676 | A1 | 1/2015 | Danesh | |
| 2015/0233556 | A1 | 8/2015 | Danesh | |
| 2015/0276185 | A1 | 10/2015 | Bailey | |
| 2016/0312987 | A1 | 10/2016 | Danesh | |
| 2016/0348860 | A1 | 12/2016 | Bailey | |
| 2016/0348861 | A1 | 12/2016 | Bailey | |
| 2017/0005460 | A1 | 1/2017 | Lee | |
| 2017/0045213 | A1 | 2/2017 | Williams | |
| 2017/0138576 | A1 | 5/2017 | Peng | |
| 2017/0167672 | A1 | 6/2017 | Stauner | |
| 2017/0167699 | A1 | 6/2017 | Schubert | |
| 2017/0290129 | A1 | 10/2017 | Kashani | |
| 2018/0231197 | A1 | 8/2018 | Danesh | |
| 2018/0372284 | A1 | 12/2018 | Danesh | |
| 2019/0049080 | A1 | 2/2019 | Danesh | |
| 2019/0063701 | A1 | 2/2019 | Lotfi | |
| 2019/0093836 | A1 | 3/2019 | Danesh | |
| 2019/0394849 | A1 | 12/2019 | Wang | |
| 2020/0056752 | A1 | 2/2020 | Danesh | |
| 2020/0116340 | A1 | 4/2020 | Nikooyan | |
| 2020/0158302 | A1 | 5/2020 | Danesh | |
| 2020/0232624 | A1 | 7/2020 | Lotfi | |
| 2020/0236755 | A1 | 7/2020 | Wang | |
| 2020/0291652 | A1 | 9/2020 | Shen | |
| 2020/0348000 | A1 | 11/2020 | Bailey | |
| 2020/0386375 | A1 | 12/2020 | Danesh | |
| 2020/0393118 | A1 | 12/2020 | Danesh | |
| 2021/0010647 | A1 | 1/2021 | Danesh | |
| 2021/0010663 | A1 | 1/2021 | Nikooyan | |
| 2021/0033268 | A1 | 2/2021 | Danesh | |
| 2021/0041070 | A1 | 2/2021 | Danesh | |
| 2021/0071836 | A1 | 3/2021 | Danesh | |
| 2021/0080084 | A1 | 3/2021 | Danesh | |
| 2021/0262650 | A1 | 8/2021 | Danesh | |

FOREIGN PATENT DOCUMENTS

| | | | |
|---|---|---|---|
| WO | WO2018237294 | A2 | 12/2018 |
| WO | WO2018237294 | A3 | 12/2018 |
| WO | WO2019046310 | A1 | 3/2019 |

(56) References Cited

FOREIGN PATENT DOCUMENTS

| | | | |
|---|---|---|---|
| WO | WO2019133669 | A1 | 7/2019 |
| WO | WO2019222259 | A1 | 11/2019 |
| WO | WO2019241198 | A1 | 12/2019 |
| WO | WO2021051101 | A1 | 3/2021 |

OTHER PUBLICATIONS

US 10,969,069 B2, 04/2021, Danesh (withdrawn)
DMF DRD2 Product Publicly available at least as early as Sep. 6, 2018 Website: https://www.dmflighting.com/product/drd2/.
DMF DRD4 Product Publicly available at least as early as Sep. 6, 2018 Website: https://www.dmflighting.com/product/drd4/.
ELCO E247 Product Publicly available at least as early as Sep. 6, 2018 See attached concurrently filed NPL document with two product images of this ELCO E247 Product.
SORAA LED Optical Light Engine See: https://res.cloudinary.com/soraa/image/upload/v1516986148/resources/misc/ole-more-info-pdf.pdf.
IMTRA Tide PowerLED Light Fixture See: https://www.imtra.com/1806fa8d-4593-40f4-bbf0-f9a833e92148/lighting-light-fixtures-detail.htm Publicly available at least as early as 2012.
ELCO 4" Round LED Reflector Insert Publicly available at least as early as Mar. 23, 2021 Website: https://elcolighting.com/products/4-round-led-reflector-insert.
ELCO 4" Five-Color Temperature Switch LED Reflector Inserts Publicly available at least as early as Mar. 23, 2021 Website: https://elcolighting.com/node/1432026.
SORAA Vivid MR16—GU10; https://www.soraa.com/products/19-MR16-GU10.php (last visited Nov. 9, 2021).
NORA Lighting, NIOB-2RNDC https://noralighting.com/product/niob-2rndc/.
NORA Lighting, NIO-4RPH https://noralighting.com/product/nio-4rph/.
NORA Lighting, NIOB-1RNG ittps://noralighting.com/product/niob-1rng/.
NORA Lighting https://noralighting.com/product-category/products/pendants/cylinder/.
NORA Lighting https://noralighting.com/product-category/products/pendants/ilene-mini-cylinder/.
Bruck Lighting https://brucklighting.com/download/b/GX15/Spec%20Sheets/GX15%20Cylinder%20Multi-Mount%20Spec%20Sheet. odf.
Elite LED Lighting https://iuseelite.com/product-category/architectural-cylinders/?characteristics=c%2Bq.
DMF Lighting https://www.dmlighting.com/wp-content/uploads/2021/12/DMFLighting_DCC_Spec_Sheet.pdf.

* cited by examiner

LIGHT FIXTURE

PRIORITY NOTICE

The present patent application is a continuation-in-part (CIP) of U.S. non-provisional patent application Ser. No. 17/246,272 filed on Apr. 30, 2021, and claims priority to said U.S. non-provisional patent application under 35 U.S.C. § 120. The above-identified patent application is incorporated herein by reference in its entirety as if fully set forth below.

The present patent application is a continuation-in-part (CIP) of U.S. non-provisional patent application Ser. No. 29/775,487 filed on Mar. 23, 2021, and claims priority to said U.S. non-provisional patent application under 35 U.S.C. § 120. The above-identified patent application is incorporated herein by reference in its entirety as if fully set forth below.

The present patent application is a continuation-in-part (CIP) of U.S. non-provisional patent application Ser. No. 29/775,488 filed on Mar. 23, 2021, and claims priority to said U.S. non-provisional patent application under 35 U.S.C. § 120. The above-identified patent application is incorporated herein by reference in its entirety as if fully set forth below.

TECHNICAL FIELD OF THE INVENTION

The present invention relates in general to light fixtures and more specifically to light fixtures that are configured to output luminosity and/or light color-temperature from within predetermined ranges of luminosity and/or light color-temperature.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

It is often desirable for different rooms or even different regions of a same room to have ceiling (or wall) mounted light fixtures that output light at a given luminosity and/or that output light at a given light color-temperature. For example, it may be desirable to output light differently in a kitchen, pantry, living room, dining room, lounge, entertainment room, media room, great room, hallway, flex room, gym, studio, bathroom, bedroom, study, foyer, office, lab, work area, waiting room, mud room, garage, shop, deck, porch, patio, portions thereof, combinations thereof, and/or the like. It would be desirable if a single type of light fixture was capable of outputting light at different lumens and/or was capable of outputting light at different light color-temperatures. It would be further desirable if the different outputs of lumens and/or the different outputs of light color-temperature were changeable and/or selectable via one or more switches of that single type of light fixture. Thus, such a single type of light fixture could be used in multiple locations in different rooms and/or within the same room to achieve different lighting effects. Having such a single type of light fixture could avoid needing to use a variety of different types of light fixtures, wherein each different type of light fixture only has a light output of a single specific luminosity and/or that has a light output of a single specific light color-temperature. Additionally, it may be desirable if the light fixture with changeable and/or selectable different lumen outputs and/or different light color-temperature outputs may be readily removed or installed within its receiving housing-can by using a frictional attachment means, such as, but not limited to, a spring-clip or the like; and thus, such a light fixture could be removed from its housing-can and its lumen output and/or its light temperature-color output may be changed and then the light fixture may be reinserted back into its housing-can by using such spring-clip(s).

It is to these ends that the present invention has been developed.

BRIEF SUMMARY OF THE INVENTION

To minimize the limitations in the prior art, and to minimize other limitations that will be apparent upon reading and understanding the present specification, the present invention may describe various light fixtures. In some embodiments, a given light fixture may be configured for (removably) mounting within a given housing-can. In some embodiments, the light fixture may comprise a driver assembly, a heat-sink and a trim-casing assembly. In some embodiments, the driver assembly may comprise a driver-printed-circuit-board, a lumen-switch, a color-temperature-switch, and a driver-box. In some embodiments, the driver-printed-circuit-board, the lumen-switch, and the color-temperature-switch may be at least partially housed within the driver-box. In some embodiments, with the lumen-switch a lumen output of the light fixture may be selected. In some embodiments, with the color-temperature-switch a light color-temperature output of the light fixture may be selected. In some embodiments, the trim-casing assembly may comprise a light-emitting-diode-circuit, a reflector, a lens, a can-attachment-means, and a trim-casing-member. In some embodiments, the light-emitting-diode-circuit, the reflector, and the lens may be housed within the trim-casing-member. In some embodiments, the can-attachment-means may be attached to an exterior of the trim-casing-member and may be configured for attaching the light fixture to the housing-can. In some embodiments, the heat-sink may be disposed entirely below the driver assembly and entirely or at least partially above the trim-casing-assembly.

It is an objective of the present invention to provide a light fixture for (removable) mounting within a housing-can.

It is an objective of the present invention to provide a light fixture with at least one spring-clip, wherein the at least one spring-clip may be attached to an exterior of the light fixture (e.g., an upper exterior of trim/casing of the light fixture) and may be configured for removable (frictional) attachment to an interior of a housing-can and/or a hole within dry wall.

It is another objective of the present invention to provide a light fixture with a lumen output selection switch.

It is another objective of the present invention to provide a light fixture that is configured to output light at different lumens from a range of predetermined lumens.

It is another objective of the present invention to provide a light fixture with a light color-temperature output selection switch.

It is another objective of the present invention to provide a light fixture that is configured to output light at different light color-temperatures from a range of predetermined light color-temperatures.

It is another objective of the present invention to provide a light fixture that is configured to receive and operate at a predetermined voltage.

It is another objective of the present invention to provide a light fixture that is configured to receive and operate at a predetermined wattage.

It is another objective of the present invention to provide a light fixture where a LED-chip/board, a reflector, and a lens are all entirely housed within a trim/casing member of the light fixture.

It is another objective of the present invention to provide a light fixture where a heatsink is located entirely below a driver assembly and entirely above a trim-casing assembly.

It is yet another objective of the present invention to provide a light fixture where a heat-sink is located entirely below a driver assembly and partially above a trim-casing assembly (with the an upper-portion of the trim-casing assembly extending into a bottom inside of the heat-sink).

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

REFERENCE NUMERAL SCHEDULE

Figure 1A:
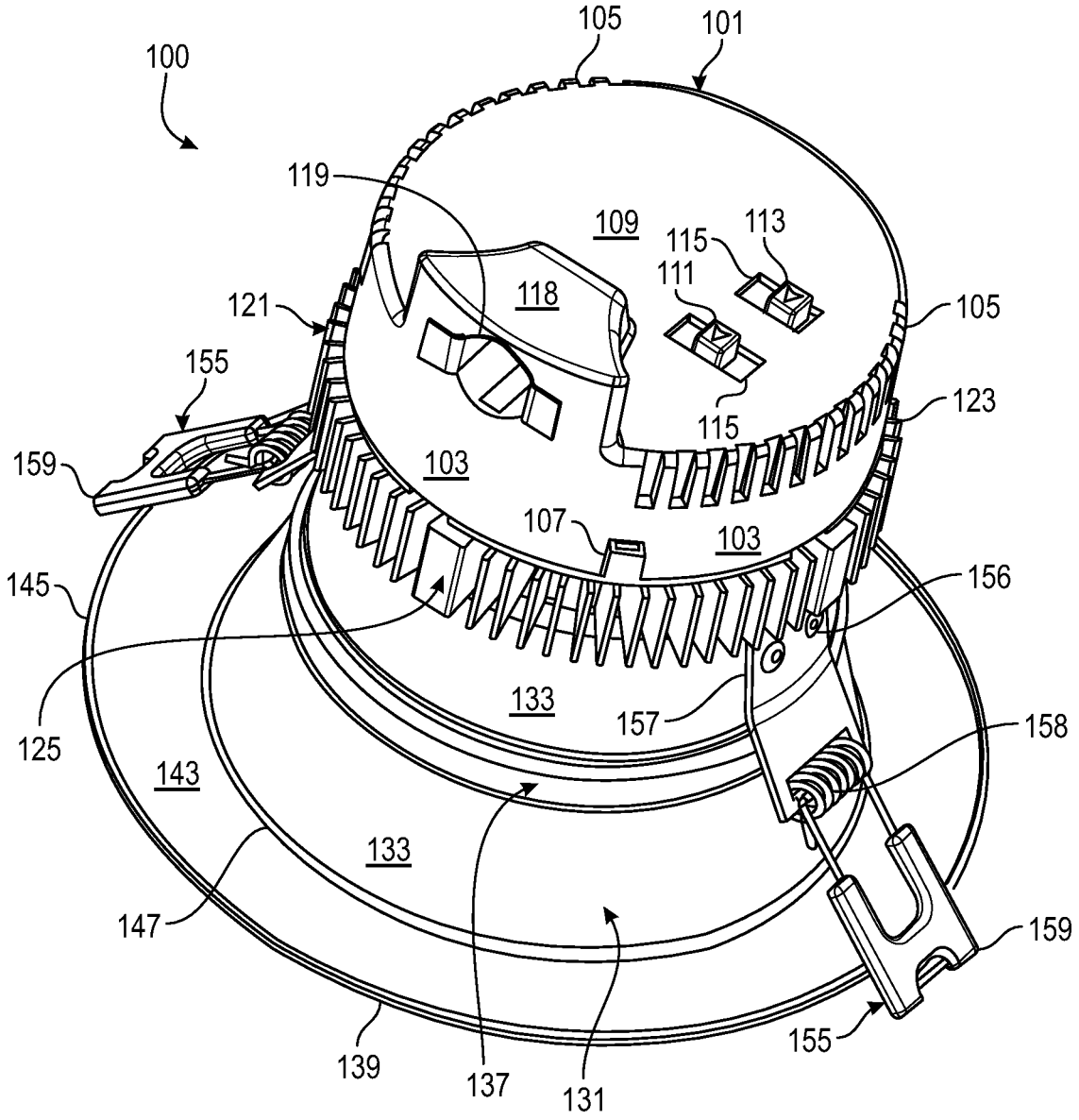
FIG. 1A depicts a top perspective view of a light fixture (in an assembled configuration).

100 light fixture 100
101 driver-box 101
103 side-wall 103
105 fin 105
107 notch 107
109 top 109
111 lumen-switch-cover 111
113 color-temperature-switch-cover 113
115 switch-aperture 115
118 integral-bulge 118
119 aperture-for-wiring 119
121 heat-sink 121
123 fin-thin 123
125 fin-thick 125
131 trim/casing 131
133 conical-exterior (conical member) 133
135 conical-interior 135
137 cylindrical-region 137
139 flange 139
141 flange-bottom 141
143 flange-top 143
145 flange-lip 145
147 flange-conical-transition 147
155 spring-clip 155
156 fastening-means 156
157 base 157
158 spring 158
159 region-of-external-contact 159
161 lens 161
201 common longitudinal center 201 (of light fixture 100 or of light fixture 400)
211 lumen-switch 211

213 color-temperature-switch 213
215 switch chassis 215
221 driver-PCB 221
231 driver-cap 231
241 LED chip/board 241
251 reflector 251
261 upper-portion 261 (of trim/casing 131)
263 top 263 (of trim/casing 131 or of trim/casing 431)
400 light fixture 400
421 heat-sink 421
423 fin-thin 423
425 fin-thick 425
431 trim/casing 431
433 upper-portion 433

DETAILED DESCRIPTION OF THE INVENTION

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized and changes may be made without departing from the scope of the invention.

Note, the 1XX series reference numerals noted and discussed herein may be shown in at least one of FIG. 1A through FIG. 2E drawing figures; the 2XX series reference numerals may be shown in at least one of FIG. 2A through FIG. 2E (and/or in at least one of FIG. 4A through FIG. 4E); and the 4XX reference numerals noted and discussed herein may be shown in at least one of FIG. 3A through FIG. 4E.

Note, the 3XX series reference numerals are shown in a FIG. 3 of a parent (prior) patent application, patent application Ser. No. 17/246,272, by the same inventor as the present patent application; and the 6XX series reference numerals are shown in a FIG. 6 of a parent (prior) patent application, patent application Ser. No. 17/246,272, by the same inventor as the present patent application. Parent patent application Ser. No. 17/246,272 is incorporated by reference as if fully set-forth herein.

FIG. 1A through FIG. 2E may depict light fixture 100; and FIG. 3A through FIG. 4E may depict light fixture 400. In some embodiments, light fixture 100 may differ from light fixture 400 in that: light fixture 100 may be smaller than light fixture 400; light fixture 400 may be larger than light fixture 100; light fixture 100 may have a smaller diameter flange 139 than light fixture 400; light fixture 400 may have a larger diameter flange 139 than light fixture 100; light fixture 100 may have a smaller total (overall) height than light fixture 400; light fixture 400 may have a larger total (overall) height than light fixture 100; light fixture 100 may fit into different sized cans/housings than light fixture 400; heat-sink 421 may taller than heatsink 121; fins 423/425 of heat-sink 421 may be of different shapes than fins 123/125 of heatsink 121; trim/casing 431 may be taller than trim/casing 131 (trim-casing-member); light fixture 100 may have different voltage and/or wattage configurations than light fixture 400; light fixture 100 may have different lumens output than light fixture 400; light fixture 100 may have different light color-temperature output than light fixture 400; and/or an upper-portion 433 of trim/casing 431 of light fixture 400 may be received into (inside) of heat-sink 421 of light fixture 400, whereas, in light fixture 100 its trim/casing 131 is not received into its heat-sink 121. However, light fixture 100 and light fixture 400 may otherwise share similar parts, components, purposes, use, functionality, and/or the like.

Figure 1B:
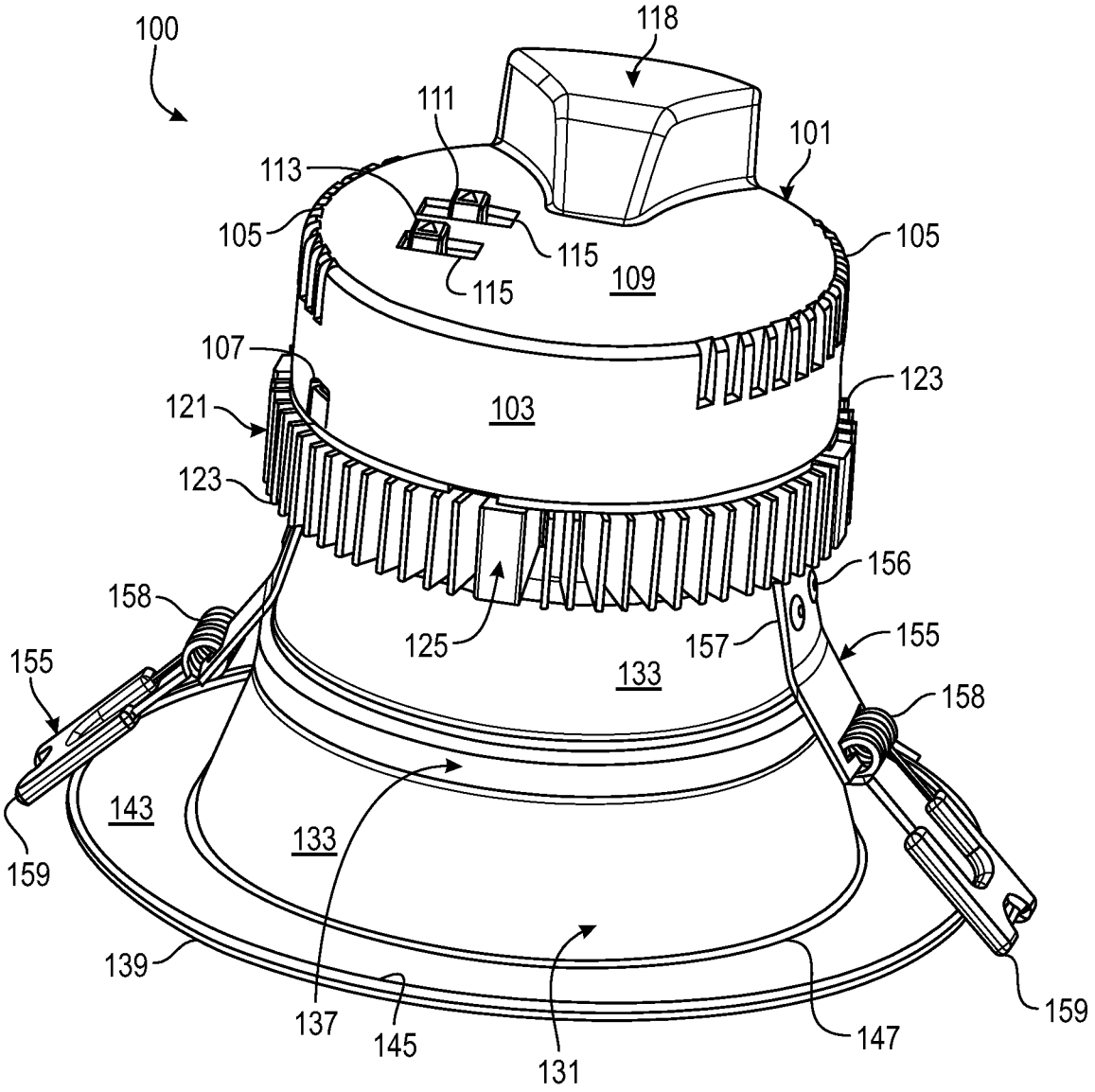
FIG. 1B depicts a top perspective view of the light fixture of FIG. 1A (in an assembled configuration).

FIG. 1A depicts a top perspective view of a light fixture 100 (in an assembled configuration). FIG. 1B depicts another top perspective view of light fixture 100 (in an assembled configuration). The top perspective views of FIG. 1A and of FIG. 1B are different perspective views. See also FIG. 1I which is a top view of light fixture 100. In some embodiments, light fixture 100 may comprise: a driver-box 101, a heat-sink 121, a trim-casing 131, a spring-clip 155, a lens 161, a driver-cap 231, a lumen-switch 211, and a color-temperature-switch 213. In some embodiments, light fixture 100 may comprise: driver-box 101, heat-sink 121, trim-casing 131, spring-clip 155, lens 161, a reflector 251, a LED chip/board 241 (light-emitting-diode-circuit), driver-cap 231, a driver-PCB 221 (driver-printed-circuit-board), lumen-switch 211, and color-temperature-switch 213. See FIG. 1C, FIG. 1D, FIG. 2A through FIG. 2E for lens 161. See FIG. 2A through FIG. 2E for lumen-switch 211, color-temperature-switch 213, driver-PCB 221, driver-cap 231, LED chip/board 241, and/or for reflector 251.

Continuing discussing FIG. 1A and FIG. 1B, in some embodiments, when light fixture 100 may be in its assembled configuration the following components/parts may be at least partially visible from an exterior of light fixture 100: driver-box 101, heat-sink 121, trim-casing 131, spring-clip 155, and/or lens 161. With respect to orientation of light fixture 100, a top of light fixture 100 is at top 109 and a bottom of light fixture 100 is at flange 139. In some embodiments, driver-box 101 may be located in a top portion or an upper portion of light fixture 100. In some embodiments, trim/casing 131 may be located from a middle region to a bottom portion or lower portion of light fixture 100. In some embodiments, heat-sink 121 may be disposed between driver-box 101 and trim/casing 131. In some embodiments, lens 161 may be mounted inside of trim/casing 131 and at least partially visible from a bottom of light fixture 100 (see e.g., FIG. 1C, FIG. 1D, and/or FIG. 1J).

Continuing discussing FIG. 1A and FIG. 1B, in some embodiments, driver-box 101 may be a substantially hollow cylindrical short member, with a mostly closed top 109, (cylindrical) (curving) side-wall 103, and an open bottom. In some embodiments, side-wall 103 may be the side-walls of driver-box 101. In some embodiments, side-wall 103 may be curved, as in a curve of a circle or cylinder side wall. In some embodiments, at least some transverse width cross-sections through driver-box 101 may yield a shape that is substantially circular in shape. In some embodiments, top 109 may be the top (top surface) of driver-box 101. In some embodiments, a hollow interior of driver-box 101 may be configured to receive and/or house at least portions of: at least some electronics of light fixture 100, at least a portion of lumen-switch 211, at least a portion of color-temperature-switch 213, switch chassis 215, at least some wiring/cabling, driver-PCB 221, and/or at least some portion of driver-cap 231, portions thereof, combinations thereof, and/or the like (see e.g., FIG. 2A through FIG. 2E). In some embodiments, driver-cap 231 may be (removably) attached to the open bottom of driver-box 101 (see e.g., FIG. 2D). In some embodiments, side-wall 103 may be disposed between top 109 and the bottom of driver-box 101. In some embodiments, side-wall 103 may connect the bottom of driver-box 101 to top 109. In some embodiments, located on side-wall 103 may be at least one fin 105. In some embodiments, located on side-wall 103 may be a plurality of fins 105. In some embodiments, fin(s) 105 of side-wall 103 may be configured to emit/transfer heat away from driver-box 101 an into the ambient surrounding air (i.e., the air that may surround light fixture 100). In some embodiments, fin(s) 105 of side-wall 103 may be located on side-wall 103 from an upper one-third of driver-box 101 to an upper one-half of driver-box 101, with respect to a height of driver-box 101 (see e.g., FIG. 1A through FIG. 1H, and FIG. 2A through FIG. 2E). In some embodiments, lower portions and/or bottom regions of driver-box 101, with respect to a height of driver-box 101 may devoid of fin(s) 105 on side-wall 103 (see e.g., FIG. 1A through FIG. 1H, and FIG. 2A through FIG. 2E). In some embodiments, fin(s) 105 of side-wall 103 may have tops of those fin(s) 105 that are visible from top 109, partially around an outside edge of top 109 (see e.g., FIG. 1I).

Continuing discussing FIG. 1A and FIG. 1B, in some embodiments, top 109 of driver-box 101 may comprise integral-bulge 118. In some embodiments, integral-bulge 118 may be an uppermost portion of top 109 that is raised above a remainder of top 109, such that this uppermost portion appears to be bulging/extending above top 109. In some embodiments, integral-bulge 118 may be integral with top 109, such that integral-bulge 118 and top 109 are of a single article of manufacture. In some embodiments, integral-bulge 118 may comprise aperture-for-wiring 119. In some embodiments, aperture-for-wiring 119 may be a hole (s) in integral-bulge 118 and leading into an inside (interior) of driver-box 101. In some embodiments, 119 may be located on an exterior side of integral-bulge 118. In some embodiments, aperture-for-wiring 119 may be configured to (removably) receive (electrical) conduit, wire(s), cable(s), and/or the like.

In some embodiments, driver box 101 may be at least substantially (mostly) the same as driver box 101 is shown and described in prior U.S. patent application Ser. No. 17/246,272 by the same inventor as the present invention; however, driver box 101 of embodiments of the present invention may comprise integral-bulge 118 and/or aperture-for-wiring 119.

Continuing discussing FIG. 1A and FIG. 1B, in some embodiments, heat-sink 121 may be a mostly cylindrical member comprising of a plurality of fins 123/125 that run around the outside side periphery of heat-sink 121. In some embodiments, the plurality of fins 123/125 may be oriented in a radial fashion with respect to a common longitudinal center 201 of light fixture 100. In some embodiments, each fin 123 may be a substantially (mostly) planar member. In some embodiments, each fin 123 may be run up and down (parallel to common longitudinal center 201). In some embodiments, heat-sink 121 may have two different types of fins, fin-thin 123 and fin-thick 125. In some embodiments, fin-thin 123 may be thinner than fin-thick 125. In some embodiments, fin-thick 125 may be thicker than fin-thin 123. In some embodiments, there may be four (4) fins-thick 125. In some embodiments, fins-thin 123 may be more numerous than fins-thick 125. In some embodiments, the four (4) fins-thick 125 may be arranged (at least substantially [mostly]) orthogonally around common longitudinal center 201. In some embodiments, the four (4) fins-thick 125 may be arranged (at least substantially [mostly]) ninety (90) degrees spaced apart from each other, around common longitudinal center 201. In some embodiments, there may be four (4) regions of fins-thin 123. In some embodiments, separating each region of fins-thin 123 may be a fin-thick 125. In some embodiments, between two adjacent fins-thick 125 may a region of fins-thin 123.

In some embodiments, heat-sink 121 may be as heat-sink 121 is shown and described in prior U.S. patent application Ser. No. 17/246,272 by the same inventor as the present invention.

Continuing discussing FIG. 1A and FIG. 1B, in some embodiments, trim/casing 131 may be a mostly hollow conical member (i.e., mostly a hollow conical frustum member) that terminates into a flange 139 where trim/casing 131 is at its widest diameter at the bottom of light fixture 100. In some embodiments, trim/casing 131 may be configured to internally receive and/house lens 161, optionally in some embodiments, LED chip/board 241. In some embodiments, trim/casing 131 may be divided into its mostly conical member and its flange 139, with the mostly conical member occupying the top/upper regions of trim/casing 131 and flange 139 occupying the very bottom of trim/casing 131. In some embodiments, side-walls of the conical member of trim/casing 131 may be a conical-exterior 133 and a conical-interior 135. In some embodiments, conical-exterior 133 and conical-interior 135 may be opposite sides/surfaces of the mostly conical member of trim/casing 131. In some embodiments, at least some of conical-interior 135 may be visible from bottom views of light fixture 100. In some embodiments, at least some of conical-interior 135 may be portions of reflector 251 that are visible from below/beneath light fixture 100. In some embodiments, at least some light emitted from light fixture 100 may shine upon portions of conical-interior 135 and/or onto portion of reflector 251. See e.g., FIG. 1C, FIG. 1D, and/or FIG. 1J for conical-interior 135 and/or reflector 251.

Continuing discussing FIG. 1A and FIG. 1B, in some embodiments, the mostly conical members 133 of trim/casing 131 may be interrupted by a cylindrical-region 137, which may be a region of trim/casing 131 that is more cylindrical than conical. In some embodiments, above and below cylindrical-region 137 may regions of trim/casing 131 that are mostly conical in shape, i.e., two (2) conical members 133, one upper and one lower.

Continuing discussing FIG. 1A and FIG. 1B, in some embodiments, flange 139 may be located at a (bottom) base of the mostly conical member of trim/casing 131, at the bottom of light fixture 100. In some embodiments, flange 139 may be a mostly planar, flat, disk/disc like, annular member. In some embodiments, flange 139 may comprise flange-top 143. In some embodiments, flange-top 143 may be a top external surface of flange 139. In some embodiments, flange-top 143 may be a mostly planar, flat, disk/disc like, annular member. In some embodiments, when light fixture may be installed in a ceiling or wall, flange-top 143 may not be visible from below. In some embodiments, an outermost edge of flange 139 may extend upwards into flange-lip 145. In some embodiments, flange-lip 145 may be an upward projection/extension of material at the outermost edge of flange 139. In some embodiments, where the bottom conical member of trim/casing 131 transitions into flange 139 may be flange-conical-transition 147. In some embodiments, flange-conical-transition 147 may be an annular ring running around an outside bottom of the conical member portion of trim/casing 131. In some embodiments, flange-conical-transition 147 may be located an inner most portion/region of flange 139, disposed away from flange-lip 145. See e.g., FIG. 1A, FIG. 1B, and/or FIG. 1I.

With respect to trim/casing 131, in some embodiments, flange 139 may comprise flange-bottom 141. In some embodiments, flange-bottom 141 may be a bottom external surface of flange 139. In some embodiments, flange-bottom 141 and flange-top 143 may be oppositely disposed external surfaces of flange 139. In some embodiments, flange-bottom 141 may be a mostly planar, flat, disk/disc like, annular member. In some embodiments, when light fixture 100 may be installed in a ceiling or wall, flange-bottom 141 may be visible overlapping drywall (or the like). In some embodiments, when light fixture 100 may be installed in a ceiling or wall, flange 139 may trim out (cover) a hole cut into the drywall (or the like), wherein this hole in the drywall (or the like) may be for receiving can/housing 301 and/or light fixture 100. In some embodiments, flange-bottom 141 may be visible from bottom views of light fixture 100. See e.g., FIG. 1C, FIG. 1D, and/or FIG. 1J for bottom view of light fixture 100.

Note, can/housing 301 is not shown in the figures of this present patent application; however, can/housing 301 is shown and described in prior U.S. patent application, patent application number 17/246,272, by the same inventor as the present patent application. Prior U.S. patent application, patent application Ser. No. 17/246,272 is incorporated by reference as if fully set-forth herein.

In some embodiments, trim/casing 131 may be as trim/casing 131 is shown and described in prior U.S. patent application Ser. No. 17/246,272 by the same inventor as the present invention.

Continuing discussing FIG. 1A and FIG. 1B, in some embodiments, attached to conical-exterior 133 (of light fixture 100) may be one or more spring-clip(s) 155. In some embodiments, attached to conical-exterior 133 may be two oppositely disposed spring-clips 155. In some embodiments, attached to an exterior of trim/casing 131 may be one or more spring-clip(s) 155. In some embodiments, attached to an exterior of trim/casing 131 may be two oppositely disposed spring-clips 155. In some embodiments, attachment of a spring-clip 155 to an exterior of trim/casing 131 may be by fastening-means 156. In some embodiments, fastening-means 156 may be one or more of: mechanical fasteners, screws, bolts, rivets, pins, dowels, welds, adhesives, portions thereof, combinations thereof, and/or the like. In some embodiments, a spring-clip 155 may comprise a base 157, a spring 158, and a region-of-external-contact 159. In some embodiments, base 157 may be attached an external portion of conical-exterior 133 (and/or of trim/casing 131) by fastening-means 156. In some embodiments, at least some portion of spring 158 may be helical/coil spring. In some embodiments, a length of the helical/coil spring portion of spring 158 may be at least substantially (mostly) orthogonal to common longitudinal center 201. In some embodiments, spring 158 may be attached to base 157, disposed away from fastening-means 156. In some embodiments, region-of-external-contact 159 may also be attached to spring 158. In some embodiments, spring 158 may be disposed between base 157 and region-of-external-contact 159. In some embodiments, region-of-external-contact 159 may be terminal end distal portion of spring-clip 155 that is disposed away from base 157. In some embodiments, the terminal end distal portion of region-of-external-contact 159 may be covered/coated with an elastomer, rubber, plastic, silicone, and/or the like. In some embodiments, region-of-external-contact 159 may be configured to come into (removable) physical contact with interior surfaces of can/housing 301, a hole in drywall, and/or the like. In some embodiments, region-of-external-contact 159 may be configured to (removably) frictionally grip interior surfaces of can/housing 301, a hole in drywall, and/or the like.

Note, light fixture 100 of U.S. patent application Ser. No. 17/246,272 by the same inventor as the present invention utilized pressure-clip(s) 151; whereas, light fixture 100 of embodiments of the present invention may utilize spring-clip(s) 155. In some embodiments, light fixture 100 of embodiments of the present invention may not utilize pressure-clip(s) 151. In some embodiments, spring-clip 155 may be devoid of wing 153 structures of pressure-clip 151. In some embodiments, an overall length of pressure-clip 151 when attached to trim/casing 131 may be perpendicular (orthogonal) to an overall length of spring-clip 155 when attached to trim/casing 131. Pressure-clip 151 may be devoid of a helical/coil spring structure. Note, pressure-clip 151 and wing 153 are not shown in the figures of this present patent application; however, pressure-clip 151 and wing 153 are shown and described in prior U.S. patent application, patent application Ser. No. 17/246,272, by the same inventor as the present patent application.

Figure 1C:
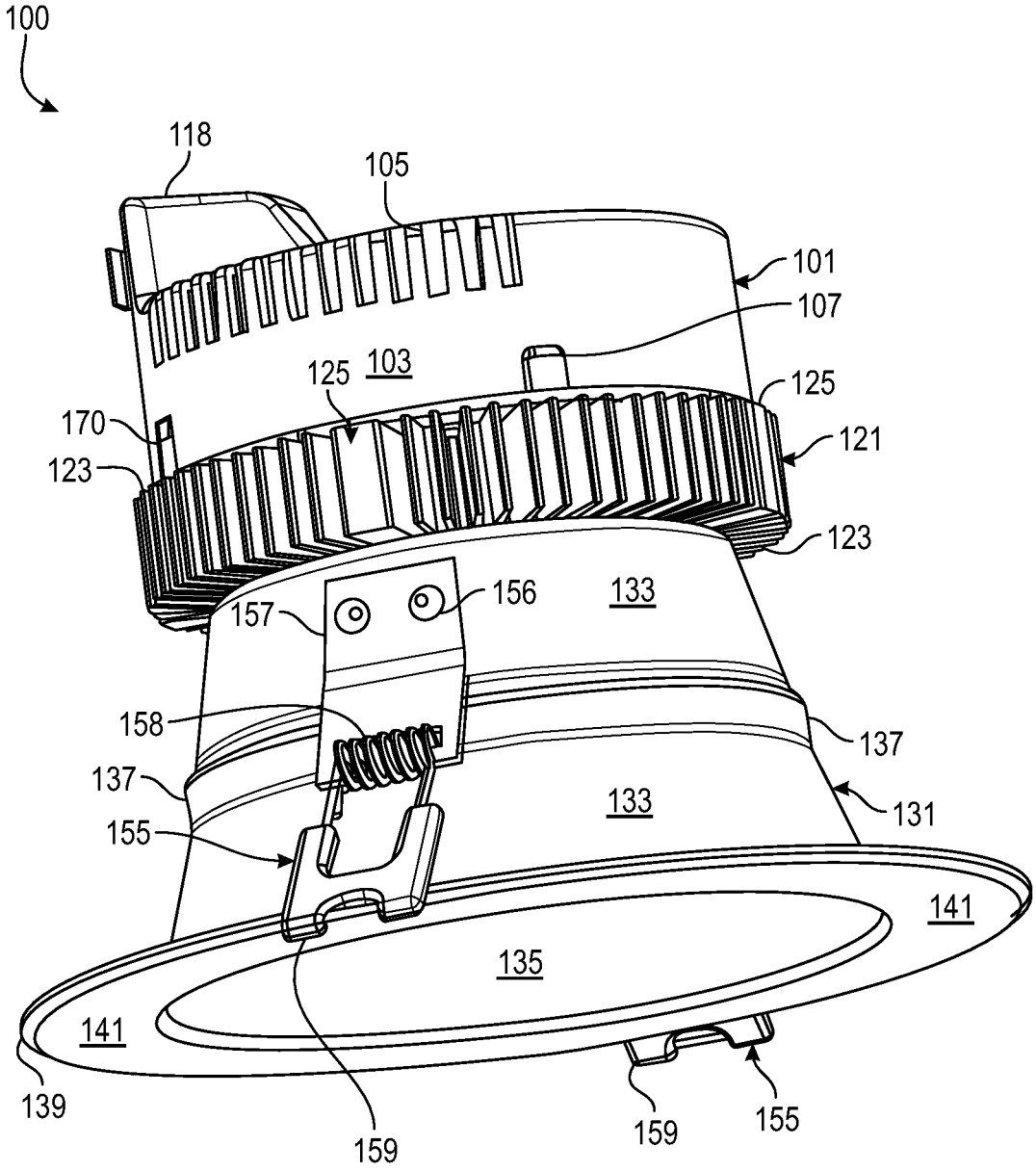
FIG. 1C depicts a bottom perspective view of the light fixture of FIG. 1A (in an assembled configuration).
Figure 1D:
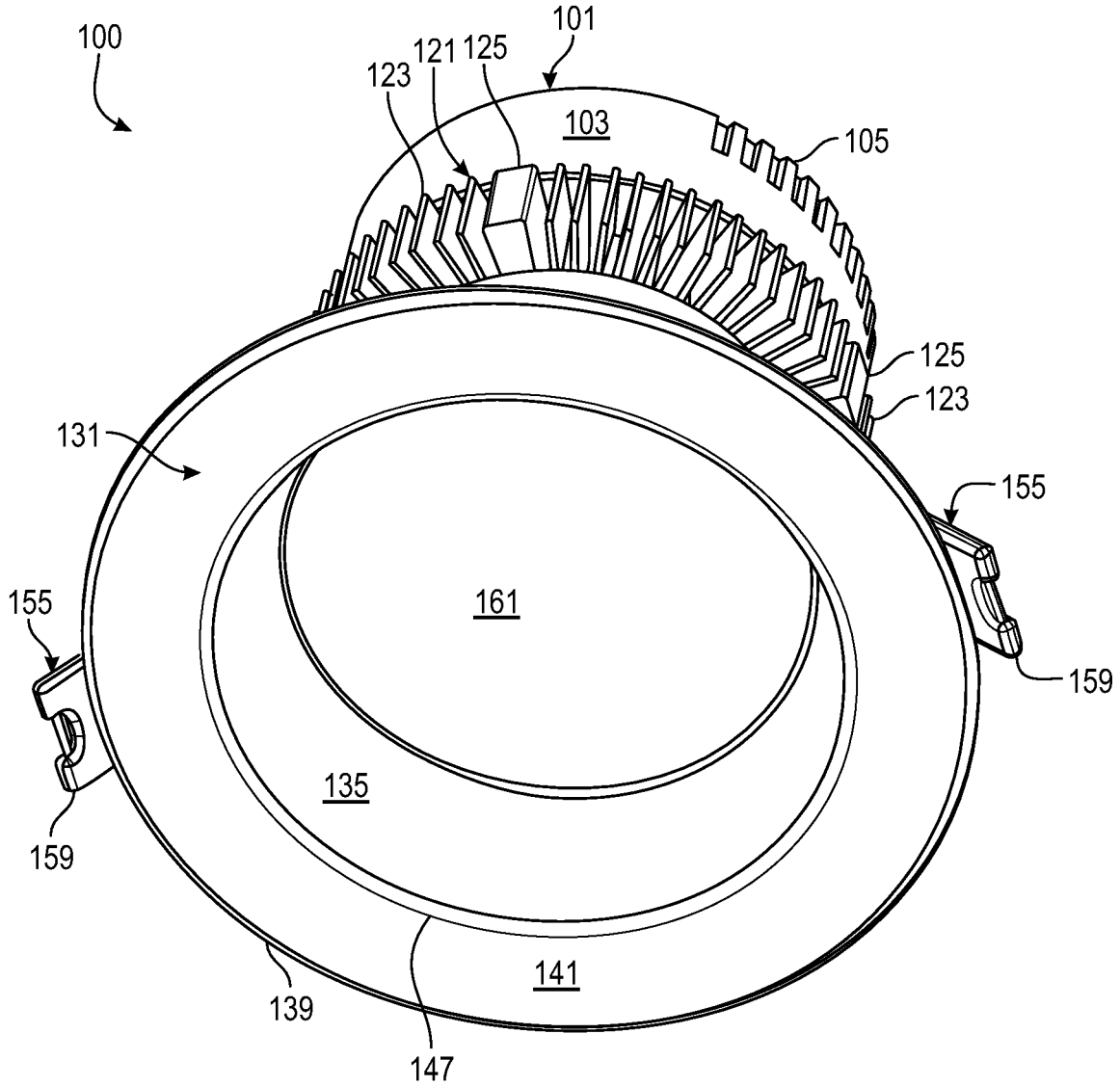
FIG. 1D depicts a bottom perspective view of the light fixture of FIG. 1A (in an assembled configuration).

FIG. 1C depicts a bottom perspective view of light fixture 100 (in an assembled configuration). FIG. 1D depicts another bottom perspective view of light fixture 100 (in an assembled configuration). The bottom perspective views of FIG. 1C and of FIG. 1D are different perspective views. In some embodiments, light fixture 100 may comprise trim/casing 131. In some embodiments, flange 139 may be a (bottom) portion of trim/casing 131. In some embodiments, flange 139 may comprise flange-bottom 141. In some embodiments, flange-bottom 141 may be a bottom external surface of flange 139. In some embodiments, flange-bottom 141 and flange-top 143 may be oppositely disposed external surfaces of flange 139. In some embodiments, flange-bottom 141 may be a mostly planar, flat, disk/disc like, annular member. In some embodiments, when light fixture 100 may be installed in a ceiling or wall, flange-bottom 141 may be visible overlapping drywall (or the like). In some embodiments, when light fixture 100 may be installed in a ceiling or wall, flange 139 may trim out (cover) a hole cut into the drywall (or the like), wherein this hole in the drywall (or the like) may be for receiving can/housing 301 and/or light fixture 100. In some embodiments, flange-bottom 141 may be visible from bottom views of light fixture 100. See e.g., FIG. 1C, FIG. 1D, and/or FIG. 1J for bottom view of light fixture 100.

Figure 1E:
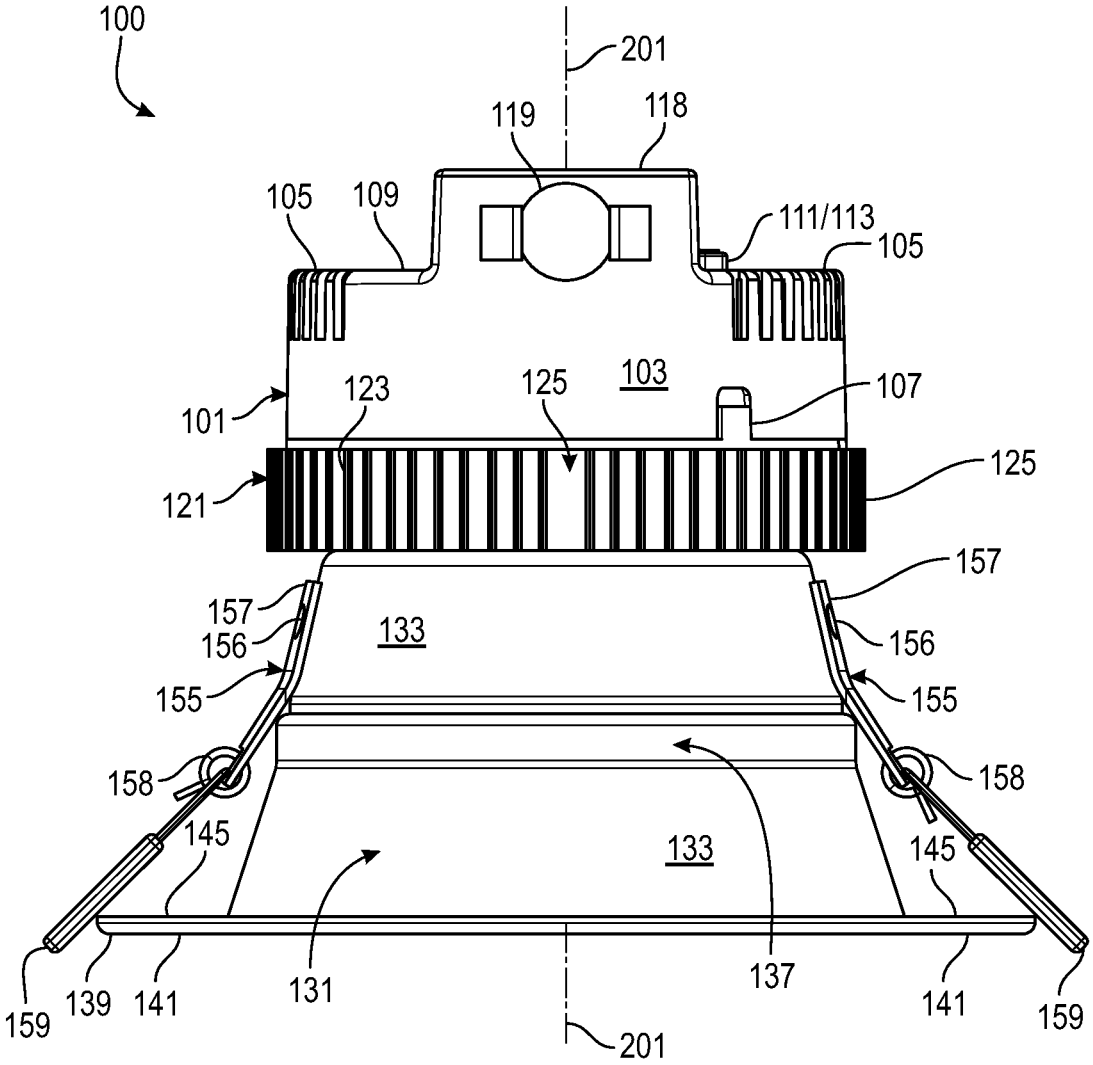
FIG. 1E depicts a front view of the light fixture of FIG. 1A (in an assembled configuration).
Figure 1F:
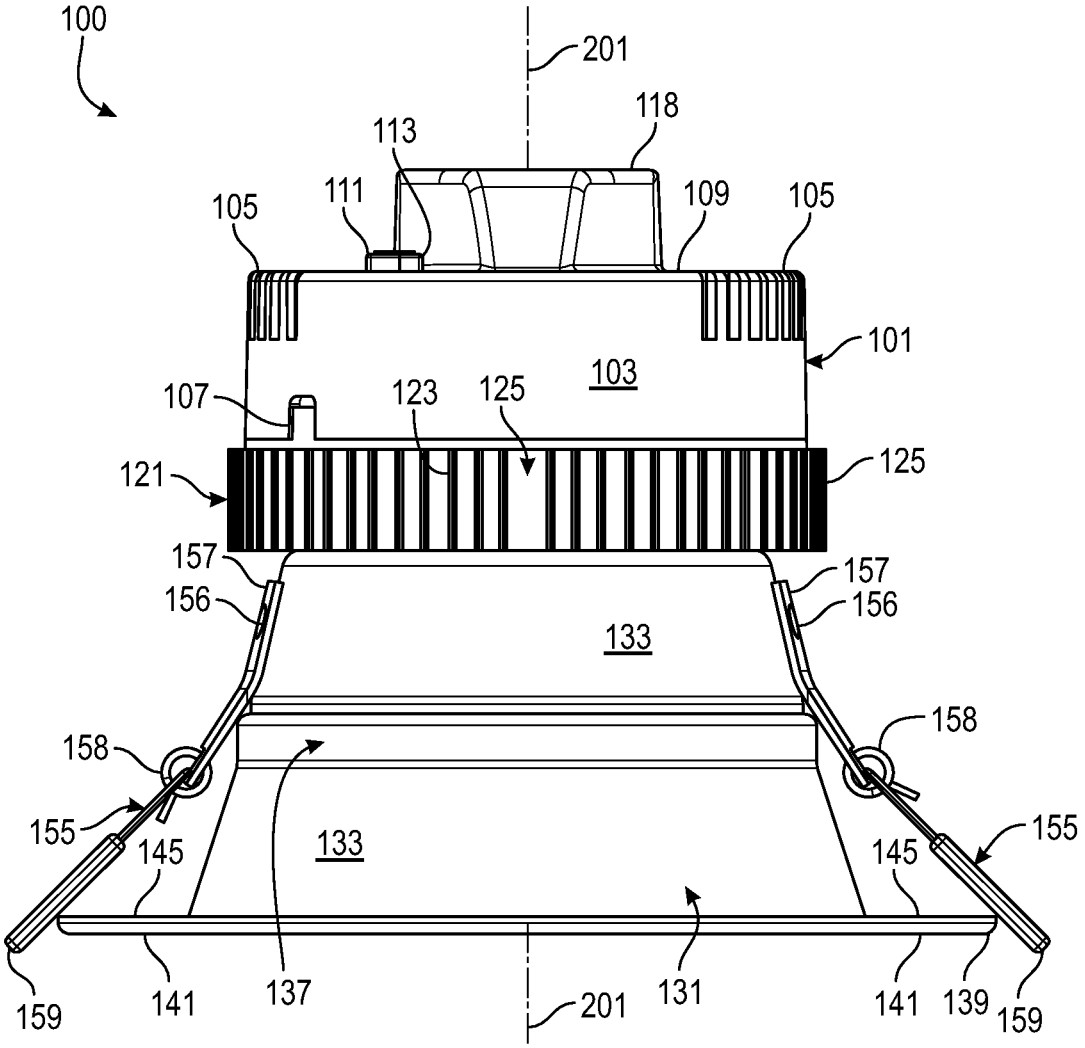
FIG. 1F depicts a back (rear) view of the light fixture of FIG. 1A (in an assembled configuration).
Figure 1G:
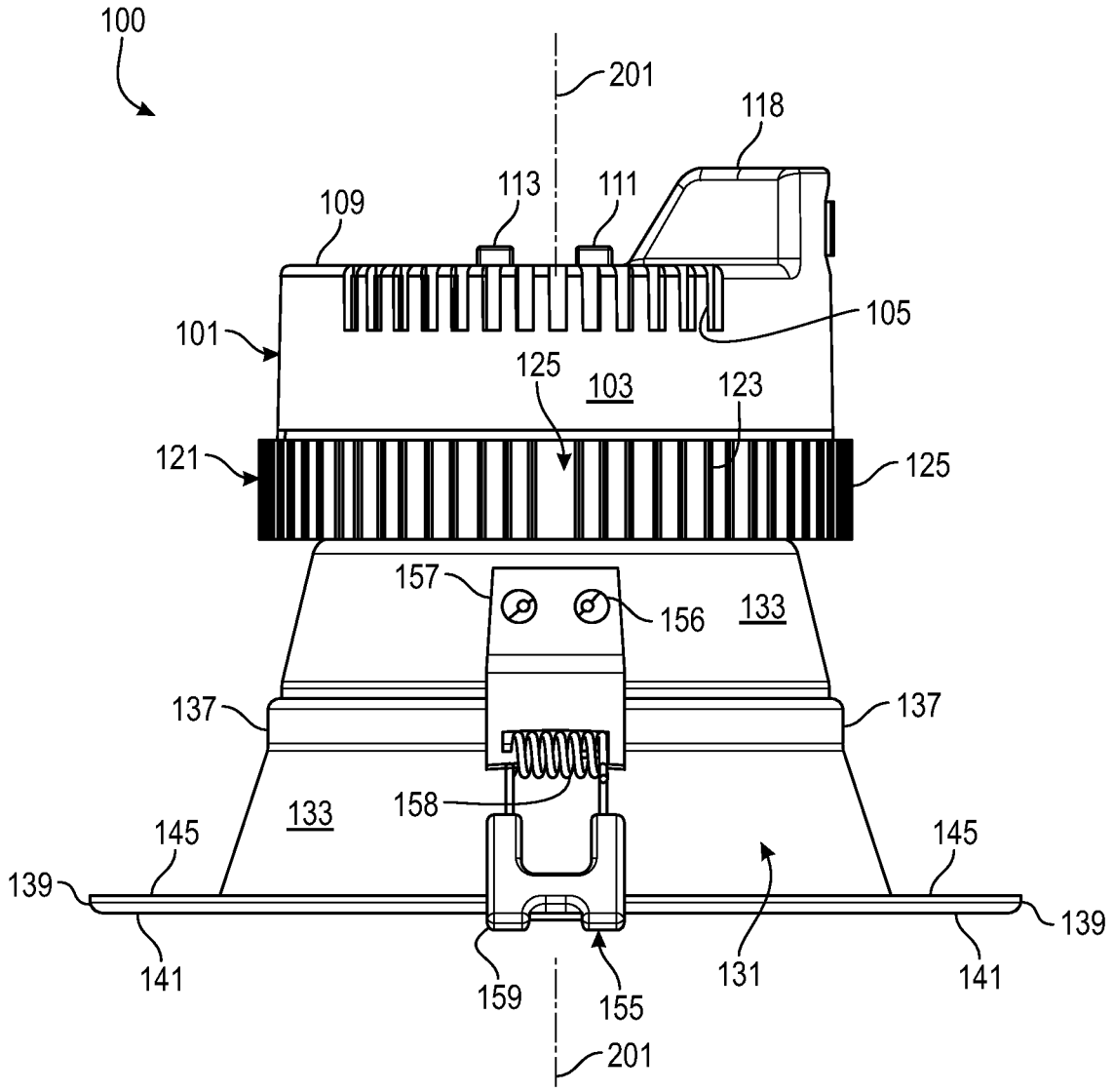
FIG. 1G depicts a left-side view of the light fixture of FIG. 1A (in an assembled configuration).
Figure 1H:
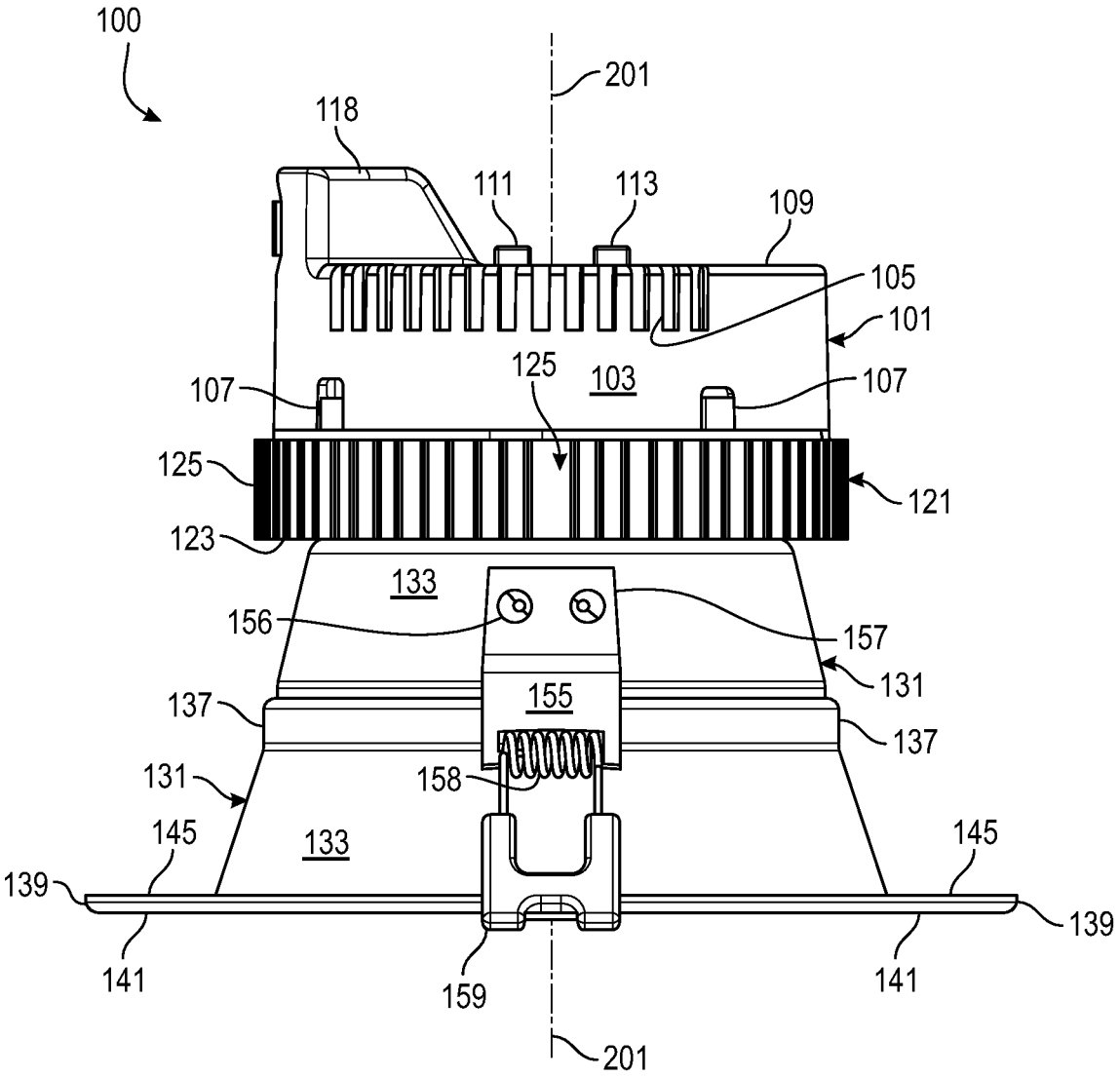
FIG. 1H depicts a right-side view of the light fixture of FIG. 1A (in an assembled configuration).
Figure 1I:
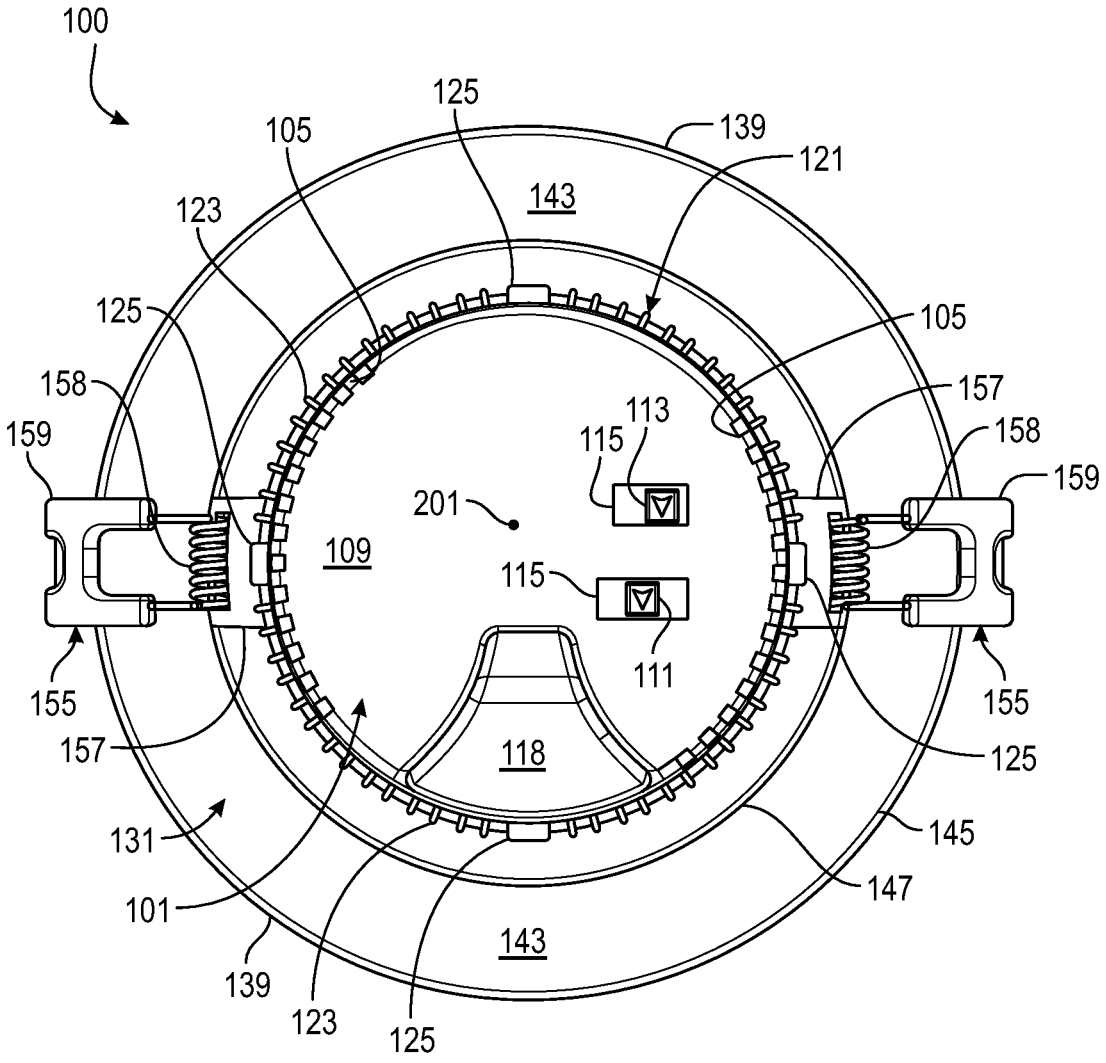
FIG. 1I depicts a top view of the light fixture of FIG. 1A (in an assembled configuration).
Figure 1J:
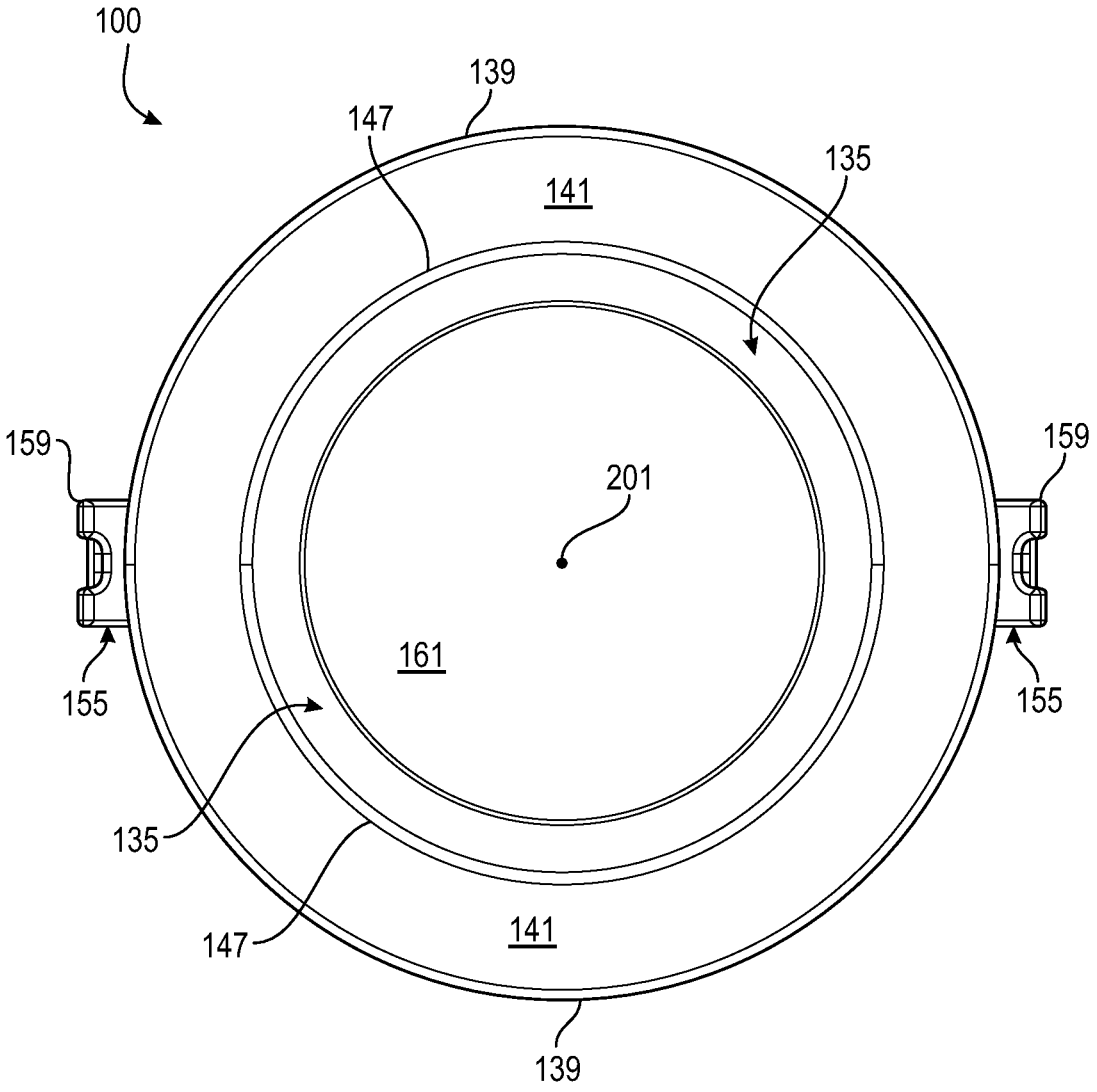
FIG. 1J depicts a bottom view of the light fixture of FIG. 1A (in an assembled configuration).

Continuing discussing FIG. 1C, FIG. 1D, and/or FIG. 1J, in some embodiments, lens 161 may be configured to permit passage of light. In some embodiments, lens 161 may be substantially optically clear, transparent, translucent, portions thereof, combinations thereof, and/or the like. In some embodiments, lens 161 may be substantially optically clear, transparent, translucent, portions thereof, combinations thereof, and/or the like, with respect to a predetermined range of wavelengths of light, of lumens, of light color-temperatures, portions thereof, combinations thereof, and/or the like. In some embodiments, lens 161 may be curved for a purpose of focusing light passing through and out of lens 161. In some embodiments, lens 161 may be mounted inside of trim/casing 131. In some embodiments, at least some portion of lens 161 may be visible from bottom views of light fixture 100. In some embodiments, lens 161 may be inserted into light fixture 100 from the bottom of light fixture 100; i.e., from below flange 139.

In some embodiments, lens 161 may be as lens 161 is shown and described in prior U.S. patent application Ser. No. 17/246,272 by the same inventor as the present invention.

FIG. 1E depicts a front view of light fixture 100 (in an assembled configuration). FIG. 1F depicts a back (rear) view of light fixture 100 (in an assembled configuration). FIG. 1G depicts a left-side view of light fixture 100 (in an assembled configuration). FIG. 1H depicts a right-side view of light fixture 100 (in an assembled configuration). In some embodiments, because of the mostly radial symmetry of light fixture 100 about common longitudinal center 201, the front view, the back (rear) view, the left-side view, and the right-side view may all be side views of light fixture 100. In some embodiments, integral-bulge 118 may be located closer to the front of driver-box 101 than to the back (rear) of driver-box 101, see e.g., FIGS. 1E to 1H. In some embodiments, due to asymmetry of a shape of integral-bulge 118 and an asymmetry of placement (location) of integral-bulge 118 on top 109 of driver-box 101, aperture-for-wiring 119 may be visible in FIG. 1E, but may not be visible in FIG. 1F to FIG. 1H. In some embodiments, the two spring-clips 155 may be located to either side of integral-bulge 118, see e.g., FIG. 1E and FIG. 1F. In some embodiments, a spring-clip 155 and a fin-thick 125 may be in vertical alignment, with respect to the overall length of spring-clip 155 and with respect to a height of fin-thick 125, with both this spring-clip 155 and the above located fin-thick 125 sharing a common vertical (imaginary) line, see e.g., FIG. 1G and FIG. 1H. In some embodiments, lumen-switch-cover 111 and color-temperature-switch-cover 113 may be located closer to the right-side of driver-box 101 than to the left-side of driver-box 101, see e.g., FIG. 1E to FIG. 1H. In other embodiments, the opposite configuration/arrangement may be employed. In some embodiments, a total (overall) height of light fixture 100 may be four (4) inches (not including wiring/cabling). In other embodiments, the total (overall) height of light fixture 100 may be a different dimension, but fixed and predetermined. See e.g., FIG. 1E to FIG. 1H. In some embodiments, at least portions of lumen-switch-cover 111 and/or color-temperature-switch-cover 113 may extend/protrude orthogonally away from top 109 and above top 109. See e.g., FIG. 1E to FIG. 1H. In some embodiments, side-wall 103 may comprise at least one notch 107. In some embodiments, side-wall 103 may comprise at least two notches 107. In some embodiments, notch 107 may be a notch, a cutout, a hole, an aperture, portions thereof, combinations thereof, and/or the like, in side-wall 103. In some embodiments, notch 107 may be configured and sized for the passage of at least some portions of wiring and/or cabling. In some embodiments, notch 107 may be located closer to the bottom of driver-box 101 than to top 109. In some embodiments, notch 107 may be extend from the bottom of driver-box 101 towards top 109, but notch 107 may not touch top 109. In some embodiments, notch 107 may be on a bottom one-third to a bottom one-half of driver-box 101. See e.g., FIG. 1E to FIG. 1H.

In some embodiments, a greatest diameter of light fixture 100 may be an outside diameter of flange 139. In some embodiments, an outside diameter of heat-sink 121 may be larger than an outside diameter of driver-box 101. In some embodiments, the outside diameter of heat-sink 121 may be about the same as an outside diameter of cylindrical-region 137 of the mostly conical member of trim/casing 131. See e.g., FIG. 1E to FIG. 1H.

In some embodiments, cylindrical-region 137 may be located about one (1) inch from flange 139/flange-bottom 141. See e.g., FIG. 1E to FIG. 111.

In some embodiments, the fins 123/125 of heat-sink 121 may run from a bottom of heat-sink 121 to a top of heat-sink 121. See e.g., FIG. 1E to FIG. 111.

FIG. 1I depicts a top view of light fixture 100 (in an assembled configuration). In some embodiments, fins 105 of driver-box 101 may be grouped into two opposing groups of fins 105, separated by two opposing regions of no fins 105. In some embodiments, top 109 may comprise one or more of: lumen-switch-cover 111, color-temperature-switch-cover 113, switch-aperture 115, indicia 117, portions thereof, combinations thereof, and/or the like. In some embodiments, driver-box 101 may comprise two distinct, different, opposing sets of fins 105 configured for heat dissipation. In some embodiments, the two distinct, different, opposing sets of fins 105 may be equally spaced apart from each other by regions of driver-box 101 without fins 105. In some embodiments, one of these regions of top 109 of driver-box 101 without fins 105 may also comprise at least a portion of integral-bulge 118. In some embodiments, each fin 105, selected from the two distinct, different, opposing sets of fins 105 may runs from a side-wall 103 of driver-box 101 to a top 109 of driver-box 101. However, in some embodiments, a bottom portion of driver-box 101 side-wall 103 may have no fins 105.

Continuing discussing FIG. 1I, in some embodiments, lumen-switch-cover 111 may be configured to be removably interacted with by fingers, thumb(s), and/or hand(s) of a user to select lumen output of light fixture 100. In some embodiments, color-temperature-switch-cover 113 may be configured to be removably interacted with by fingers, thumb(s), and/or hand(s) of a user to select light color-temperature output of light fixture 100. In some embodiments, lumen-switch-cover 111 and/or color-temperature-switch-cover 113 may be a membrane cover. In some embodiments, the membrane cover may be water resistant or water proof.

Continuing discussing FIG. 1I, in some embodiments, top 109 may have one or more holes, for example, switch-aperture(s) 115. In some embodiments, switch-aperture 115 may be a hole in top 109. In some embodiments, switch-aperture 115 may be configured to pass and/or receive at least a portion of: lumen-switch-cover 111, color-temperature-switch-cover 113, lumen-switch 211, color-temperature-switch 213, portions thereof, combinations thereof, and/or the like through top 109. In some embodiments, there may be one switch-aperture 115 for lumen switching and one switch-aperture 115 for color-temperature switching. In some embodiments, the two switch-apertures 115 may be grouped together side by side (e.g., towards a right-side of top 109 of driver-box 101.

In some embodiments, various indicia 117 are shown and described in prior U.S. patent application Ser. No. 17/246,272 by the same inventor as the present invention. In some embodiments, top 109 may comprise various indicia 117. In some embodiments, indicia 117 may be one or more of: a logo, a company name, a trademark, a brand, a trade name, a slogan, a catch phrase, a model number, a serial number, a range of selectable lumens, a range of selectable color-temperatures, a registration number, certification information, testing information, standards information, rating information, specification information, a lot number, inspection information, a patent number, patent pending status, a website, a phone number, a mailing address, portions thereof, combinations thereof, and/or the like. In some embodiments, adjacent and next to each switch-aperture 115 may be indicia of a range of selectable lumens and/or a range of selectable color-temperatures. In some embodiments, indicia 117 may be in the form of one or more of: a sticker, printed onto top 109, written onto top 109, painted onto top 109, drawn onto top 109, stenciled onto top 109, engraved onto top 109, carved into top 109, molded directly into top 109, portions thereof, combinations thereof, and/or the like.

Continuing discussing FIG. 1I, in some embodiments, flange 139 may comprise flange-top 143 and flange-lip 145. In some embodiments, flange-top 143 may be an opposing surface with respect to flange-bottom 141. In some embodiments, flange-bottom 141 and flange-top 143 may be different opposing sides/surfaces of flange 139. In some embodiments, when light fixture 100 may be installed in a ceiling and/or wall, flange-top 143 may not be visible from below. In some embodiments, flange-top 143 may be a mostly planar, flat, disk/disc like, annular member. In some embodiments, towards an outside edge of flange 139 may be flange-lip 145. In some embodiments, flange-lip 145 may be an annular fixed ridge the extends/protrudes orthogonally away from flange-top 143 (towards top 109 and/or towards top 263). In some embodiments, flange-conical-transition 147 may indicate where flange 139 begins and the mostly conical member of trim/casing 131 ends. In some embodiments, flange-conical-transition 147 may be relatively smooth. In some embodiments, flange-conical-transition 147 may be devoid of a raised wall/ridge. In some embodiments, the outside diameter of flange 139 may be five and one-half (5½) inches. In some embodiments, an inside diameter of flange 139 may be four (4) inches. In other embodiments, one or more of these diameter dimensions may be different, but fixed and predetermined.

FIG. 1J depicts a bottom view of light fixture 100 (in an assembled configuration). From FIG. 1J the following may be visible (from outside of flange 139 towards common longitudinal center 201): bottom portions of oppositely disposed region-of-external-contact 159; flange-bottom 141; at least some portions of conical-interior 135; at least some bottom portions of reflector 251 (in some embodiments); at least some bottom portions of lens 161; portions thereof; combinations thereof; and/or the like. In some embodiments, reflector 251 may be located above lens 161 (inside of upper-portion 261), so not visible in FIG. 1J.

Figure 2A:
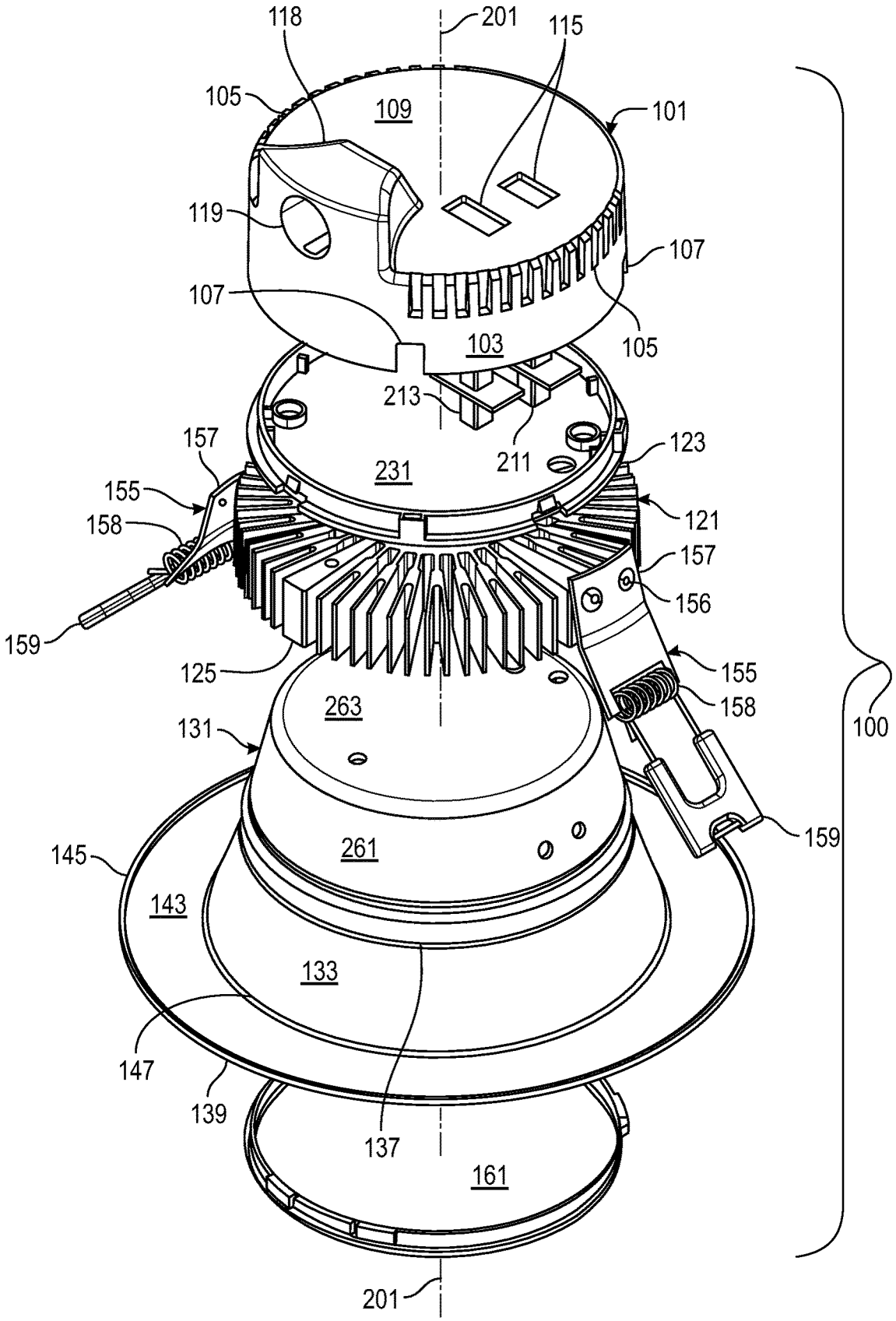
FIG. 2A depicts a top perspective exploded view (at least partially exploded view) of the light fixture of FIG. 1A.
Figure 2B:
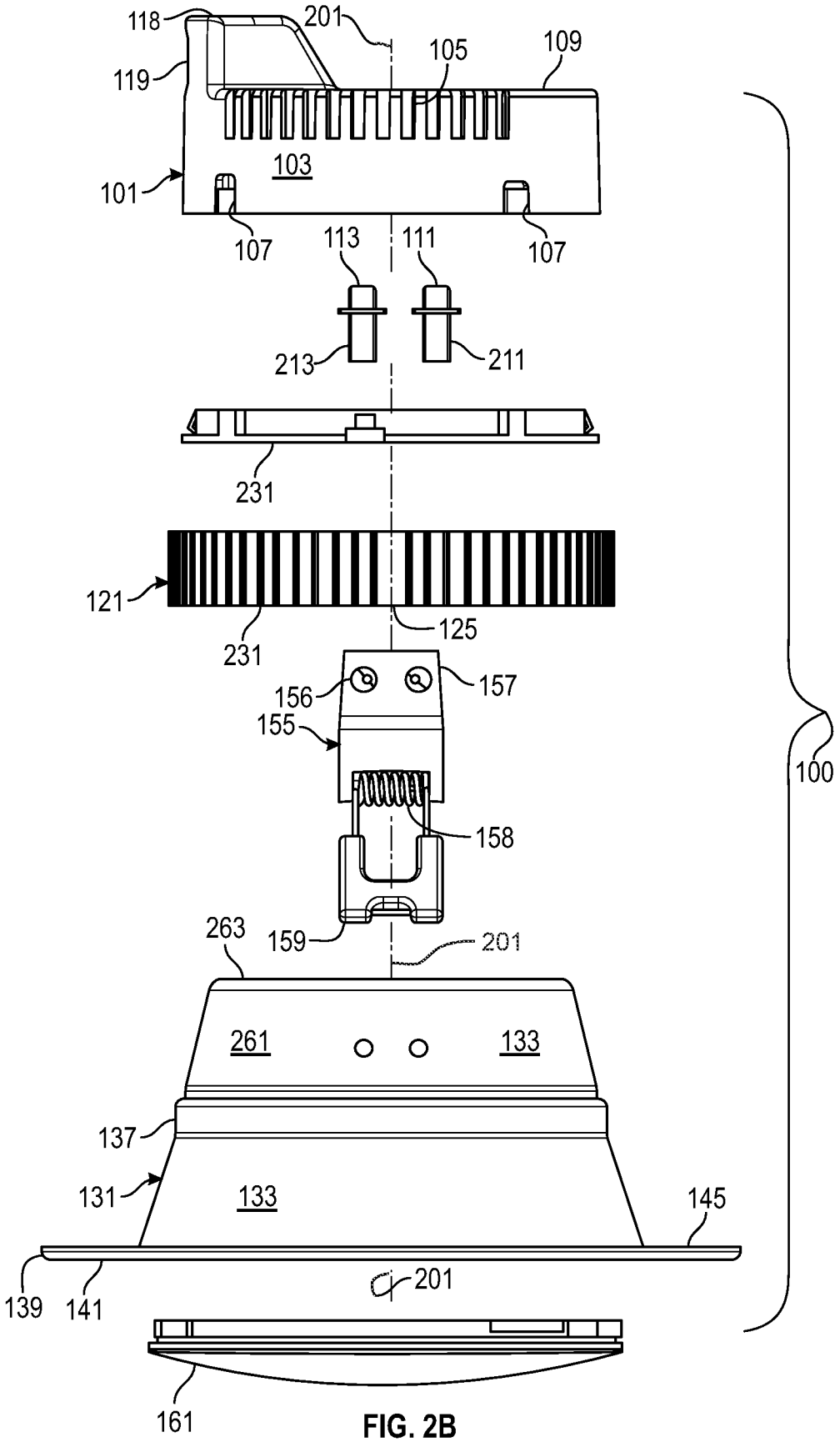
FIG. 2B depicts a right-side exploded view (at least partially exploded view) of the light fixture of FIG. 1A.
Figure 2C:
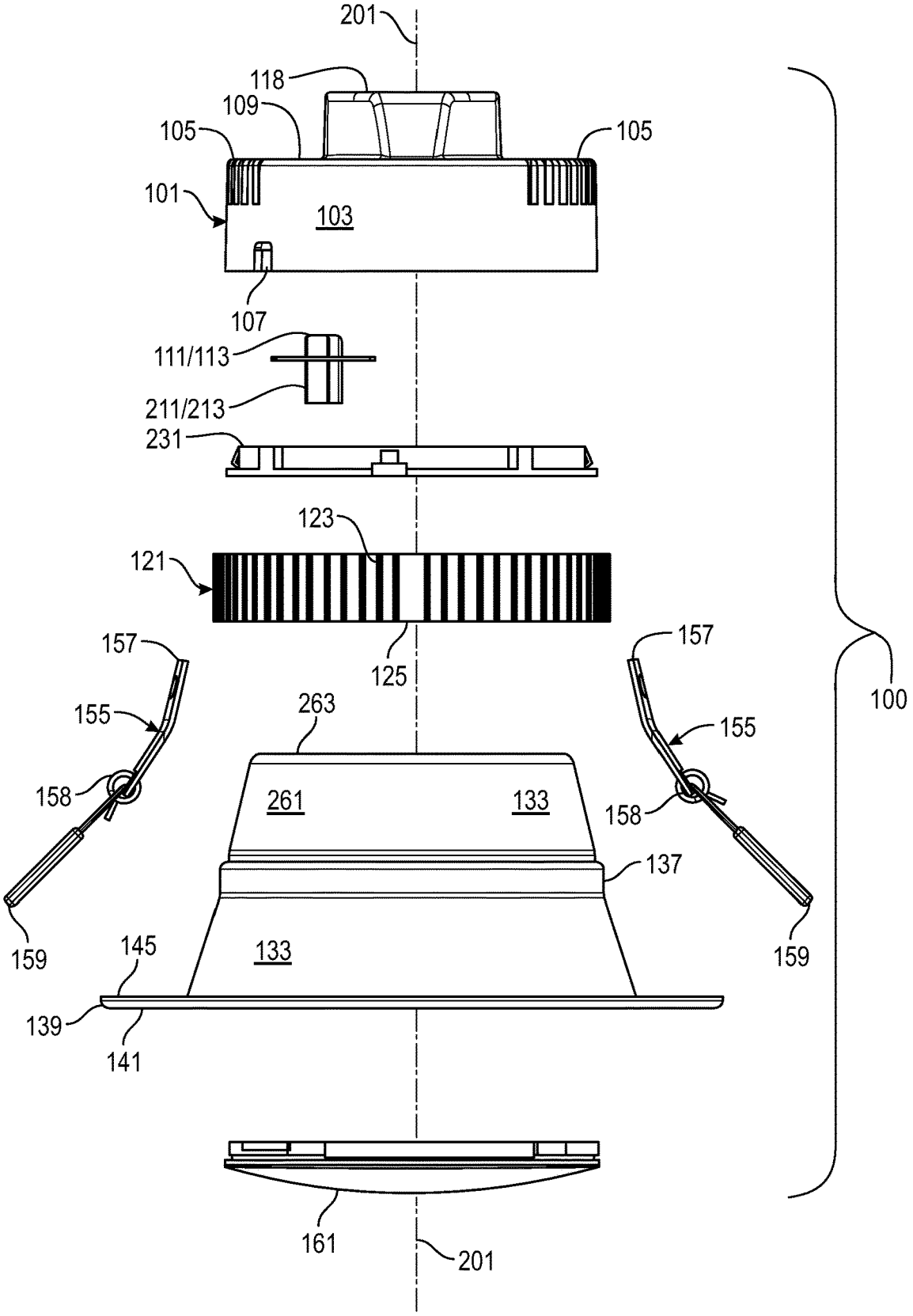
FIG. 2C depicts a back (rear) exploded view (at least partially exploded view) of the light fixture of FIG. 1A.
Figure 2D:
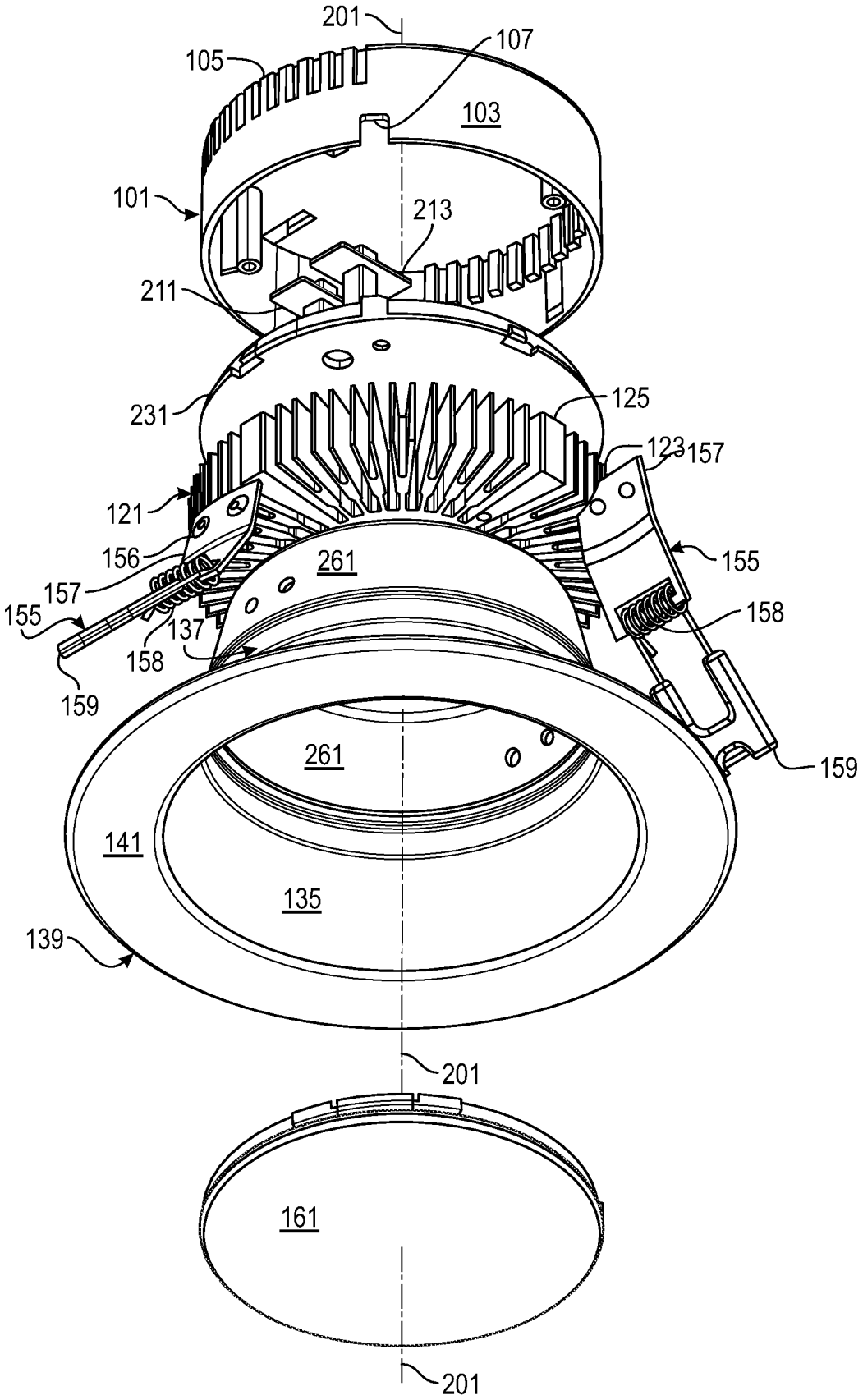
FIG. 2D depicts a bottom perspective exploded view (at least partially exploded view) of the light fixture of FIG. 1A.
Figure 2E:
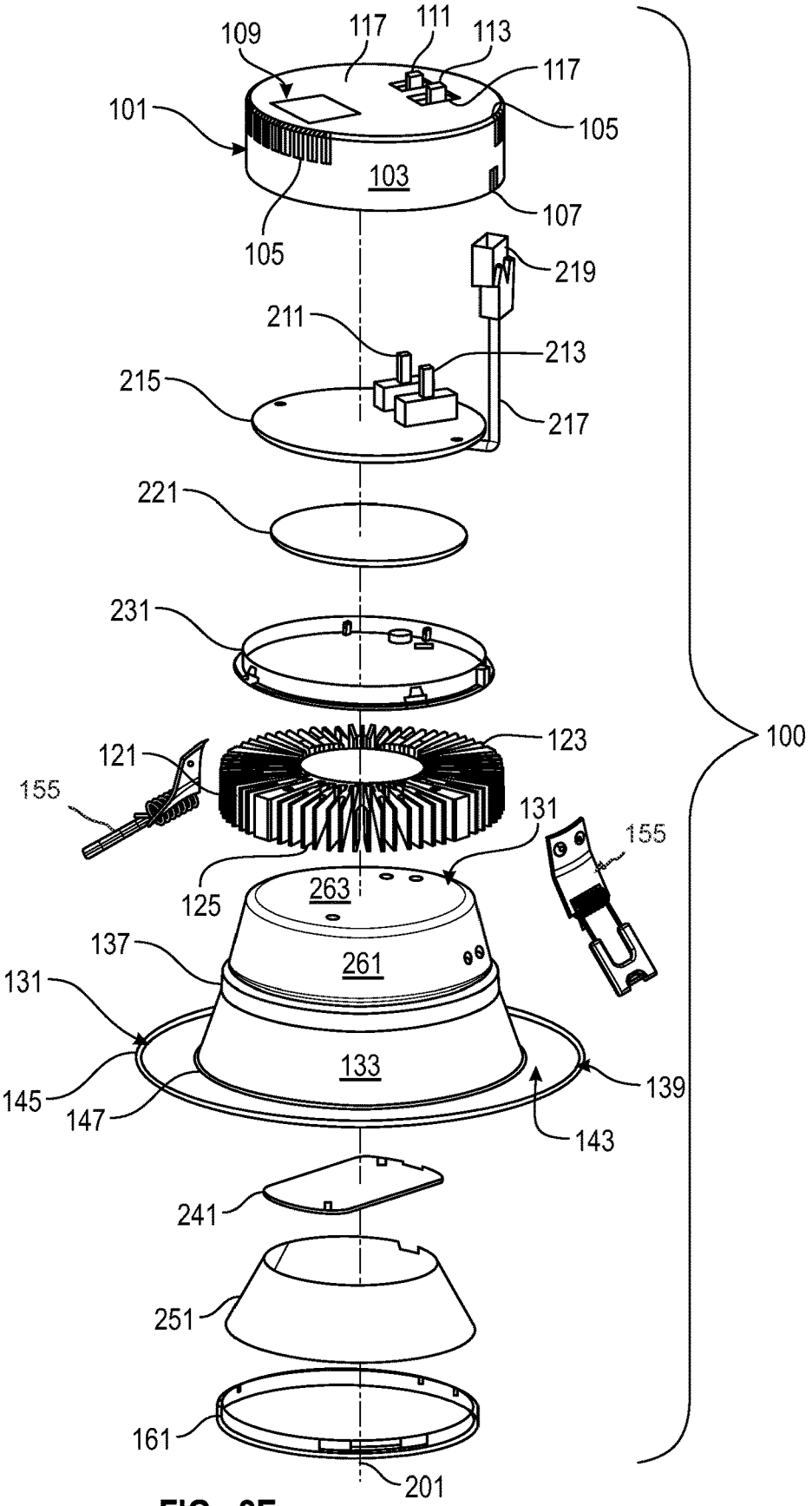
FIG. 2E depicts a top perspective exploded view (at least partially exploded view) of the light fixture of FIG. 1A.

FIG. 2A depicts a top perspective exploded view (at least partially exploded view) of light fixture 100. FIG. 2B depicts a right-side exploded view (at least partially exploded view) of light fixture 100. FIG. 2C depicts a back (rear) exploded view (at least partially exploded view) of light fixture 100. FIG. 2D depicts a bottom perspective exploded view (at least partially exploded view) of light fixture 100. FIG. 2E depicts a top perspective exploded view (at least partially exploded view) of light fixture 100.

FIG. 2A through FIG. 2E may show common longitudinal center 201 of light fixture 100. In some embodiments, common longitudinal center 201 is also an imaginary central axis of light fixture 100 wherein the main component parts are exploded along this imaginary line in FIG. 2A through FIG. 2E.

In some embodiments, light fixture 100 may be configured for mounting within a given can/housing 301 (see e.g., parent (prior) patent application Ser. No. 17/246,272, by the same inventor as the present patent application for can/housing 301). In some embodiments, light fixture 100 may comprise a driver assembly, heat-sink 121, and a trim-casing assembly.

Continuing discussing FIG. 2A through FIG. 2E, in some embodiments, the driver assembly may comprise at least driver-box 101. In some embodiments, the driver assembly may comprise driver-PCB 221, lumen-switch 211, color-temperature-switch 213, and driver-box 101. In some embodiments, driver-PCB 221, lumen-switch 211, and color-temperature-switch 213 may be at least mostly housed within driver-box 101. In some embodiments, driver-PCB 221 may be configured to provide electrical power and/or to control LED-chipboard 241 (or the like). In some embodiments, lumen-switch 211 may be configured to change a lumen output of LED-chip/board 241 (or the like). In some embodiments, color-temperature-switch 213 may be configured to change a light color-temperature output of LED-chip/board 241 (or the like). See e.g., FIG. 2A through FIG. 2E.

Continuing discussing FIG. 2A through FIG. 2E, in some embodiments, the driver assembly may further comprise lumen-switch-cover 111 and color-temperature-switch-cover 113. In some embodiments, lumen-switch-cover 111 may cover over the lumen-switch 211. In some embodiments, lumen-switch-cover 111 may be in physical communication with the lumen-switch 211. In some embodiments, color-temperature-switch-cover 113 may cover over color-temperature-switch 213. In some embodiments, color-temperature-switch-cover 113 may be in physical communication with the color-temperature-switch 213. In some embodiments, at least a portion of lumen-switch 211 (and/or lumen-switch-cover 111) and at least a portion of the color-temperature-switch 213 (and/or temperature-switch-cover 113) both extend and protrude orthogonally away from an exterior surface of driver-box 101. In some embodiments, at least a portion of lumen-switch 211 (and/or lumen-switch-cover 111) and at least a portion of the color-temperature-switch 213 (and/or temperature-switch-cover 113) both extend and protrude orthogonally away from an exterior surface of top 109. In some embodiments, at least a portion of the lumen-switch-cover 111 and at least a portion of the color-temperature-switch-cover 113 may be both configured to be engaged (i.e., switched to different positions) by a finger, a thumb, and/or a hand of a user.

Continuing discussing FIG. 2A through FIG. 2E, in some embodiments, the driver assembly may further comprise one or more of: lumen-switch-cover 111, color-temperature-switch-cover 113, switch chassis 215, wiring/cabling, power connector (s), driver-cap 231, portions thereof, combinations thereof, and/or the like. In some embodiments, driver-cap 231 may cover over the otherwise open bottom of driver-box 101. In some embodiments, driver-cap 231 may be (removably) attached to the open bottom of driver-box 101.

Continuing discussing FIG. 2A through FIG. 2E, in some embodiments, the trim-casing assembly may comprise at least trim/casing 131. In some embodiments, the trim-casing assembly may comprise at least trim/casing 131 and lens 161. In some embodiments, the trim-casing assembly may comprise LED-chip/board 241, reflector 251, lens 161, a can-attachment-means (or a receiving hole attachment means), and trim/casing 131. In some embodiments, reflector 251 and/or lens 161 may be housed within trim/casing 131. In some embodiments, LED-chip/board 241, reflector 251, and lens 161 may be housed within trim/casing 131. In some embodiments, LED-chip/board 241 may be on top of a top of trim/casing 131. In some embodiments, LED-chip/board 241 may be configured to output light of a predetermined luminosity and of a predetermined light color-temperature. In some embodiments, the can-attachment-means (or the receiving hole attachment means), may be mounted (attached) to an exterior of trim/casing 131 (e.g., via fastening-means 156). In some embodiments, the can-attachment-means (or the receiving hole attachment means), may be mounted (attached) to an exterior of the conical member portion of trim/casing 131 (e.g., via fastening-means 156). In some embodiments, the can-attachment-means may be configured to removably mount light fixture 100 within can/housing 301. In some embodiments, the receiving hole attachment means (e.g., spring-clip(s) 155) may be configured to removably mount light fixture 100 within a receiving hole in drywall. In some embodiments, the can-attachment-means (or the receiving hole attachment means) may be one or more of: pressure-clip 151, spring-clip 155, torsion-spring 451, combinations thereof, and/or the like.

Continuing discussing FIG. 2E, in some embodiments, lumen-switch 211, color-temperature-switch 213, and LED-chip/board 241 may all be operatively connected to driver-PCB 221. In some embodiments, heat-sink 121 may be disposed below the driver assembly (below driver-box 101 and/or below driver-cap 231) and entirely above the trim-casing assembly (above trim-casing 131). In some embodiments, heat-sink 121 may be disposed entirely below driver-cap 231 and entirely above trim/casing 131.

Continuing discussing FIG. 2E, in some embodiments, when light fixture 100 may be assembled, switch chassis 215, driver-PCB 221, and driver-cap 231 may be located at least mostly to entirely within the hollow interior of driver-box 101. In some embodiments, when light fixture 100 may be assembled, lumen-switch 211 and color-temperature-switch 213 may be located at least partially within the hollow interior of driver-box 101. In some embodiments, switch chassis 215 may be a structural member wherein lumen-switch 211 and/or color-temperature-switch 213 are attached thereto. In some embodiments, switch chassis 215 may be a mostly circular disc like member. In some embodiments, switch chassis 215 may comprise circuitry, wiring, cabling, wiring/cabling, switches, lumen-switch 211, color-temperature-switch 213, portions thereof, combinations thereof, and/or the like. In some embodiments, driver-PCB 221 may be a printed circuit board. In some embodiments, driver-PCB 221 may comprise one or more circuits. In some embodiments, driver-PCB 221 may be configured for lighting/LED driver, control, management, and/or regulation functions. In some embodiments, driver-PCB 221 may have a power factor greater than 0.9 and a start time of less than 0.75 seconds. In some embodiments, driver-PCB 221 may be electrically coupled to: lumen-switch 211, color-temperature-switch 213, wiring/cabling, power connector(s), LED-chip/board 241, wiring, cabling, portions thereof, combinations thereof, and/or the like. In some embodiments, driver-cap 231 may cover over the bottom of driver-box 101. In some embodiments, driver-PCB 221 may be referred to as a "driver-printed-circuit-board." In some embodiments, driver-cap 231 may be (removably) attached to the bottom of driver-box 101 and/or to a top of heat-sink 121. In some embodiments, driver-cap 231 may be a mostly planarly flat plate disc like member (with hole(s) for wire passage and/or for mechanical fasteners).

Continuing discussing FIG. 2A through FIG. 2E, in some embodiments, light fixture 100 may comprise various wiring/cabling. In some embodiments, wiring/cabling may be configured for electrical power transmission. In some embodiments, wiring/cabling may terminate in a power connector. In some embodiments, wiring/cabling may also terminate at lumen-switch 211, color-temperature-switch 213, switch chassis 215, portions thereof, combinations thereof, and/or the like. In some embodiments, the power connector may be configured to be removably attached to a complimentary power connector (e.g., power source 303), so that light fixture 100 may receive electrical power for operation. In some embodiments, light fixture 100 may comprise other wiring and/or cabling in addition to this wiring/cabling. See U.S. patent application 17/246,272 for wiring/cabling 217, power connector 219, and power source 303.

Continuing discussing FIG. 2A through FIG. 2E, in some embodiments, light fixture 100 may be configured for operation at predetermined voltage and/or wattage. For example, and without limiting the scope of the present invention, in some embodiments, light fixture 100 may be configured for operation at 120 volts, 9.5 watts, 13.5 watts, and/or 18 watts. In other embodiments, light fixture 100 may be configured for operating at other voltages and/or wattages.

Continuing discussing FIG. 2A through FIG. 2E, in some embodiments, lumen-switch-cover 111 may cover over a below located lumen-switch 211. In some embodiments, lumen-switch-cover 111 may be in physical communication with below located lumen-switch 211. In some embodiments, color-temperature-switch-cover 113 may cover over a below located color-temperature-switch 213. In some embodiments, color-temperature-switch-cover 113 may be in physical communication with below color-temperature-switch 213.

Continuing discussing FIG. 2A through FIG. 2E, in some embodiments, lumen-switch 211 may be a switch configured to change the luminosity of emitted light from LED-chip/board 241 (or the like), within a predetermined range of luminosity (e.g., in lumens). In some embodiments, lumen-switch 211 may be configured to select lumens output from 1000 to 2000 lumens. In some embodiments, lumen-switch 211 may be configured to select lumens output at 1000 lumens, 1250 lumens, 1500 lumens, 1750 lumens, and/or 2000 lumens. In other embodiments, other predetermined lumens may be selected (selectable) by lumen-switch 211.

Continuing discussing FIG. 2A through FIG. 2E, in some embodiments, color-temperature-switch 213 may be a switch configured to change the emitted light color-temperature from LED-chip/board 241 (or the like), within a predetermined range of light color-temperatures (e.g., in Kelvin). In some embodiments, color-temperature-switch 213 may be configured to select light color-temperatures from 2700 Kelvin to 5000 Kelvin. In some embodiments, color-temperature-switch 213 may be configured to select light color-temperatures at 2700 Kelvin, 3000 Kelvin, 3500 Kelvin, 4000 Kelvin, and/or 5000 Kelvin. In other embodiments, other predetermined light color-temperatures may be selected (selectable) by color-temperature-switch 213.

Continuing discussing FIG. 2A through FIG. 2E, in some embodiments, heat-sink 121 may be configured to receive heat from electronic components of light fixture 100 and to then dissipate (expel/radiate) this received heat into the surrounding ambient air. In some embodiments, the electronic components of light fixture 100 that may generate and/or emit heat may be one or more of: LED-chip/board 241, driver-PCB 221, lumen-switch 211, color-temperature-switch 213, wiring/cabling, power connector(s), portions thereof, combinations thereof, and/or the like. In some embodiments, each fin 123/125 of heat-sink 121 may be shaped substantially as a rectangular prism. In some embodiments, a center of heat-sink 121 may be devoid of fins 123/125. In some embodiments, a center of heat-sink 121 may be devoid of material, i.e., the center may be void space (however wiring [not shown] may pass through this otherwise void space). In some embodiments, the four (4) fins-thick 125 may be equally spaced around heat-sink 121 with respect to the common longitudinal center 201 of light fixture 100; with a plurality of fins-thin 123 disposed between each fin-thick 125, such that there are four distinct regions (quadrants) of fins-thin 123. In some embodiments, heatsink 121 may comprise four fins-thick 125 and four groups of fins-thin 123. In some embodiments, each group of fins-thin 123 may be disposed two different of fins-thick 125. In some embodiments, all of fins-thick 125 and all of fins-thin 123 may be arranged radially around a common longitudinal center line 201 of light fixture 100. In some embodiments, all of fins-thick 125 and all of fins-thin 123 may have a same (exterior) height from a bottom of heat-sink 121 to a top of heat-sink 121. In some embodiments, an exterior of heat-sink 121 from a bottom of heat-sink 121 to a top of heat-sink 121 may be substantially cylindrical in shape with a same outer diameter up and down that exterior. In some embodiments, the exterior of heatsink 121 may be devoid of (free of) any steps. In some embodiments, the exterior of heat-sink 121 may be devoid of (free of) changes in external diameter. In some embodiments, the exterior of heat-sink 121 may be devoid of threading for attachment to trim/casing 131. In some embodiments, a fin-thick 125 may have a hole, wherein such a hole may be configured for receiving a screw, post, bolt, pin, mechanical fastener, portions thereof, combinations thereof, and/or the like, wherein this hole (in fin-thick 125) runs in a vertical direction, parallel to the common longitudinal center 201 of light fixture 100.

Continuing discussing FIG. 2A through FIG. 2E, in some embodiments, trim/casing 131 may comprise a substantially conical frustum member that has a mostly closed top 263 and an open base at flange 139. In some embodiments, the substantially conical frustum member may be interrupted by cylindrical-region 137 that is more cylindrical than conical. In some embodiments, a portion above the cylindrical-region 137 of trim/casing 131 is conical and a portion below cylindrical-region 137 of trim/casing 131 is conical. In some embodiments, lens 161 may be housed within cylindrical-region 137 of trim/casing 131. In some embodiments, reflector 251 and/or LED-chip/board 241 may be housed above lens 161 in an upper-portion 261 of trim/casing 131 that is conical. In some embodiments, an outside diameter of cylindrical-region 137 of trim/casing 131 is about the same as an outside diameter of heat-sink 121. In some embodiments, trim/casing 131 does not extend into a bottom of heat-sink 121.

Continuing discussing FIG. 2A through FIG. 2E, in some embodiments, cylindrical-region 137 may be sized and configured to removably receive lens 161 inside of cylindrical-region 137. In some embodiments, when light fixture 100 may be assembled, above lens 161 and inside of an upper-portion 261 of the mostly conical member of trim/casing 131 may be reflector 251 and/or LED-chip/board 241. In some embodiments, upper-portion 261 (of trim/casing 131) may be located between a top 263 of trim/casing 131 and cylindrical-region 137. In some embodiments, LED-chip/board 241 may be located on top of reflector 251 within upper-portion 261. In some embodiments, LED-chip/board 241 may be located closer to top 263 as compared to reflector 251. In some embodiments, top 263 may be mostly planarly flat and closed, aside from at least one hole. In some embodiments, a flat surface of top 263 may be at least substantially (mostly) parallel with flat surfaces of flange-top 143, flange-bottom 141, and/or most of top 109. In some embodiments, hole(s) in top 263 may be configured for passage/receiving of portions of wires/cables; and/or for attaching trim/casing 131 to heat-sink 121 via mechanical fasteners, screws, bolts, pins, rods, and/or the like. In some embodiments, trim/casing 131 (e.g., top 263) does not extend into nor over portions of heat-sink 121. In some embodiments, top 263 may be constructed of a material that conducts heat well from top 263 and into heat-sink 121. In some embodiments, thermal-paste (or the like) may be located on a bottom of heat-sink 121 and/or on top 263 to facilitate/promote heat transfer from top 263 and into heat-sink 121.

Discussing FIG. 2E, in some embodiments, LED-chip/board 241 may be a light source. In some embodiments, LED-chip/board 241 may be electrically powered. In some embodiments, when LED-chip/board 241 may be sufficiently electrically powered, LED-chip/board 241 may emit light. In some embodiments, when LED-chip/board 241 may be sufficiently electrically powered, LED-chip/board 241 may emit light down over reflector 251, through lens 161, down over conical-interior 135, and out of a bottom (flange 139) of light fixture 100. In some embodiments, LED-chip/board 241 may comprise one or more LEDs (light emitting diodes) and/or other types of light sources. In some embodiments, LED-chip/board 241 may comprise one or more LEDs (light emitting diodes) of different colors. In some embodiments, LED-chip/board 241 may comprise one or more printed circuit boards. In some embodiments, LED-chip/board 241 may comprise one or more circuits. In some embodiments, LED-chip/board 241 may be dimmable. In some embodiments, LED-chip/board 241 may be electrically coupled to driver-PCB 221, lumen-switch 211, color-temperature-switch 213, switch chassis 215, wiring/cabling, power connector(s), portions thereof, combinations thereof, and/or the like.

Continuing discussing FIG. 2E, in some embodiments, LED-chip/board 241 may output lumens at a predetermined value. In some embodiments, LED-chip/board 241 may output lumens from a predetermined range of lumens. In some embodiments, LED-chip/board 241 may output lumens from 1000 to 2000 lumens. In some embodiments, LED-chip/board 241 may output lumens at 1000 lumens, 1250 lumens, 1500 lumens, 1750 lumens, and/or 2000 lumens. In other embodiments, other predetermined lumens may be output by LED-chip/board 241.

Continuing discussing FIG. 2E, in some embodiments, LED-chip/board 241 may output light color-temperature at a predetermined value (e.g., in Kelvins). In some embodiments, LED-chip/board 241 may output light color-temperature from 2700 Kelvin to 5000 Kelvin. In some embodiments, LED-chip/board 241 may output light color-temperatures at 2700 Kelvin, 3000 Kelvin, 3500 Kelvin, 4000 Kelvin, and/or 5000 Kelvin. In other embodiments, other predetermined light color-temperatures may be output by LED-chip/board 241.

Continuing discussing FIG. 2E, in some embodiments, reflector 251 may be a highly reflective conical frustum member. Highly reflective in this context may mean a mirror or mirror like finish. In some embodiments, at least an interior surface of reflector 251 that faces a bottom of light fixture 100 may have a substantially mirror like reflective finish. In some embodiments, reflector 251 may be configured to reflect at least some light emitted by LED-chip/board 241. In some embodiments, reflector 251 may be configured to reflect at least some light emitted by LED-chip/board 241 downwards and out of a bottom of light fixture 100.

Continuing discussing FIG. 2A through FIG. 2E, in some embodiments, spring-clip(s) 155 of light fixture 100 may be attached to upper-portion 261, above cylindrical-region 137. In some embodiments, at least two (2) spring-clips 155 of light fixture 100 may be attached to upper-portion 261, above cylindrical-region 137. In some embodiments, two (2) spring-clips 155 of light fixture 100 may be attached to upper-portion 261, above cylindrical-region 137, at opposite sides of upper-portion 261 from each other. In some embodiments, base 157 (of spring-clip 155) may be attached to upper-portion 261 via fastening-means 156. In some embodiments, when spring-clip 155 is attached to upper-portion 261, spring 158 (of spring-clip 155) is over, next to, and/or adjacent to the lower conical-exterior 133 and not over upper-portion 261. See also, FIG. 1A to FIG. 1H.

Figure 3A:
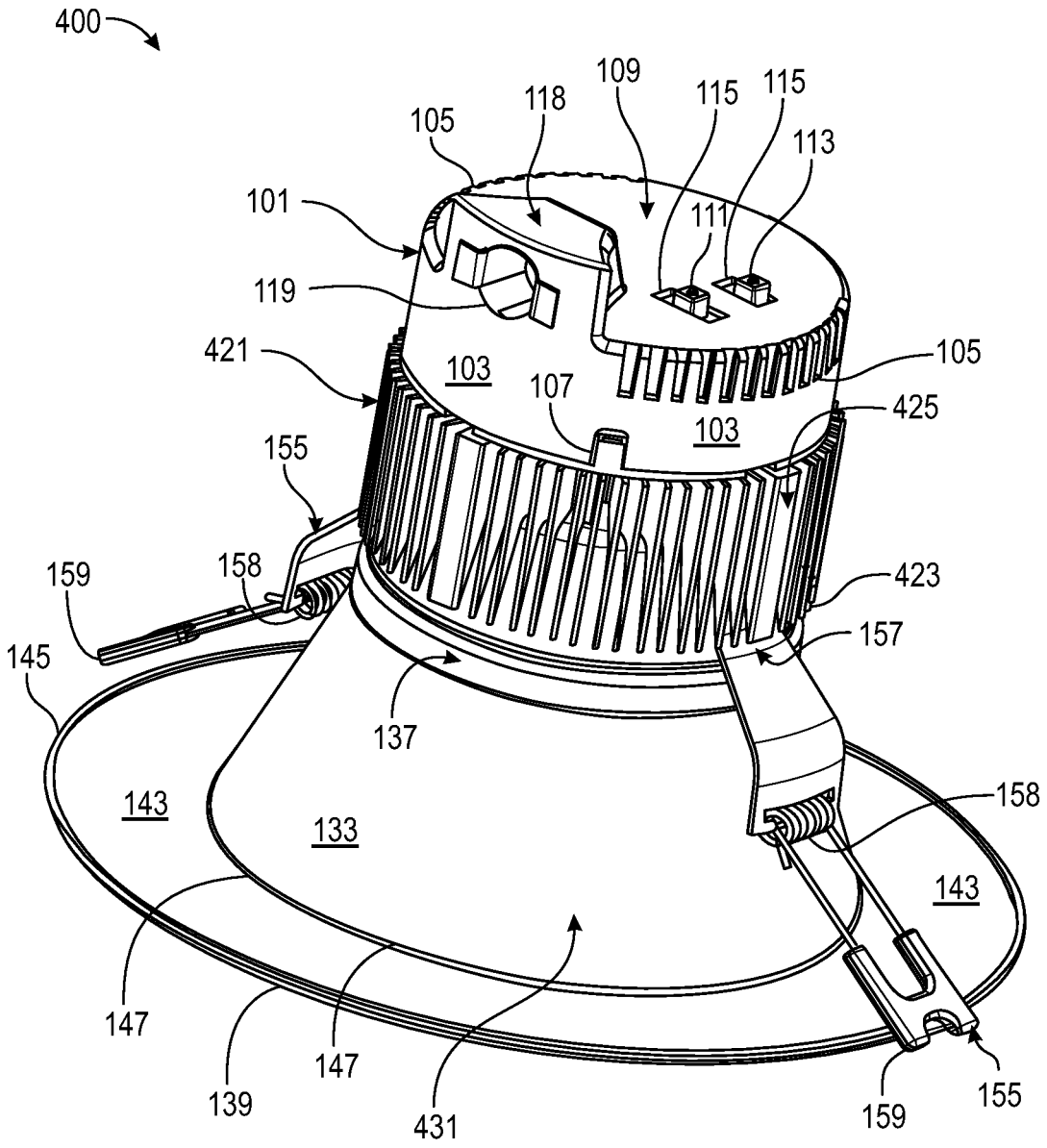
FIG. 3A depicts a top perspective view of a light fixture (in an assembled configuration).
Figure 3B:
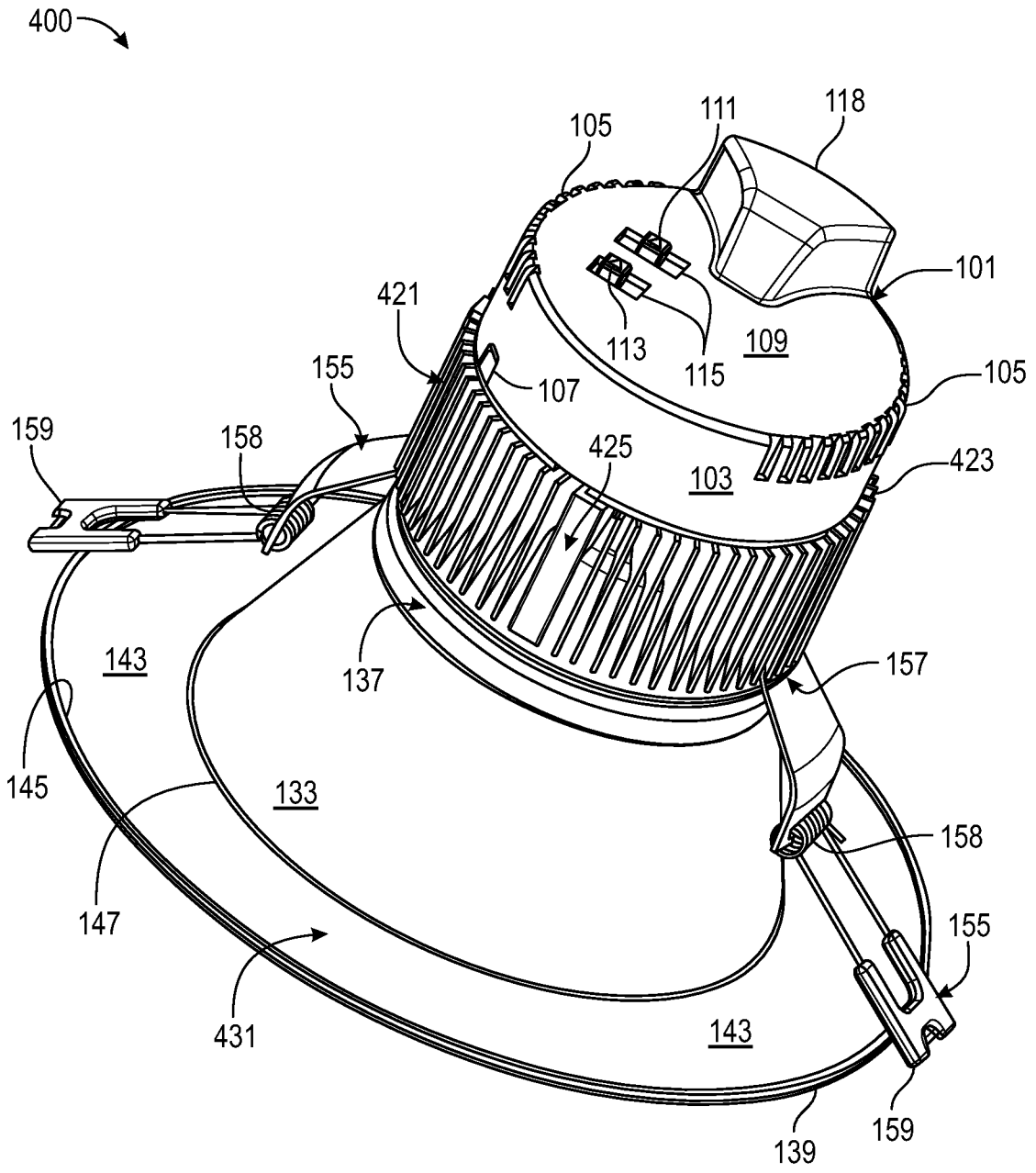
FIG. 3B depicts a top perspective view of the light fixture of FIG. 3A (in an assembled configuration).

FIG. 3A depicts a top perspective view of a light fixture 400 (in an assembled configuration). FIG. 3B depicts another top perspective view of light fixture 400 (in an assembled configuration). The top perspective views of FIG. 3A and of FIG. 3B are different perspective views from each other. See also FIG. 3I which is a top view of light fixture 400. In some embodiments, light fixture 400 may comprise: a driver-box 101, a heat-sink 421, a trim-casing 431, at least one spring-clip 155, a lens 161, a driver-cap 231, a lumen-switch 211, and a color-temperature-switch 213. In some embodiments, light fixture 400 may comprise: driver-box 101, heat-sink 421, trim-casing 431, at least one spring-clip 155, lens 161, a reflector 251, a LED chip/board 241 (light-emitting-diode-circuit), driver-cap 231, a driver-PCB 221 (driver-printed-circuit-board), lumen-switch 211, and color-temperature-switch 213. See FIG. 3C, FIG. 3D, FIG. 4A through FIG. 4D (bottom views of light fixture 400) for lens 161. See FIG. 4A through FIG. 4E for lumen-switch 211, color-temperature-switch 213, driver-PCB 221, driver-cap 231, LED chip/board 241, and/or for reflector 251.

Continuing discussing FIG. 3A and FIG. 3B, in some embodiments, when light fixture 400 may be in its assembled configuration the following components/parts may be at least partially visible from an exterior of light fixture 400: driver-box 101, heat-sink 421, trim-casing 431, spring-clip(s) 155, and/or lens 161. With respect to orientation of light fixture 400, a top of light fixture 400 is at top 109 and a bottom of light fixture 400 is at flange 139. In some embodiments, driver-box 101 may be located in a top portion or an upper portion of light fixture 400. In some embodiments, trim/casing 431 may be located from a middle region to a bottom portion or lower portion of light fixture 400. In some embodiments, heat-sink 421 may be disposed between driver-box 101 and trim/casing 431. In some embodiments, lens 161 may be mounted inside of trim/casing 431 and at least partially visible from a bottom of light fixture 400 (see e.g., FIG. 3C, FIG. 3D, and/or FIG. 3J for bottom views of light fixture 400).

Continuing discussing FIG. 3A and FIG. 3B, in some embodiments, driver-box 101 of light fixture 400 may be at least substantially (mostly) similar to identical as driver-box 101 of light fixture 100. The above discussion of driver-box 101 of light fixture 100 may be applicable to driver-box 101 of light fixture 400; with an exception that a bottom of driver-box 101 of light fixture 400 is in physical communication (e.g., attached to) heat-sink 421, instead of heat-sink 121.

Continuing discussing FIG. 3A and FIG. 3B, in some embodiments, heat-sink 421 may be a mostly cylindrical member comprising of a plurality of fins 423/425 that run around the outside side periphery of heat-sink 421. In some embodiments, the plurality of fins 423/425 may be oriented in a radial fashion with respect to a common longitudinal center 201 of light fixture 400. In some embodiments, each fin 423 may be a substantially (mostly) planar member. In some embodiments, each fin 423 may be run up and down (parallel to common longitudinal center 201). In some embodiments, heat-sink 421 may have two different types of fins, fin-thin 423 and fin-thick 425. In some embodiments, fin-thin 423 may be thinner than fin-thick 425. In some embodiments, fin-thick 425 may be thicker than fin-thin 423. In some embodiments, there may be four (4) fins-thick 425. In some embodiments, fins-thin 423 may be more numerous than fins-thick 425.

In some embodiments, heat-sink 421 may be similarly shaped and/or sized to that of heat-sink 121, except that fins 423/425 of heat-sink 421 may be longer/taller than fins 123/125 of heat-sink 121; and/or an external diameter of heat-sink 421 may be different from an external diameter of heat-sink 121. Additionally, in some embodiments, a bottom of heat-sink 421 may be configured to receive most of upper-portion 433 of trim/casing 431. Note, upper-portion 433 is first shown in FIG. 4A.

Continuing discussing FIG. 3A and FIG. 3B, in some embodiments, trim/casing 431 may be a mostly hollow conical member (i.e., mostly a hollow conical frustum member) that terminates into a flange 139 where trim/casing 431 is at its widest diameter at the bottom of light fixture 400. In some embodiments, trim/casing 431 may be configured to internally receive and/house lens 161, optionally in some embodiments, LED chip/board 241. In some embodiments, trim/casing 431 may be similar in shape to trim/casing 131. In some embodiments, trim/casing 431 may be larger than trim/casing 131. In some embodiments, trim/casing 431 may be divided into its mostly conical member and its flange 139, with the mostly conical member occupying the top/upper regions of trim/casing 431 and flange 139 occupying the very bottom of trim/casing 431. In some embodiments, side-walls of the conical member of trim/casing 431 may be a conical-exterior 133, a conical-interior 135, and cylindrical-region 137. In some embodiments, conical-exterior 133 and conical-interior 135 may be opposite sides/surfaces of the mostly conical member of trim/casing 431. In some embodiments, at least some of conical-interior 135 may be visible from bottom views of light fixture 400. In some embodiments, at least some light emitted from light fixture 400 may shine upon portions of conical-interior 135 and then out the bottom of light fixture 400 (out the bottom of flange 139).

Continuing discussing FIG. 3A and FIG. 3B, in some embodiments, the mostly conical member 133 of trim/casing 431 may be interrupted by cylindrical-region 137, which may be region of that is more cylindrical than conical. In some embodiments, above and below cylindrical-region 137 may regions of trim/casing 431 that are mostly conical in shape, i.e., two (2) conical members 133, one upper and one lower. Note, the upper conical member 133 (upper-portion 433) of trim/casing 431 is not readily visible in assembled views of light fixture 400 because heat-sink 421 may cover over most of the upper conical member 133 (upper-portion 433). See e.g., exploded view FIG. 4A for the upper conical member 133 (upper-portion 433) of trim/casing 431.

Continuing discussing FIG. 3A and FIG. 3B, in some embodiments, flange 139 may be located at a base of the mostly conical member 133 of trim/casing 431, at the bottom of light fixture 400. In some embodiments, flange 139 may be a mostly planar, flat, disk/disc like, annular member. In some embodiments, flange 139 may comprise flange-top 143. In some embodiments, flange-top 143 may be visible from top views of light fixture 400. In some embodiments, flange-top 143 may be a top external surface of flange 139. In some embodiments, flange-top 143 may be a mostly planar, flat, disk/disc like, annular member. In some embodiments, when light fixture may be installed in a ceiling or wall, flange-top 143 may not be visible from below. In some embodiments, an outermost edge of flange 139 may extend upwards into flange-lip 145. In some embodiments, flange-lip 145 may be an upward projection/extension of material at the outermost edge of flange 139. In some embodiments, where the bottom conical member of trim/casing 131 transitions into flange 139 may be flange-conical-transition 147. In some embodiments, flange-conical-transition 147 may be an annular ring running around an outside bottom of the conical member portion of trim/casing 131. In some embodiments, flange-conical-transition 147 may be located an inner most portion/region of flange 139, disposed away from flange-lip 145. See e.g., FIG. 3A, FIG. 3B, and/or FIG. 3I.

Continuing discussing FIG. 3A and FIG. 3B, in some embodiments, attached to conical-exterior 133 (of light fixture 400) may be one or more spring-clip(s) 155. In some embodiments, attached to an exterior of upper-portion 433, which may be conical in shape, and above cylindrical-region 137, may be one or more spring-clip(s) 155. In some embodiments, attached to the exterior of upper-portion 433, which may be conical in shape, and above cylindrical-region 137, opposite from each other, may be two (2) spring-clips 155. In some embodiments, attached to conical-exterior 133 (of light fixture 400) may be two oppositely disposed spring-clips 155. In some embodiments, attached to an exterior of trim/casing 431 may be one or more spring-clip(s) 155. In some embodiments, attached to an exterior of trim/casing 431 may be two oppositely disposed spring-clips 155. In some embodiments, attachment of a spring-clip 155 to an exterior of trim/casing 431 may be by fastening-means 156. In some embodiments, fastening-means 156 may be one or more of: mechanical fasteners, screws, bolts, rivets, pins, dowels, welds, adhesives, portions thereof, combinations thereof, and/or the like. In some embodiments, a spring-clip 155 may comprise a base 157, a spring 158, and a region-of-external-contact 159. In some embodiments, base 157 may be attached an external portion of conical-exterior 133 (and/or of trim/casing 431) by fastening-means 156. In some embodiments, at least some portion of spring 158 may be helical/coil spring. In some embodiments, a length of the helical/coil spring portion of spring 158 may be at least substantially (mostly) orthogonal to common longitudinal center 201. In some embodiments, spring 158 may be attached to base 157, disposed away from fastening-means 156. In some embodiments, region-of-external-contact 159 may also be attached to spring 158. In some embodiments, spring 158 may be disposed between base 157 and region-of-external-contact 159. In some embodiments, region-of-external-contact 159 may be terminal end distal portion of spring-clip 155 that is disposed away from base 157. In some embodiments, the terminal end distal portion of region-of-external-contact 159 may be covered/coated with an elastomer, rubber, plastic, silicone, and/or the like. In some embodiments, region-of-external-contact 159 may be configured to come into (removable) physical contact with interior surfaces of can/housing 601, a hole in drywall, and/or the like. In some embodiments, region-of-external-contact 159 may be configured to (removably) frictionally grip interior surfaces of can/housing 601, a hole in drywall, and/or the like. In some embodiments, spring(s) 158 of spring-clip(s) 155 may be over the lower conical-exterior 133 and not over upper-portion 433.

Note, light fixture 400 of U.S. patent application Ser. No. 17/246,272 by the same inventor as the present invention utilized torsion-spring(s) 451; whereas, light fixture 400 of embodiments of the present invention may utilize spring-clip(s) 155. In some embodiments, light fixture 400 of embodiments of the present invention may not utilize torsion-spring(s) 451. In some embodiments, spring-clip 155 may be devoid of wing 453 structures of torsion-spring 451. Wings 453 of torsion-spring 451 formed a V-like structure that is completely absent in spring-clip(s) 155. Note, torsion-spring 451 and wing 453 are not shown in the figures of this present patent application; however, torsion-spring 451 and wing 453 are shown and described in prior U.S. patent application, patent application Ser. No. 17/246,272, by the same inventor as the present patent application.

Figure 3C:
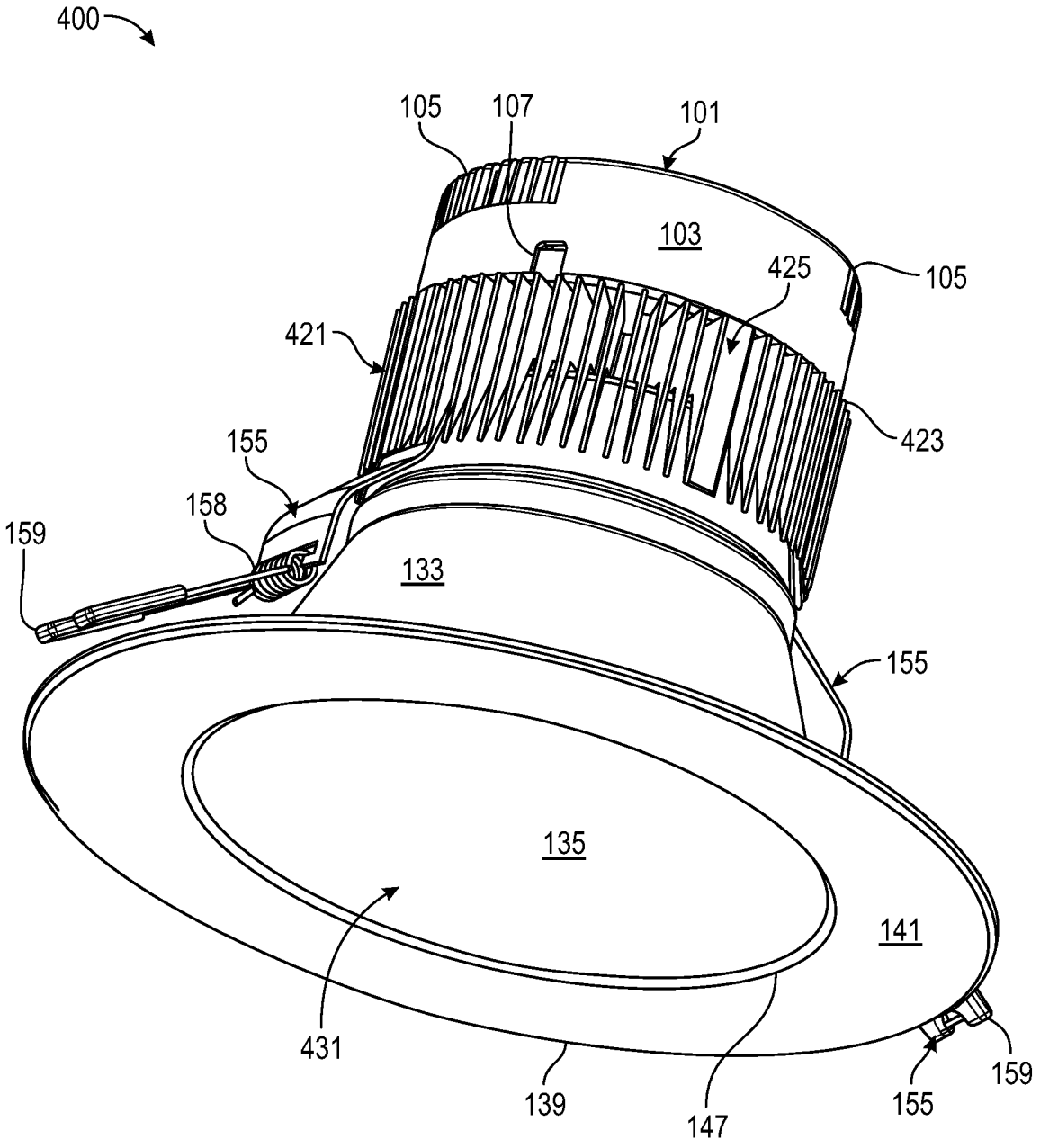
FIG. 3C depicts a bottom perspective view of the light fixture of FIG. 3A (in an assembled configuration).
Figure 3D:
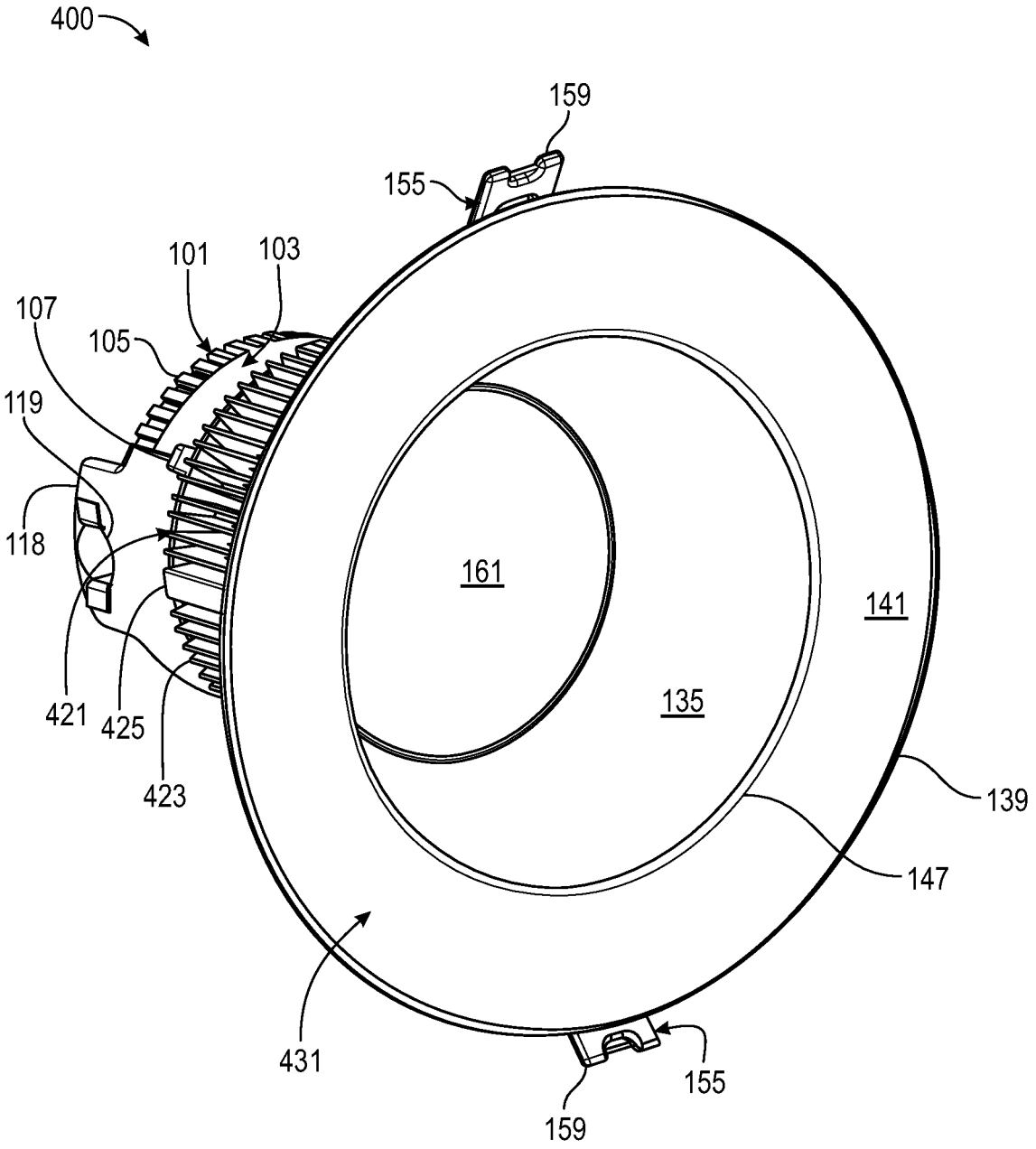
FIG. 3D depicts a bottom perspective view of the light fixture of FIG. 3A (in an assembled configuration).

FIG. 3C depicts a bottom perspective view of light fixture 400 (in an assembled configuration). FIG. 3D depicts a bottom perspective view of light fixture 400 (in an assembled configuration). The bottom perspective views of FIG. 3C and of FIG. 3D are different perspective views from each other. See also FIG. 3J which is a bottom view of light fixture 400. In some embodiments, flange 139 of trim/casing 431 may comprise flange-bottom 141. In some embodiments, flange-bottom 141 may be a bottom external surface of flange 139. In some embodiments, flange-bottom 141 and flange-top 143 may be oppositely disposed external surfaces of flange 139. In some embodiments, flange-bottom 141 may be a mostly planar, flat, disk/disc like, annular member. In some embodiments, when light fixture 400 may be installed in a ceiling or wall, flange-bottom 141 may be visible overlapping drywall (or the like). In some embodiments, when light fixture 400 may be installed in a ceiling or wall, flange 139 may trim out (cover) a hole cut into the drywall (or the like), wherein this hole in the drywall (or the like) may be for receiving can/housing 601 and/or light fixture 400. In some embodiments, flange-bottom 141 may be visible from bottom views of light fixture 400. See e.g., FIG. 3C, FIG. 3D, and/or FIG. 3J for bottom views of light fixture 400.

Note, can/housing 601 is not shown in the figures of this present patent application; however, can/housing 601 is shown and described in prior U.S. patent application, patent application Ser. No. 17/246,272, by the same inventor as the present patent application. Prior U.S. patent application, patent application Ser. No. 17/246,272 is incorporated by reference as if fully set-forth herein.

Continuing discussing FIG. 3D, in some embodiments, lens 161 may be configured to permit passage of light. In some embodiments, lens 161 may be substantially optically clear, transparent, translucent, portions thereof, combinations thereof, and/or the like. In some embodiments, lens 161 may be substantially optically clear, transparent, translucent, portions thereof, combinations thereof, and/or the like, with respect to a predetermined range of wavelengths of light, of lumens, of light color-temperatures, portions thereof, combinations thereof, and/or the like. In some embodiments, lens 161 may be curved for a purpose of focusing light passing through and out of lens 161. In some embodiments, lens 161 may be mounted inside of trim/casing 431.

Figure 3E:
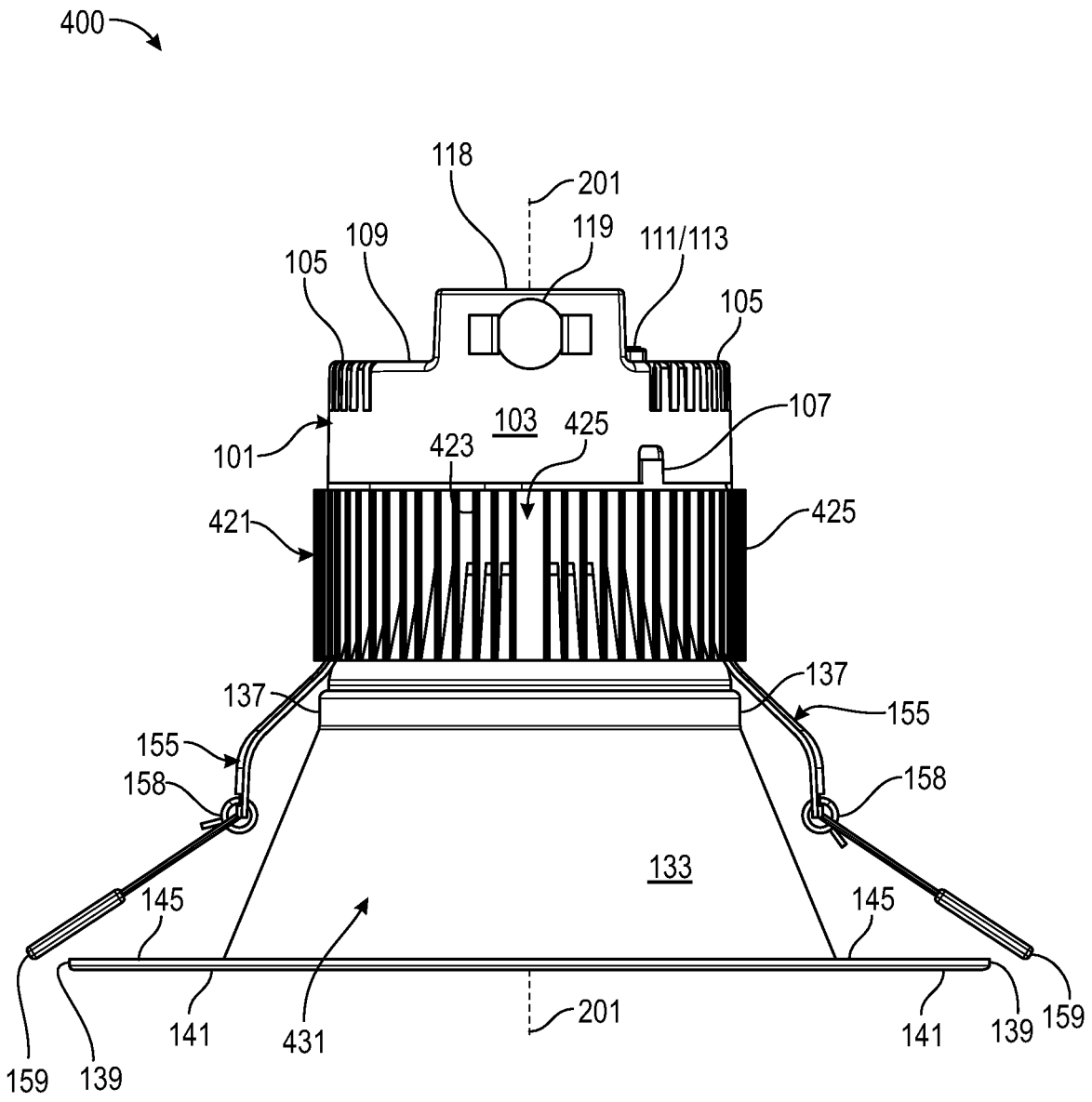
FIG. 3E depicts a front view of the light fixture of FIG. 3A (in an assembled configuration).
Figure 3F:
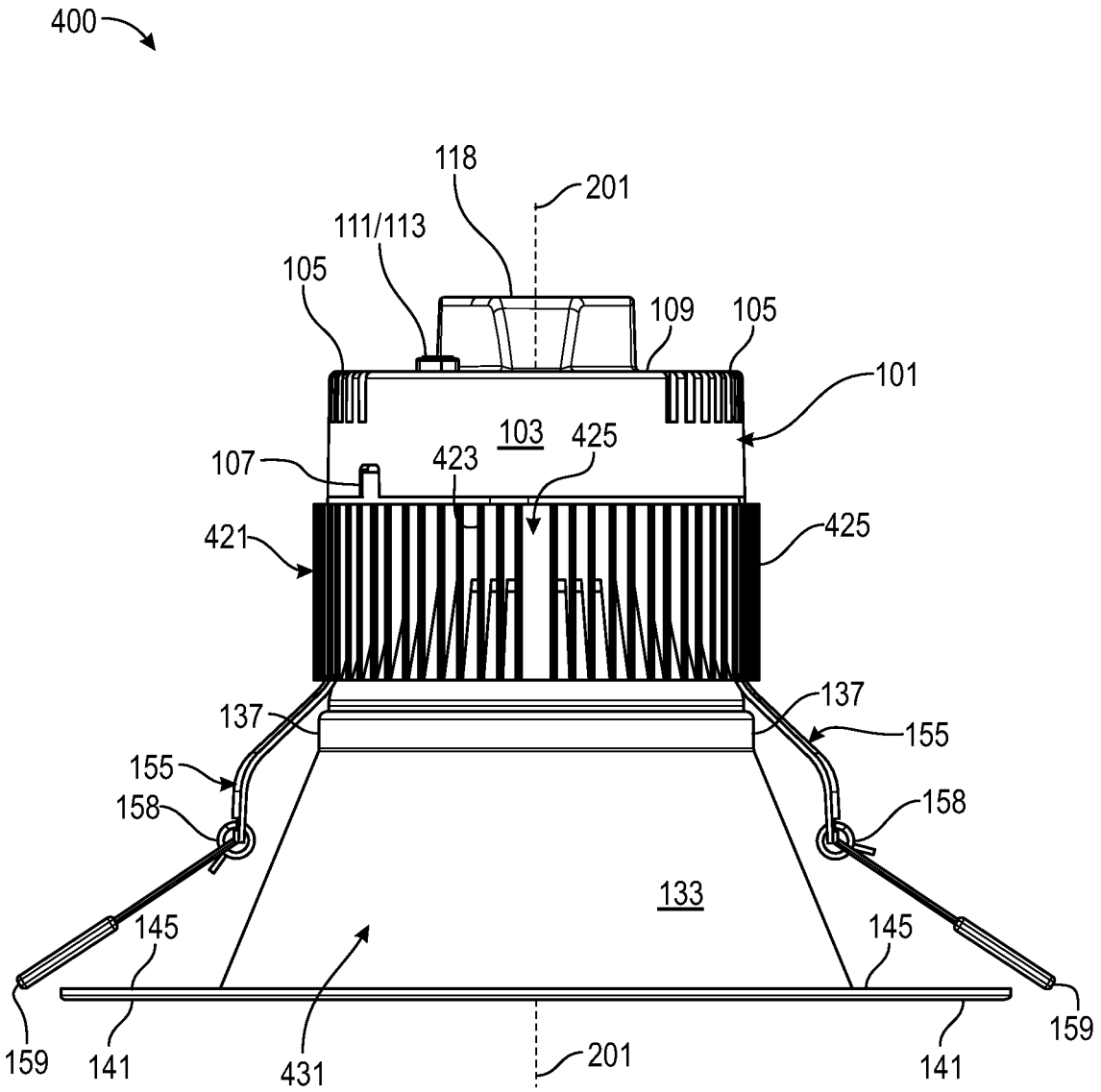
FIG. 3F depicts a back (rear) view of the light fixture of FIG. 3A (in an assembled configuration).
Figure 3G:
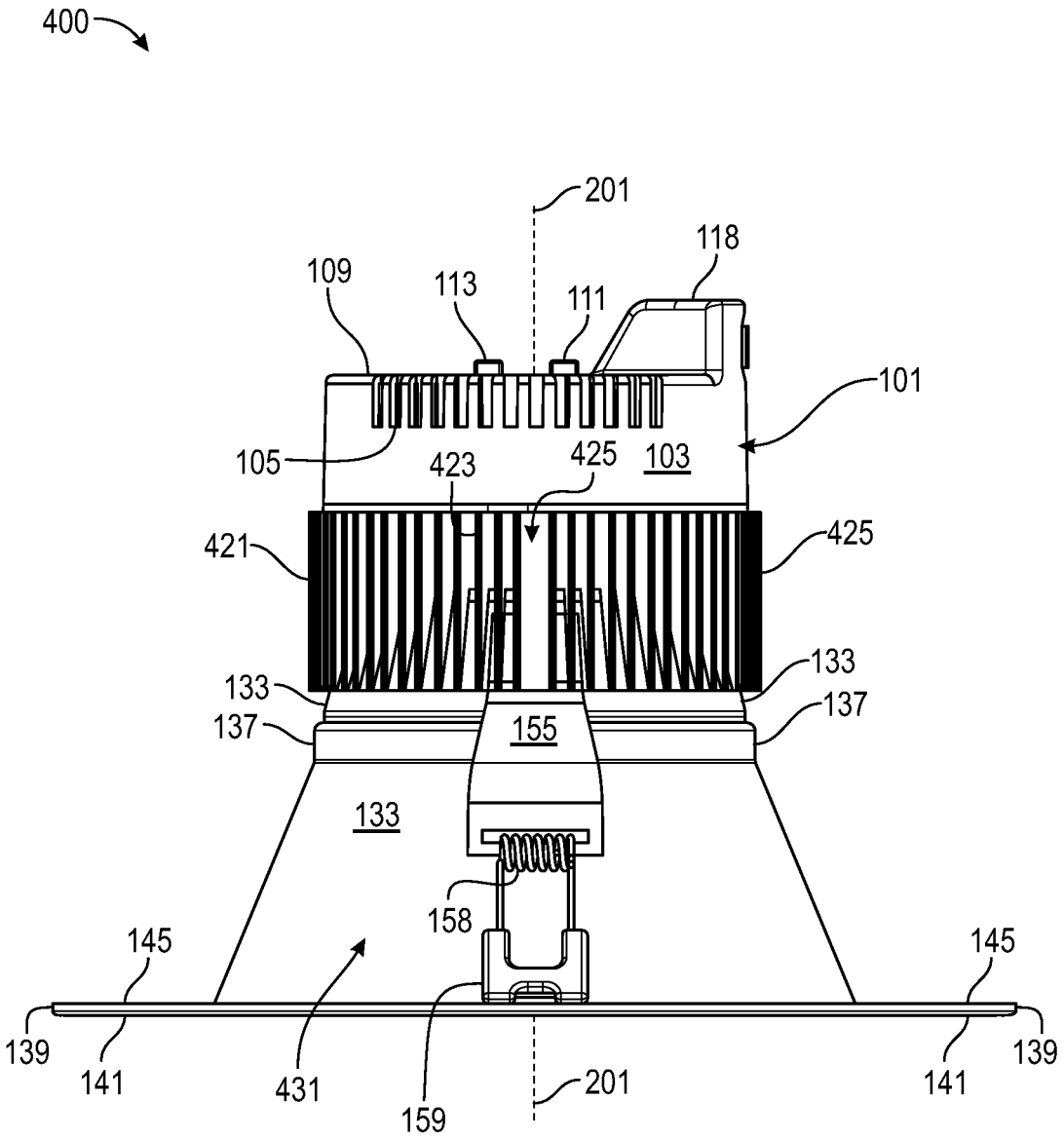
FIG. 3G depicts a left-side view of the light fixture of FIG. 3A (in an assembled configuration).
Figure 3H:
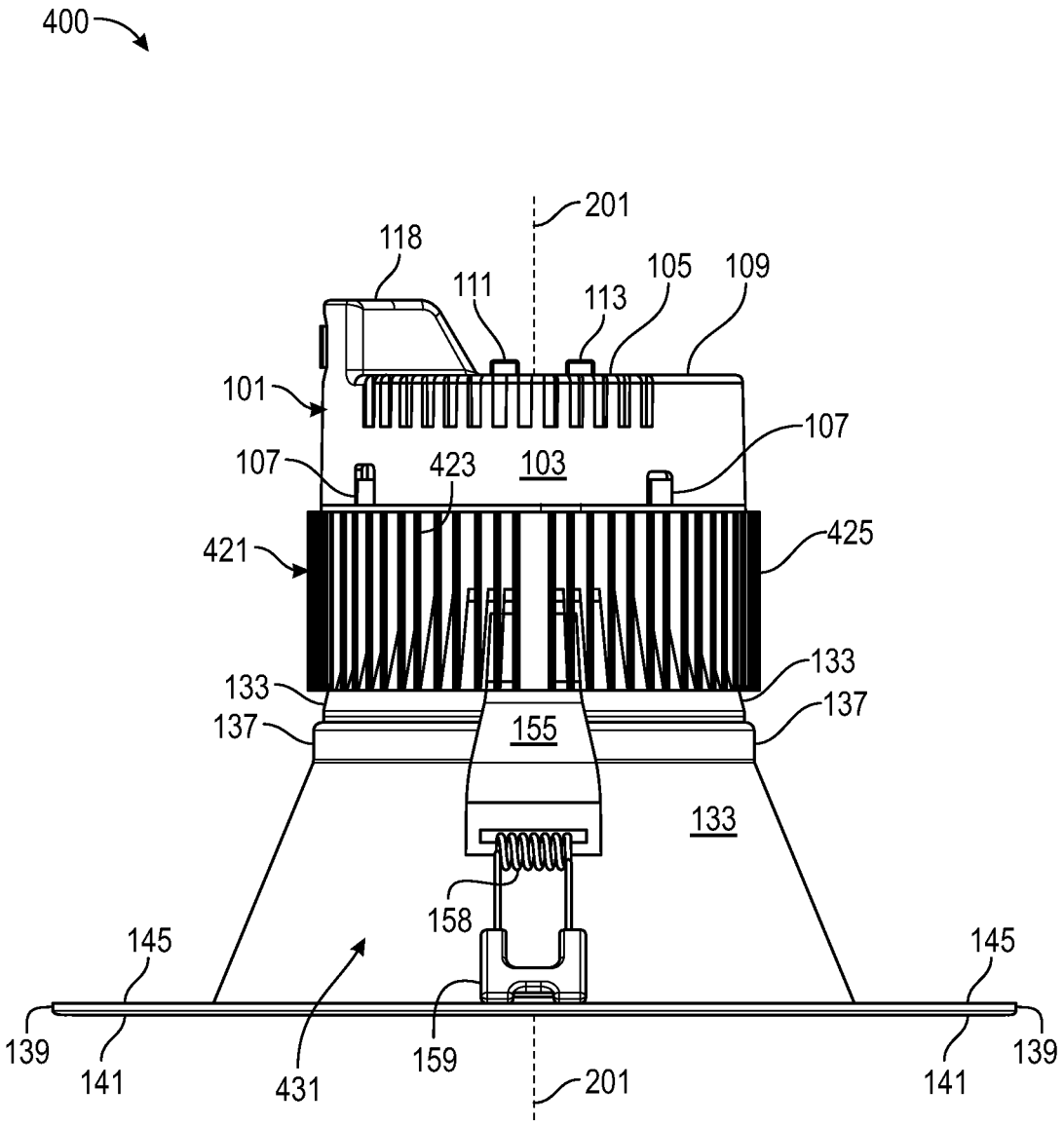
FIG. 3H depicts a right-side view of the light fixture of FIG. 3A (in an assembled configuration).

FIG. 3E depicts a front view of light fixture 400 (in an assembled configuration). FIG. 3F depicts a back (rear) view of light fixture 400 (in an assembled configuration). FIG. 3G depicts a left-side view of light fixture 400 (in an assembled configuration). FIG. 3H depicts a right-side view of light fixture 400 (in an assembled configuration). In some embodiments, because of the mostly radial symmetry of light fixture 400 about common longitudinal center 201, the front view, the back (rear) view, the left-side view, and the right-side view may all be side views of light fixture 400. In some embodiments, integral-bulge 118 may be located closer to the front of driver-box 101 than to the back (rear) of driver-box 101, see e.g., FIGS. 3E to 3H. In some embodiments, due to asymmetry of a shape of integral-bulge 118 and an asymmetry of placement (location) of integral-bulge 118 on top 109 of driver-box 101 of light fixture 400, aperture-for-wiring 119 may be visible in FIG. 3E, but may not be visible in FIG. 3F to FIG. 3H. In some embodiments, the two spring-clips 155 may be located to either side of integral-bulge 118, see e.g., FIG. 3E and FIG. 3F. In some embodiments, a spring-clip 155 and a fin-thick 425 may be in vertical alignment, with respect to the overall length of spring-clip 155 and with respect to a height of fin-thick 425, with both this spring-clip 155 and the above located fin-thick 425 sharing a common vertical (imaginary) line, see e.g., FIG. 3G and FIG. 3H. In some embodiments, lumen-switch-cover 111 and color-temperature-switch-cover 113 may be located closer to the right-side of driver-box 101 than to the left-side of driver-box 101, see e.g., FIG. 3E to FIG. 3H. In other embodiments, the opposite configuration/arrangement may be employed.

In some embodiments, a total (overall) height of light fixture 400 may be five (5) inches (not including wiring/cabling). In other embodiments, the total (overall) height of light fixture 400 may be a different dimension, but fixed and predetermined.

In some embodiments, at least portions of lumen-switch-cover 111 and/or color-temperature-switch-cover 113 may extend/protrude orthogonally away from top 109 and above top 109. See e.g., FIG. 3E through FIG. 3H.

In some embodiments, side-wall 103 may comprise at least one notch 107. In some embodiments, side-wall 103 may comprise at least two notches 107. In some embodiments, notch 107 may be a notch, a cutout, a hole, an aperture, portions thereof, combinations thereof, and/or the like, in side-wall 103. In some embodiments, notch 107 may be configured and sized for the passage of at least some portions of wiring and/or cabling. In some embodiments, notch 107 may be located closer to the bottom of driver-box 101 than to top 109. In some embodiments, notch 107 may be extend from the bottom of driver-box 101 towards top 109, but notch 107 may not touch top 109. In some embodiments, notch 107 may be on a bottom one-third to a bottom one-half of driver-box 101. See e.g., FIG. 3E, FIG. 3F, and FIG. 3H.

In some embodiments, a majority of upper-portion 433 of trim/casing 431 may be received inside of heat-sink 421. In some embodiments, upper-portion 433 may be located above cylindrical-region 137 of trim/casing 431. In some embodiments, this upper-portion 433 may include top 263 of trim/casing 431. In some embodiments, bottom interiors of fins 423/425 may be shaped to accommodate the majority of upper-portion 433; i.e., fins 423/425 are not entirely rectangular prisms in shape. See e.g., FIG. 3E through FIG. 3H and see FIG. 4D.

In some embodiments, a greatest diameter of light fixture 400 may be an outside diameter of flange 139. In some embodiments, an outside diameter of heat-sink 421 may be larger than an outside diameter of driver-box 101. In some embodiments, the outside diameter of heat-sink 421 may be larger than an outside diameter of cylindrical-region 137 of the mostly conical member of trim/casing 431. See e.g., FIG. 3E through FIG. 3H.

In some embodiments, cylindrical-region 137 of trim/casing 431 may be located about two (2) inches from flange 139/flange-bottom 141. See e.g., FIG. 3E through FIG. 3H.

In some embodiments, the fins 423/425 of heat-sink 421 may run from a bottom of heat-sink 421 to a top of heat-sink 421. See e.g., FIG. FIG. 3E through FIG. 3H.

Figure 3I:
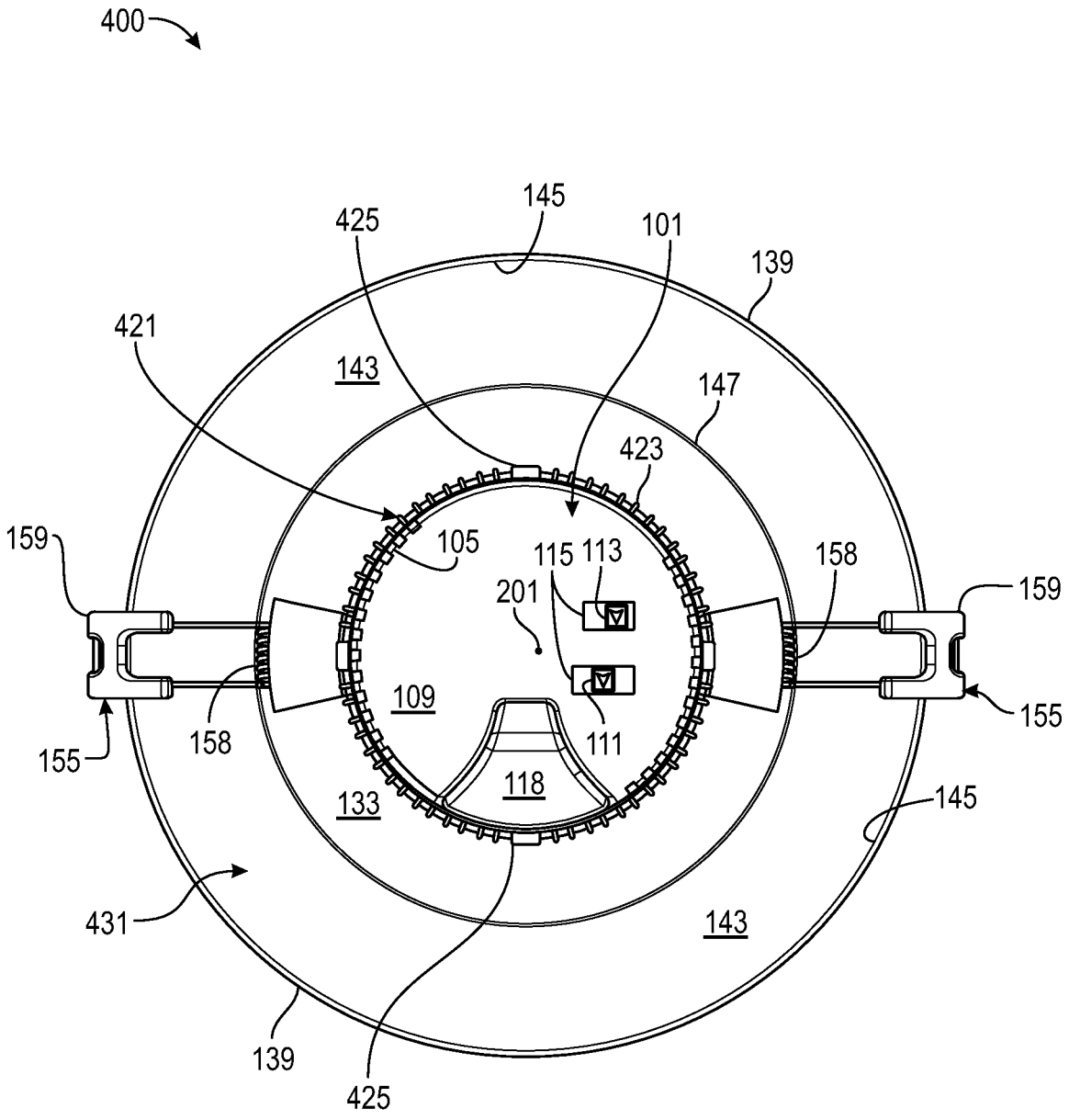
FIG. 3I depicts a top view of the light fixture of FIG. 3A (in an assembled configuration).

FIG. 3I depicts a top view of light fixture 400 (in an assembled configuration). In some embodiments, fins 105 of driver-box 101 of light fixture 400 may be grouped into two opposing groups of fins 105, separated by two opposing regions of no fins 105. In some embodiments, top 109 may comprise one or more of: lumen-switch-cover 111, color-temperature-switch-cover 113, switch-aperture 115, indicia 117, portions thereof, combinations thereof, and/or the like. In some embodiments, driver-box 101 of light fixture 400 may comprise two distinct, different, opposing sets of fins 105 configured for heat dissipation. In some embodiments, the two distinct, different, opposing sets of fins 105 may be equally spaced apart from each other by regions of driver-box 101 without fins 105. In some embodiments, each fin 105, selected from the two distinct, different, opposing sets of fins 105 may runs from a side-wall 103 of driver-box 101 to a top 109 of driver-box 101. However, in some embodiments, a bottom portion of driver-box 101 side-wall 103 may have no fins 105.

Continuing discussing FIG. 3I, in some embodiments, lumen-switch-cover 111 may be configured to be removably interacted with by fingers, thumb(s), and/or hand(s) of a user to select lumen output of light fixture 400. In some embodiments, color-temperature-switch-cover 113 may be configured to be removably interacted with by fingers, thumb(s), and/or hand(s) of a user to select light color-temperature output of light fixture 400. In some embodiments, lumen-switch-cover 111 and/or color-temperature-switch-cover 113 may be a membrane cover. In some embodiments, the membrane cover may be water resistant or water proof.

Continuing discussing FIG. 3I, in some embodiments, top 109 may have one or more holes, for example, switch-aperture(s) 115. In some embodiments, switch-aperture 115 may be a hole in top 109. In some embodiments, switch-aperture 115 may be configured to pass and/or receive at least a portion of: lumen-switch-cover 111, color-temperature-switch-cover 113, lumen-switch 211, color-temperature-switch 213, portions thereof, combinations thereof, and/or the like. In some embodiments, there may be one switch-aperture 115 for lumen switching and one switch-aperture 115 for color-temperature switching. In some embodiments, the two switch-apertures 115 may be grouped together side by side.

In some embodiments, top 109 may comprise various indicia 117. In some embodiments, indicia 117 may be one or more of: a logo, a company name, a trademark, a brand, a trade name, a slogan, a catch phrase, a model number, a serial number, a range of selectable lumens, a range of selectable color-temperatures, a registration number, certification information, testing information, standards information, rating information, specification information, a lot number, inspection information, a patent number, patent pending status, a website, a phone number, a mailing address, portions thereof, combinations thereof, and/or the like. In some embodiments, adjacent and next to each switch-aperture 115 may be indicia of a range of selectable lumens and/or a range of selectable color-temperatures. In some embodiments, indicia 117 may be in the form of one or more of: a sticker, printed onto top 109, written onto top 109, painted onto top 109, drawn onto top 109, stenciled onto top 109, engraved onto top 109, carved into top 109, molded directly into top 109, portions thereof, combinations thereof, and/or the like. In some embodiments, various indicia 117 are shown and described in prior U.S. patent application Ser. No. 17/246,272 by the same inventor as the present invention.

Continuing discussing FIG. 3I, in some embodiments, flange 139 of trim/casing 431 may comprise flange-top 143 and flange-lip 145. In some embodiments, flange-top 143 may be an opposing surface with respect to flange-bottom 141. In some embodiments, flange-bottom 141 and flange-top 143 may be different opposing sides/surfaces of flange 139. In some embodiments, when light fixture 400 may be installed in a ceiling and/or wall, flange-top 143 may not be visible. In some embodiments, flange-top 143 may be a mostly planar, flat, disk/disc like, annular member. In some embodiments, towards an outside edge of flange 139 may be flange-lip 145. In some embodiments, flange-lip 145 may be an annular fixed ridge the extends/protrudes orthogonally away from flange-top 143. In some embodiments, flange-conical-transition 147 may indicate where flange 139 begins and the mostly conical member of trim/casing 431 ends. In some embodiments, flange-conical-transition 147 may be relatively smooth. In some embodiments, flange-conical-transition 147 may be devoid of a raised wall/ridge. In some embodiments, the outside diameter of flange 139 may be seven and one-half (7½) inches. In some embodiments, an inside diameter of flange 139 may be five (5) inches. In other embodiments, one or more of these diameter dimensions may be different, but fixed and predetermined.

Figure 3J:
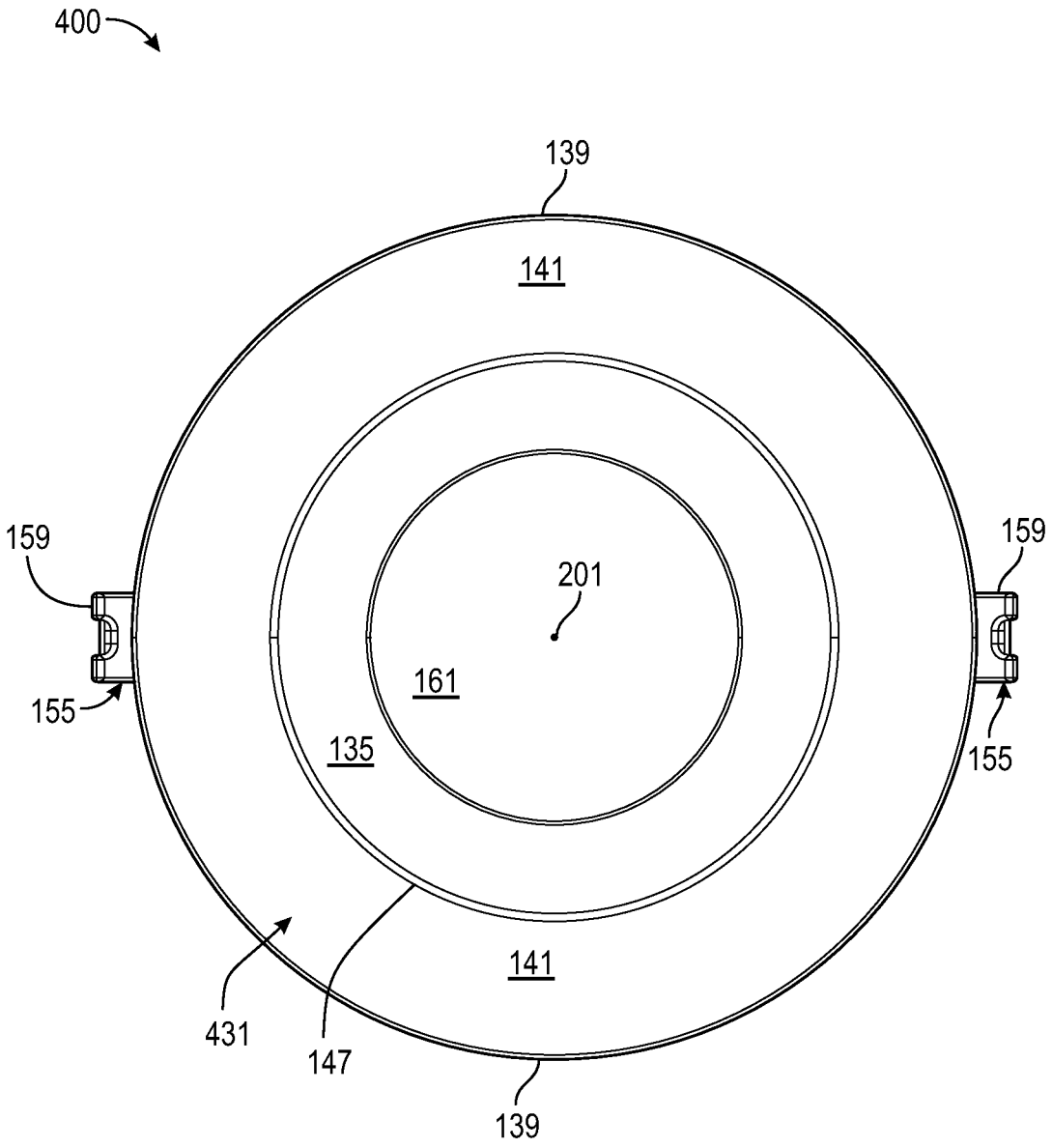
FIG. 3J depicts a bottom view of the light fixture of FIG. 3A (in an assembled configuration).

FIG. 3J depicts a bottom view of light fixture 400 (in an assembled configuration).

From FIG. 3J the following may be visible (from outside of flange 139 towards common longitudinal center 201): bottom portions of oppositely disposed region-of-external-contact 159 (of opposing spring-clips 155); flange-bottom 141; at least some portions of conical-interior 135; at least some bottom portions of reflector 251 (in some embodiments); at least some bottom portions of lens 161; portions thereof; combinations thereof; and/or the like. In some embodiments, reflector 251 may be located above lens 161 (inside of upper-portion 433), so not visible in FIG. 3J.

Figure 4A:
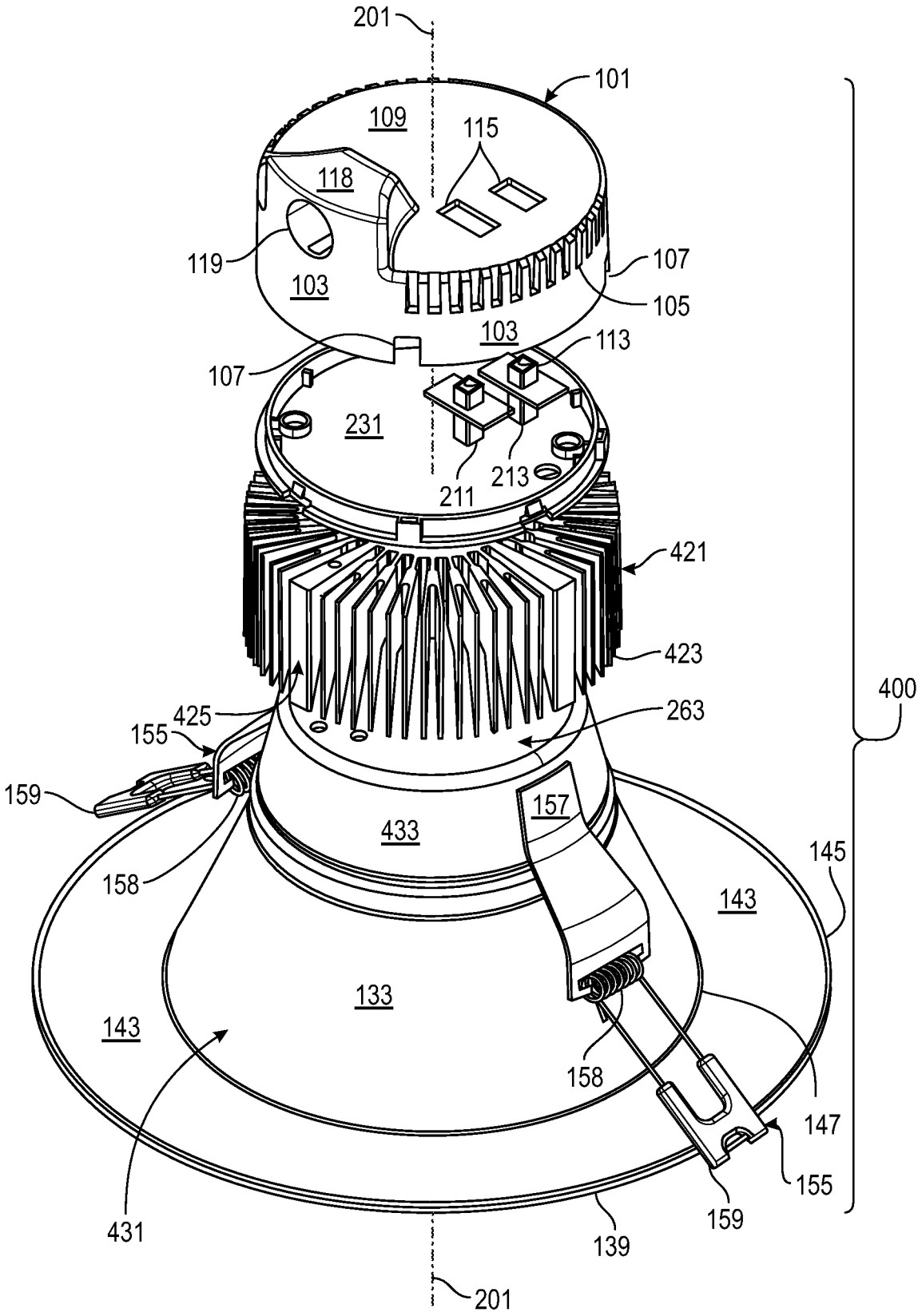
FIG. 4A depicts a top perspective exploded view (at least partially exploded view) of the light fixture of FIG. 3A.
Figure 4B:
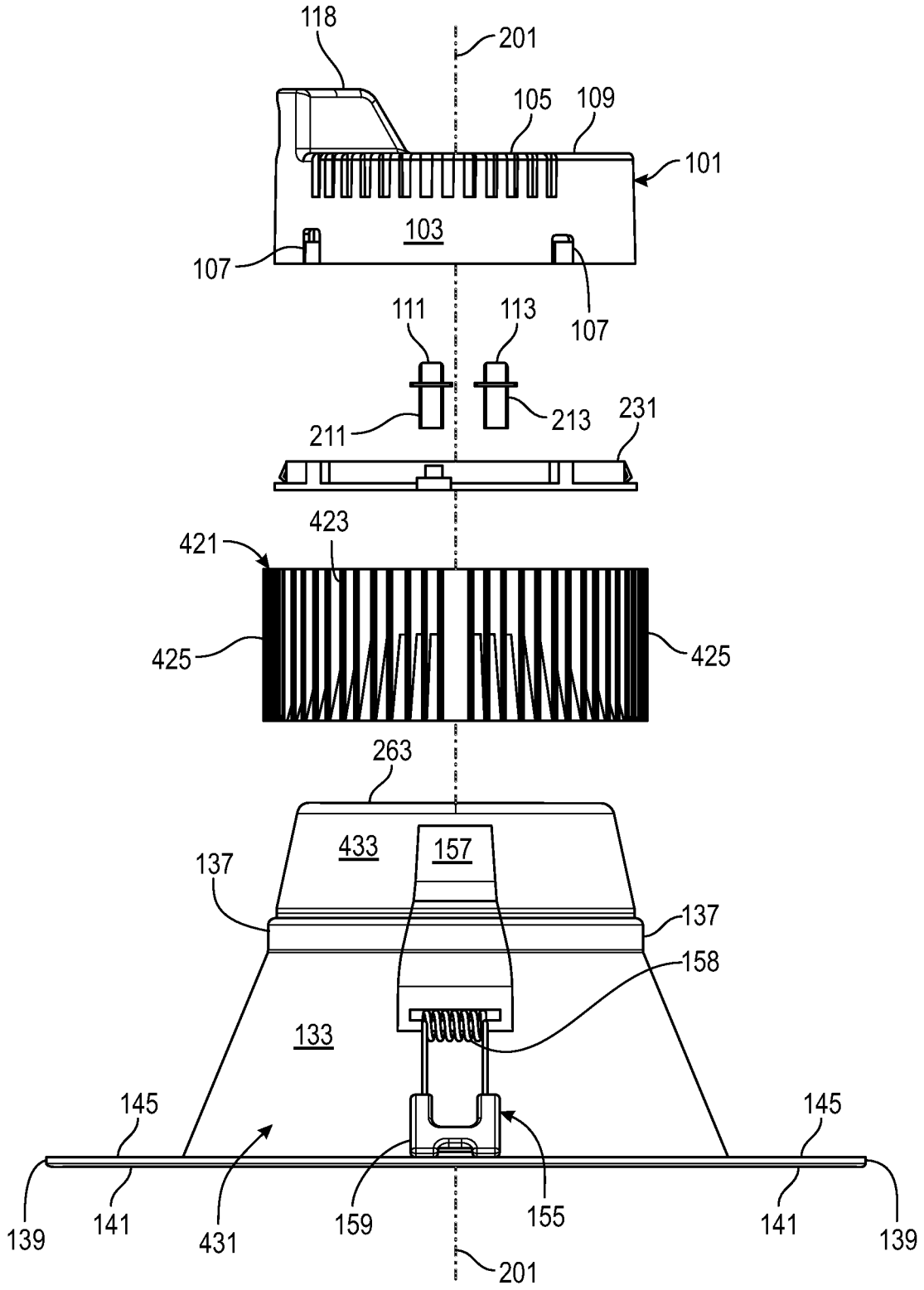
FIG. 4B depicts a right-side exploded view (at least partially exploded view) of the light fixture of FIG. 3A.
Figure 4C:
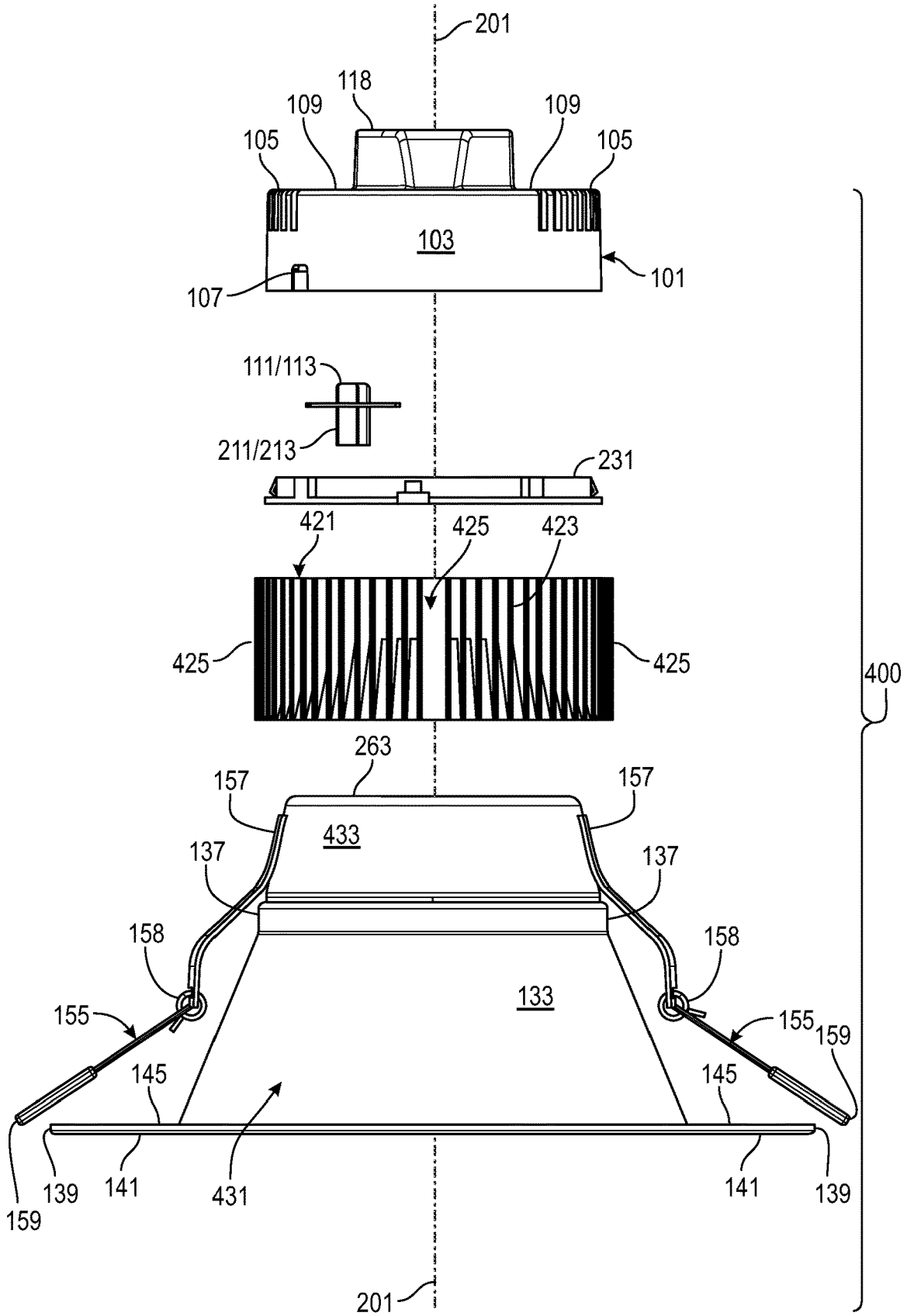
FIG. 4C depicts a back (rear) exploded view (at least partially exploded view) of the light fixture of FIG. 3A.
Figure 4D:
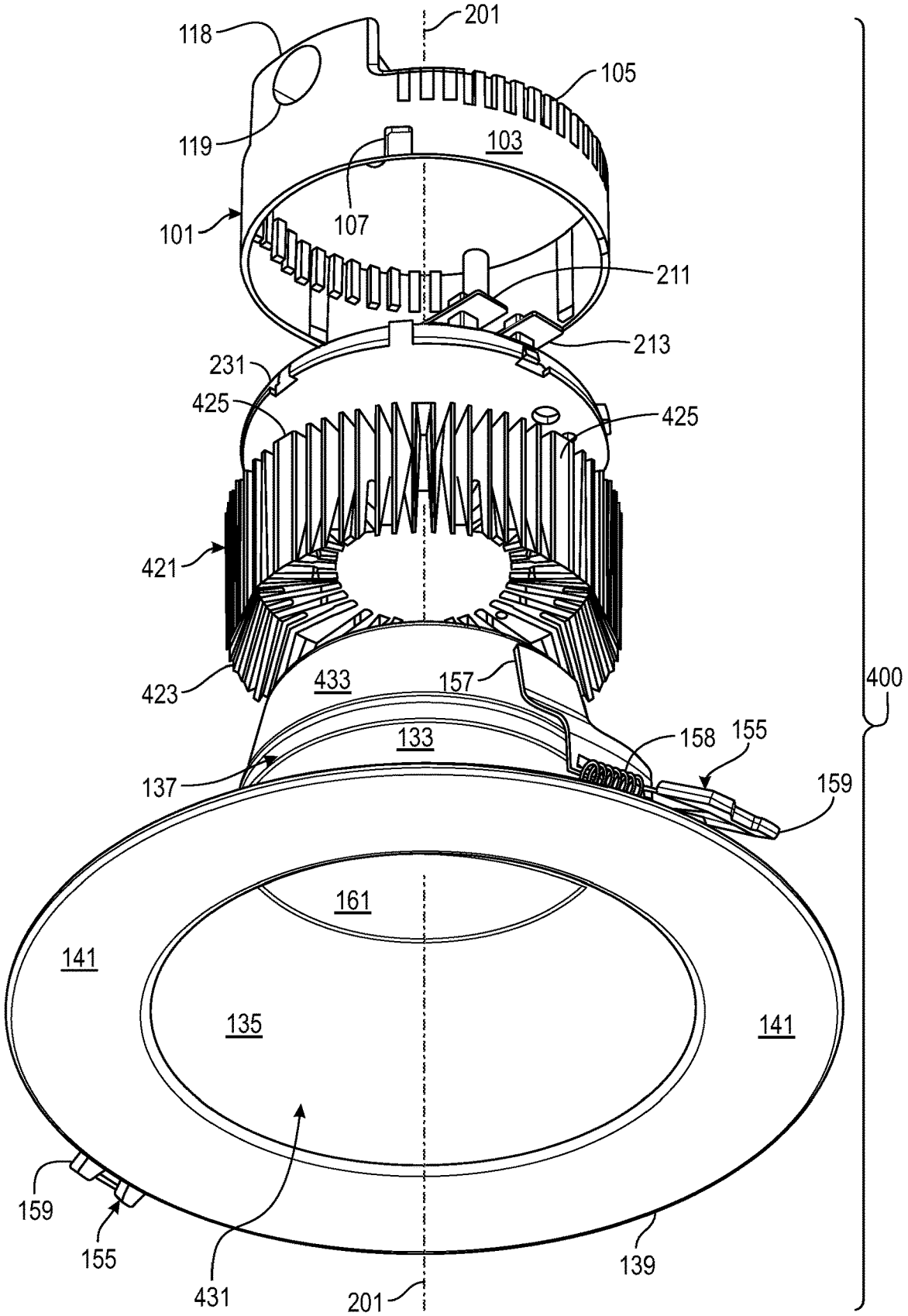
FIG. 4D depicts a bottom perspective exploded view (at least partially exploded view) of the light fixture of FIG. 3A.
Figure 4E:
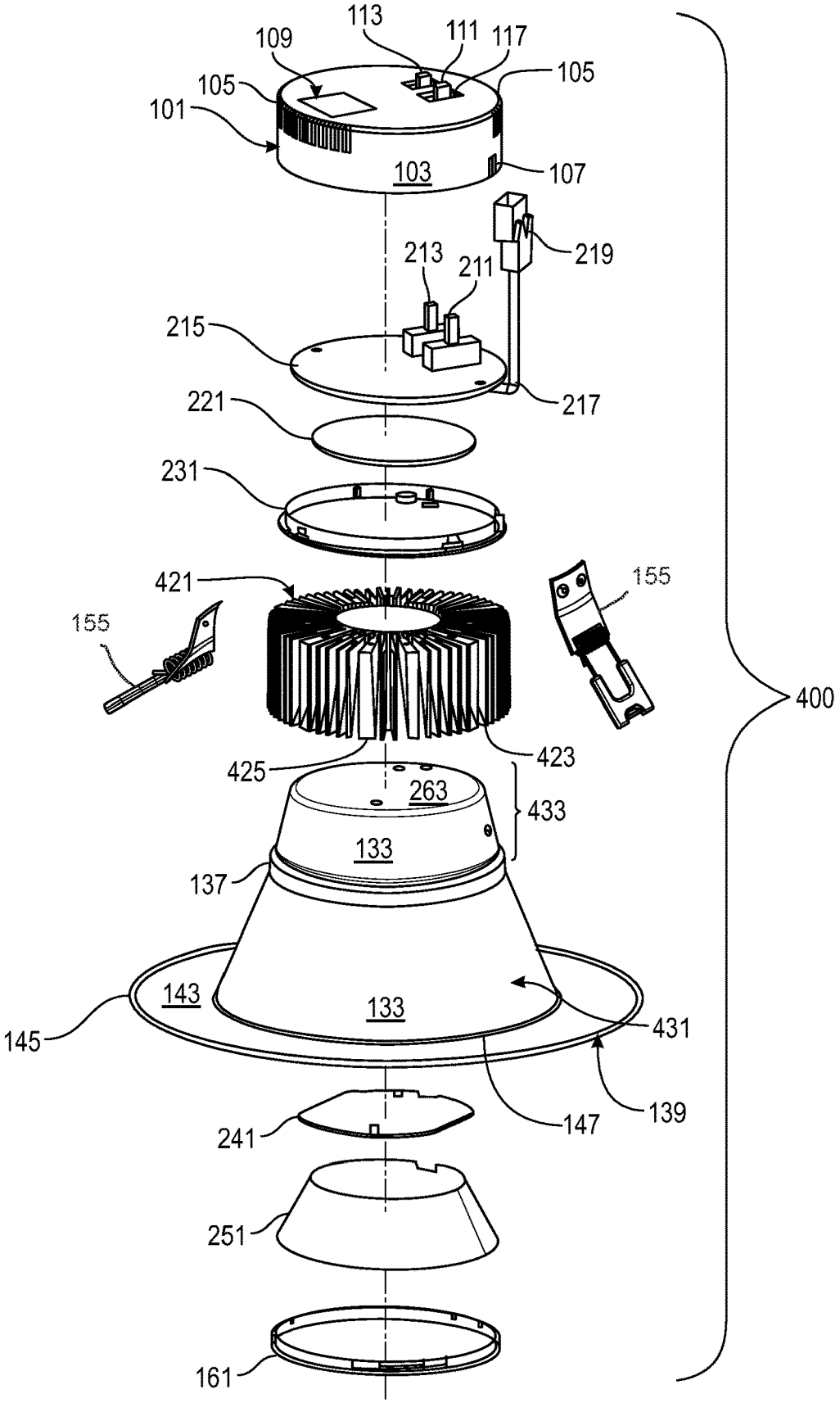
FIG. 4E depicts a top perspective exploded view (at least partially exploded view) of the light fixture of FIG. 3A.

FIG. 4A depicts a top perspective exploded view (at least partially exploded view) of light fixture 400. FIG. 4B depicts a right-side exploded view (at least partially exploded view) of light fixture 400. FIG. 4C depicts a back (rear) exploded view (at least partially exploded view) of light fixture 400. FIG. 4D depicts a bottom perspective exploded view (at least partially exploded view) of light fixture 400. FIG. 4E depicts a top perspective exploded view (at least partially exploded view) of light fixture 400. FIG. 4A through FIG. 4E may show common longitudinal center 201 of light fixture 400. In some embodiments, common longitudinal center 201 is also an imaginary central axis of light fixture 400 wherein the main component parts are exploded along this imaginary line in FIG. 4A through FIG. 4E. In some embodiments, light fixture 400 may be configured for mounting within a given can/housing 601 (see e.g., parent (prior) patent application Ser. No. 17/246,272, by the same inventor as the present patent application for can/housing 601). In some embodiments, light fixture 400 may comprise a driver assembly, heat-sink 421, and a trim-casing assembly.

Continuing discussing FIG. 4A through FIG. 4E, in some embodiments, the driver assembly may comprise at least driver-box 101. In some embodiments, the driver assembly may comprise driver-PCB 221, lumen-switch 211, color-temperature-switch 213, and driver-box 101. In some embodiments, driver-PCB 221, lumen-switch 211, and color-temperature-switch 213 may be at least mostly housed within driver-box 101. In some embodiments, driver-PCB 221 may be configured to provide electrical power and/or to control LED-chipboard 241 (or the like). In some embodiments, lumen-switch 211 may be configured to change a lumen output of LED-chip/board 241 (or the like). In some embodiments, color-temperature-switch 213 may be configured to change a light color-temperature output of LED-chip/board 241 (or the like). See e.g., FIG. 4A through FIG. 4E.

Continuing discussing FIG. 4A through FIG. 4E, in some embodiments, the driver assembly may further comprise lumen-switch-cover 111 and color-temperature-switch-cover 113. In some embodiments, lumen-switch-cover 111 may cover over the lumen-switch 211. In some embodiments, lumen-switch-cover 111 may be in physical communication with the lumen-switch 211. In some embodiments, color-temperature-switch-cover 113 may cover over color-temperature-switch 213. In some embodiments, color-temperature-switch-cover 113 may be in physical communication with the color-temperature-switch 213. In some embodiments, at least a portion of lumen-switch 211 (and/or lumen-switch-cover 111) and at least a portion of the color-temperature-switch 213 (and/or temperature-switch-cover 113) both extend and protrude orthogonally away from an exterior surface of driver-box 101. In some embodiments, at least a portion of lumen-switch 211 (and/or lumen-switch-cover 111) and at least a portion of the color-temperature-switch 213 (and/or temperature-switch-cover 113) both extend and protrude orthogonally away from an exterior surface of top 109. In some embodiments, at least a portion of the lumen-switch-cover 111 and at least a portion of the color-temperature-switch-cover 113 may be both configured to be engaged (i.e., switched to different positions) by a finger, a thumb, and/or a hand of a user.

Continuing discussing FIG. 4A through FIG. 4E, in some embodiments, the driver assembly may further comprise one or more of: lumen-switch-cover 111, color-temperature-switch-cover 113, switch chassis 215, wiring/cabling, power connector (s), driver-cap 231, portions thereof, combinations thereof, and/or the like. In some embodiments, driver-cap 231 may cover over the otherwise open bottom of driver-box 101. In some embodiments, driver-cap 231 may be (removably) attached to the open bottom of driver-box 101.

Continuing discussing FIG. 4A through FIG. 4E, in some embodiments, the trim-casing assembly may comprise at least trim/casing 431. In some embodiments, the trim-casing assembly may comprise at least trim/casing 431 and lens 161. In some embodiments, the trim-casing assembly may comprise LED-chip/board 241, reflector 251, lens 161, a can-attachment-means (or a receiving hole attachment means), and trim/casing 431. In some embodiments, reflector 251 and/or lens 161 may be housed within trim/casing 431. In some embodiments, LED-chip/board 241, reflector 251, and lens 161 may be housed within trim/casing 431. In some embodiments, LED-chip/board 241 may be on top of a top of trim/casing 431. In some embodiments, LED-chip/board 241 may be configured to output light of a predetermined luminosity and of a predetermined light color-temperature. In some embodiments, the can-attachment-means (or the receiving hole attachment means), may be mounted (attached) to an exterior of trim/casing 431 (e.g., via fastening-means 156). In some embodiments, the can-attachment-means (or the receiving hole attachment means), may be mounted (attached) to an exterior of the conical member portion of trim/casing 431 (e.g., via fastening-means 156). In some embodiments, the can-attachment-means may be configured to removably mount light fixture 400 within can/housing 601. In some embodiments, the receiving hole attachment means (e.g., spring-clip(s) 155) may be configured to removably mount light fixture 400 within a receiving hole in drywall. In some embodiments, the can-attachment-means (or the receiving hole attachment means) may be one or more of: pressure-clip 151, spring-clip 155, torsion-spring 451, combinations thereof, and/or the like.

Continuing discussing FIG. 4E, in some embodiments, lumen-switch 211, color-temperature-switch 213, and LED-chip/board 241 may all be operatively connected to driver-PCB 221. In some embodiments, heat-sink 421 may be disposed below the driver assembly (below driver-box 101 and/or below driver-cap 231) and entirely above the trim-casing assembly (above trim-casing 431). In some embodiments, heat-sink 421 may be disposed entirely below driver-cap 231 and entirely above trim/casing 431.

Continuing discussing FIG. 4E, in some embodiments, when light fixture 400 may be assembled, switch chassis 215, driver-PCB 221, and driver-cap 231 may be located at least mostly to entirely within the hollow interior of driver-box 101. In some embodiments, when light fixture 400 may be assembled, lumen-switch 211 and color-temperature-switch 213 may be located at least partially within the hollow interior of driver-box 101. In some embodiments, switch chassis 215 may be a structural member wherein lumen-switch 211 and/or color-temperature-switch 213 are attached thereto. In some embodiments, switch chassis 215 may be a mostly circular disc like member. In some embodiments, switch chassis 215 may comprise circuitry, wiring, cabling, wiring/cabling, switches, lumen-switch 211, color-temperature-switch 213, portions thereof, combinations thereof, and/or the like. In some embodiments, driver-PCB 221 may be a printed circuit board. In some embodiments, driver-PCB 221 may comprise one or more circuits. In some embodiments, driver-PCB 221 may be configured for lighting/LED driver, control, management, and/or regulation functions. In some embodiments, driver-PCB 221 may have a power factor greater than 0.9 and a start time of less than 0.75 seconds. In some embodiments, driver-PCB 221 may be electrically coupled to: lumen-switch 211, color-temperature-switch 213, wiring/cabling, power connector(s), LED-chip/board 241, wiring, cabling, portions thereof, combinations thereof, and/or the like. In some embodiments, driver-cap 231 may cover over the bottom of driver-box 101. In some embodiments, driver-PCB 221 may be referred to as a "driver-printed-circuit-board." In some embodiments, driver-cap 231 may be (removably) attached to the bottom of driver-box 101 and/or to a top of heatsink 421. In some embodiments, driver-cap 231 may be a mostly planarly flat plate disc like member (with hole(s) for wire passage and/or for mechanical fasteners).

Continuing discussing FIG. 4A through FIG. 4E, in some embodiments, light fixture 400 may comprise various wiring/cabling. In some embodiments, wiring/cabling may be configured for electrical power transmission. In some embodiments, wiring/cabling may terminate in a power connector. In some embodiments, wiring/cabling may also terminate at lumen-switch 211, color-temperature-switch 213, switch chassis 215, portions thereof, combinations thereof, and/or the like. In some embodiments, the power connector may be configured to be removably attached to a complimentary power connector (e.g., power source 603), so that light fixture 400 may receive electrical power for operation. In some embodiments, light fixture 400 may comprise other wiring and/or cabling in addition to this wiring/cabling. See U.S. patent application 17/246,272 for wiring/cabling 217, power connector 219, and power source 603.

Continuing discussing FIG. 4A through FIG. 4E, in some embodiments, light fixture 400 may be configured for operation at predetermined voltage and/or wattage. For example, and without limiting the scope of the present invention, in some embodiments, light fixture 400 may be configured for operation at 120 volts, 9.5 watts, 13.5 watts, and/or 18 watts. In other embodiments, light fixture 400 may be configured for operating at other voltages and/or wattages.

Continuing discussing FIG. 4A through FIG. 4E, in some embodiments, lumen-switch-cover 111 may cover over a below located lumen-switch 211. In some embodiments, lumen-switch-cover 111 may be in physical communication with below located lumen-switch 211. In some embodiments, color-temperature-switch-cover 113 may cover over a below located color-temperature-switch 213. In some embodiments, color-temperature-switch-cover 113 may be in physical communication with below color-temperature-switch 213.

Continuing discussing FIG. 4A through FIG. 4E, in some embodiments, lumen-switch 211 may be a switch configured to change the luminosity of emitted light from LED-chip/board 241 (or the like), within a predetermined range of luminosity (e.g., in lumens). In some embodiments, lumen-switch 211 may be configured to select lumens output from 1000 to 2000 lumens. In some embodiments, lumen-switch 211 may be configured to select lumens output at 1000 lumens, 1250 lumens, 1500 lumens, 1750 lumens, and/or 2000 lumens. In other embodiments, other predetermined lumens may be selected (selectable) by lumen-switch 211.

Continuing discussing FIG. 4A through FIG. 4E, in some embodiments, color-temperature-switch 213 may be a switch configured to change the emitted light color-temperature from LED-chip/board 241 (or the like), within a predetermined range of light color-temperatures (e.g., in Kelvin). In some embodiments, color-temperature-switch 213 may be configured to select light color-temperatures from 2700 Kelvin to 5000 Kelvin. In some embodiments, color-temperature-switch 213 may be configured to select light color-temperatures at 2700 Kelvin, 3000 Kelvin, 3500 Kelvin, 4000 Kelvin, and/or 5000 Kelvin. In other embodiments, other predetermined light color-temperatures may be selected (selectable) by color-temperature-switch 213.

Continuing discussing FIG. 4A through FIG. 4E, in some embodiments, heat-sink 421 may be configured to receive heat from electronic components of light fixture 400 and to then dissipate (expel/radiate) this received heat into the surrounding ambient air. In some embodiments, the electronic components of light fixture 400 that may generate and/or emit heat may be one or more of: LED-chip/board 241, driver-PCB 221, lumen-switch 211, color-temperature-switch 213, wiring/cabling, power connector(s), portions thereof, combinations thereof, and/or the like. In some embodiments, each fin 423/425 of heat-sink 421 may be shaped substantially as a rectangular prism to their tops and external sides, but may be scalloped shaped on their bottoms to accommodate fitting a majority of upper-portion 433 of trim/casing 431 beneath heat-sink 421 (see e.g., FIG. 4D). In some embodiments, a center of heat-sink 421 may be devoid of fins 423/425. In some embodiments, a center of heat-sink 421 may be devoid of material, i.e., the center may be void space (however wiring [not shown] may pass through this otherwise void space). In some embodiments, the four (4) fins-thick 425 may be equally spaced around heat-sink 421 with respect to the common longitudinal center 201 of light fixture 400; with a plurality of fins-thin 423 disposed between each fin-thick 425, such that there are four distinct regions (quadrants) of fins-thin 423. In some embodiments, heat-sink 421 may comprise four fins-thick 425 and four groups of fins-thin 423. In some embodiments, each group of fins-thin 423 may be disposed two different of fins-thick 425. In some embodiments, all of fins-thick 425 and all of fins-thin 423 may be arranged radially around a common longitudinal center line 201 of light fixture 400. In some embodiments, all of fins-thick 425 and all of fins-thin 423 may have a same (exterior) height from a bottom of heat-sink 421 to a top of heat-sink 421. In some embodiments, an exterior of heat-sink 421 from a bottom of heat-sink 421 to a top of heat-sink 421 may be substantially cylindrical in shape with a same outer diameter up and down that exterior. In some embodiments, the exterior of heat-sink 421 may be devoid of (free of) any steps. In some embodiments, the exterior of heat-sink 421 may be devoid of (free of) changes in external diameter. In some embodiments, the exterior of heat-sink 421 may be devoid of threading for attachment to trim/casing 431. In some embodiments, a fin-thick 425 may have a hole, wherein such a hole may be configured for receiving a screw, post, bolt, pin, mechanical fastener, portions thereof, combinations thereof, and/or the like, wherein this hole (in fin-thick 425) runs in a vertical direction, parallel to the common longitudinal center 201 of light fixture 400.

Continuing discussing FIG. 4A through FIG. 4E, in some embodiments, trim/casing 431 may comprise a substantially conical frustum member that has a mostly closed top 263 and an open base at flange 139 at the bottom of trim/casing 431. In some embodiments, the substantially conical frustum member may be interrupted by cylindrical-region 137 that is more cylindrical than conical. In some embodiments, a portion above the cylindrical-region 137 of trim/casing 431 is conical and a portion below cylindrical-region 137 of trim/casing 431 is conical. In some embodiments, a portion above the cylindrical-region 137 of trim/casing 431 is conical and may be designated as upper-portion 433 (see e.g., FIG. 4A and/or FIG. 4E). In some embodiments, lens 161 may be housed within cylindrical-region 137 of trim/casing 431. In some embodiments, reflector 251 and/or LED-chip/board 241 may be housed above lens 161 in upper-portion 433 of trim/casing 431 that is conical. In some embodiments, an outside diameter of cylindrical-region 137 of trim/casing 431 is about the same as an outside diameter of heat-sink 421 or slightly smaller than the outside diameter of heat-sink 421. In some embodiments, a majority of upper-portion 433 of trim/casing 431 does extend into a bottom of heat-sink 421 (whereas, with light fixture 100 such geometry is different).

Continuing discussing FIG. 4A through FIG. 4E, in some embodiments, cylindrical-region 137 may be sized and configured to removably receive lens 161 inside of cylindrical-region 137. In some embodiments, when light fixture 400 may be assembled, above lens 161 and inside of upper-portion 433 of the mostly conical member of trim/casing 431 may be reflector 251 and/or LED-chip/board 241. In some embodiments, upper-portion 433 (of trim/casing 431) may be located between a top 263 of trim/casing 431 and cylindrical-region 137. In some embodiments, LED-chip/board 241 may be located on top of reflector 251 within upper-portion 433. In some embodiments, LED-chip/board 241 may be located closer to top 263 as compared to reflector 251. In some embodiments, top 263 may be mostly planarly flat and closed, aside from at least one hole. In some embodiments, a flat surface of top 263 may be at least substantially (mostly) parallel with flat surfaces of flange-top 143, flange-bottom 141, and/or most of top 109. In some embodiments, hole(s) in top 263 may be configured for passage/receiving of portions of wires/cables; and/or for attaching trim/casing 431 to heat-sink 421 via mechanical fasteners, screws, bolts, pins, rods, and/or the like. In some embodiments, the majority of upper-portion 433 trim/casing 431 (with top 263) does extend into and under portions of heat-sink 421. In some embodiments, top 263 may be constructed of a material that conducts heat well from top 263 and into heat-sink 421. In some embodiments, thermal-paste (or the like) may be located on a bottom of heat-sink 421 and/or on top 263 to facilitate/promote heat transfer from top 263 and into heat-sink 421.

Discussing FIG. 4E, in some embodiments, LED-chip/board 241 may be a light source. In some embodiments, LED-chip/board 241 may be electrically powered. In some embodiments, when LED-chip/board 241 may be sufficiently electrically powered, LED-chip/board 241 may emit light. In some embodiments, when LED-chip/board 241 may be sufficiently electrically powered, LED-chip/board 241 may emit light down over reflector 251, through lens 161, down over conical-interior 135, and out of a bottom (flange 139) of light fixture 400. In some embodiments, LED-chip/board 241 may comprise one or more LEDs (light emitting diodes) and/or other types of light sources. In some embodiments, LED-chip/board 241 may comprise one or more LEDs (light emitting diodes) of different colors. In some embodiments, LED-chip/board 241 may comprise one or more printed circuit boards. In some embodiments, LED-chip/board 241 may comprise one or more circuits. In some embodiments, LED-chip/board 241 may be dimmable. In some embodiments, LED-chip/board 241 may be electrically coupled to driver-PCB 221, lumen-switch 211, color-temperature-switch 213, switch chassis 215, wiring/cabling, power connector(s), portions thereof, combinations thereof, and/or the like.

Continuing discussing FIG. 4E, in some embodiments, LED-chip/board 241 may output lumens at a predetermined value. In some embodiments, LED-chip/board 241 may output lumens from a predetermined range of lumens. In some embodiments, LED-chip/board 241 may output lumens from 1000 to 2000 lumens. In some embodiments, LED-chip/board 241 may output lumens at 1000 lumens, 1250 lumens, 1500 lumens, 1750 lumens, and/or 2000 lumens. In other embodiments, other predetermined lumens may be output by LED-chip/board 241.

Continuing discussing FIG. 4E, in some embodiments, LED-chip/board 241 may output light color-temperature at a predetermined value (e.g., in Kelvins). In some embodiments, LED-chip/board 241 may output light color-temperature from 2700 Kelvin to 5000 Kelvin. In some embodiments, LED-chip/board 241 may output light color-temperatures at 2700 Kelvin, 3000 Kelvin, 3500 Kelvin, 4000 Kelvin, and/or 5000 Kelvin. In other embodiments, other predetermined light color-temperatures may be output by LED-chip/board 241.

Continuing discussing FIG. 4E, in some embodiments, reflector 251 may be a highly reflective conical frustum member. In some embodiments, at least an interior surface of reflector 251 that faces a bottom of light fixture 400 may have a substantially mirror like reflective finish. In some embodiments, reflector 251 may be configured to reflect at least some light emitted by LED-chip/board 241. In some embodiments, reflector 251 may be configured to reflect at least some light emitted by LED-chip/board 241 downwards and out of a bottom of light fixture 400.

Continuing discussing FIG. 4A through FIG. 4E, in some embodiments, spring-clip(s) 155 of light fixture 400 may be attached to upper-portion 433, above cylindrical-region 137. In some embodiments, at least two (2) spring-clips 155 of light fixture 400 may be attached to upper-portion 433, above cylindrical-region 137. In some embodiments, two (2) spring-clips 155 of light fixture 400 may be attached to upper-portion 433, above cylindrical-region 137, at opposite sides of upper-portion 433 from each other. In some embodiments, base 157 (of spring-clip 155) may be attached to upper-portion 433 via fastening-means 156. In some embodiments, when spring-clip 155 is attached to upper-portion 433, spring 158 (of spring-clip 155) is over, next to, and/or adjacent to the lower conical-exterior 133 and not over upper-portion 433. See also, FIG. 3A to FIG. 3H.

In some embodiments, heat-sink 121 and/or heat-sink 421 may be substantially constructed from one or more materials that are generally used for heat conduction. In some embodiments, heat-sink 121 and/or heat-sink 421 may be substantially constructed from one or more materials that have generally high heat conductivity. In some embodiments, heat-sink 121 and/or heat-sink 421 may be substantially constructed from one or more metals.

In some embodiments, lumen-switch 211 (and its cover 111) as shown in the drawing figures may be switched (swapped) with color-temperature-switch 213 (and its cover 113); and vice-versa. In some embodiments, a given switch-aperture 115 may receive at least portions of a lumen-switch 211 (and its cover 111) or of a color-temperature-switch 213 (and its cover 113). In some embodiments, switch-aperture 115, lumen-switch 211 (and its cover 111), and/or color-temperature-switch 213 (and its cover 113) may be located on side-wall 103 of driver-box 101, instead of extending out from top 109 as shown in the accompanying drawing.

In some embodiments, adjacent to each switch-aperture 115 may be indicia 117 of the available lumens and/or color-temperatures that may be selected. In some embodiments, a top of lumen-switch-cover 111 and/or a top of color-temperature-switch-cover 113 may comprise an arrow that points to the currently selected lumen output and/or that points to the currently selected color-temperature output.

In some embodiments, each indicia 117 for each switch-aperture 115 may be located to a right of the respective 115. In some embodiments, each indicia 117 for each switch-aperture 115 may be located to a left of the respective 115. In some embodiments, an indicia 117 for a given switch-aperture 115 may be located between two adjacent switch-apertures 115.

In some embodiments, the two switch-apertures 115 may be adjacent and side by side to each other and each such switch-aperture 115 may have a single indicia 117 associated next to that switch-aperture 115, but between the two adjacent side by side switch-apertures 115 there may be no indicia 117.

In some embodiments, lumen-switch-cover 111 shown in the accompanying figures may be swapped (switched) for color-temperature-switch-cover 113. In some embodiments, color-temperature-switch-cover 113 shown in the accompanying figures may be swapped (switched) for lumen-switch-cover 111. In some embodiments, lumen-switch 211 shown in the accompanying figures may be swapped (switched) for color-temperature-switch 213. In some embodiments, color-temperature-switch 213 shown in the accompanying figures may be swapped (switched) for lumen-switch 211.

In some embodiments, switch-aperture 115 for color-temperature-switch-cover 113 may be longer than switch-aperture 115 for lumen-switch-cover 111. In some embodiments, switch-aperture 115 for lumen-switch-cover 111 may be longer than switch-aperture 115 for color-temperature-switch-cover 113.

In some embodiments, can/housing 301 and/or can/housing 601 may be referred to as a "housing-can," a "housing," and/or as a "can."

In some embodiments, trim/casing 131 and/or trim/casing 431 may be referred to as a "trim-casing-member" and/or as "trim."

In some embodiments, driver-PCB 221 may be referred to as a "driver-printed-circuit-board."

In some embodiments, LED chip-board 241 may be referred to as a "light-emitting-diode-circuit."

In some embodiments, spring-clip 155 may be referred to as "can-attachment-means" and/or as "receiving hole attachment means."

In some embodiments, at least one (one or more) spring-clip(s) 155 may be attached to and part of light fixture 100, light fixture 400, trim/casing 131, and/or trim/casing 431.

Light fixtures have been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A light fixture configured for mounting within a housing-can, wherein the light fixture comprises:

a driver assembly, wherein the driver assembly comprises a driver-printed-circuit-board, a lumen-switch, a color-temperature-switch, and a driver-box; wherein the driver-printed-circuit-board, the lumen-switch, and the color-temperature-switch are at least mostly housed within the driver-box; wherein the driver-printed-circuit-board is configured to provide electrical power and to control a light-emitting-diode-circuit within the light fixture; wherein the lumen-switch is configured to change a lumen output of the light-emitting-diode-circuit; wherein the color-temperature-switch is configured to change a light color-temperature output of the light-emitting-diode-circuit;

a heat-sink; and a trim-casing assembly, wherein the trim-casing assembly comprises the light-emitting-diode-circuit, a reflector, a lens, at least one spring-clip that is configured to secure the light fixture within the housing-can by friction, and a trim-casing-member; wherein the light-emitting-diode-circuit, the reflector, and the lens are housed within the trim-casing-member; wherein the light-emitting-diode-circuit is configured to output light of a predetermined luminosity and of a predetermined light color-temperature; wherein the at least one spring-clip is mounted to an exterior of the trim-casing member;

wherein the lumen-switch, the color-temperature-switch, and the light-emitting-diode-circuit are all operatively connected to the driver-printed-circuit-board; and wherein the heat-sink is disposed below the driver assembly and at least partially above the trim-casing assembly.

2. The light fixture according to claim 1, wherein at least a portion of the lumen-switch and at least a portion of the color-temperature-switch both extend and protrude orthogonally away from an exterior surface of the driver-box.

3. The light fixture according to claim 1, wherein the driver assembly further comprises a lumen-switch-cover and a color-temperature-switch-cover; wherein the lumen-switch-cover covers over the lumen-switch; wherein the lumen-switch-cover is in physical communication with the lumen-switch; wherein the color-temperature-switch-cover covers over the color-temperature-switch; wherein the color-temperature-switch-cover is in physical communication with the color-temperature-switch.

4. The light fixture according to claim 3, wherein the lumen-switch-cover and the color-temperature-switch-cover are both waterproof.

5. The light fixture according to claim 3, wherein at least a portion of the lumen-switch-cover and at least a portion of the color-temperature-switch-cover are both configured to be engaged by a finger, a thumb, and/or a hand of a user.

6. The light fixture according to claim 1, wherein the lumen-switch is configured to select the lumen output from a range of 1000 lumens to 2000 lumens.

7. The light fixture according to claim 1, wherein the color-temperature-switch is configured to select the light color-temperature output from a range of 2700 Kelvin to 5000 Kelvin.

8. The light fixture according to claim 1, wherein the driver-box comprises two distinct, different, opposing sets of fins configured for heat dissipation; wherein the two distinct, different, opposing sets of fins are equally spaced apart from each other by regions of the driver-box without fins.

9. The light fixture according to claim 8, wherein each fin, selected from the two distinct, different, opposing sets of fins, runs from a side-wall of the driver-box to a top of the driver-box.

10. The light fixture according to claim 1, wherein a portion of a top of the driver-box comprises a bulge that is integral with the top and extends above the top.

11. The light fixture according to claim 1, wherein the heat-sink comprises four thick fins and four groups of thin fins, wherein each group of thin fins is disposed two of the thick fins, wherein the thick fins are thicker than the thin fins; and wherein all of the thick fins and all of the thin fins are arranged radially around a common longitudinal center line of the light fixture.

12. The light fixture according to claim 10, wherein all of the thick fins and all of the thin fins have a same height from a bottom of the heat-sink to a top of the heat-sink.

13. The light fixture according to claim 1, wherein an exterior of the heat-sink from a bottom of the heat-sink to a top of the heat-sink is substantially cylindrical in shape with a same outer diameter.

14. The light fixture according to claim 1, wherein the trim-casing-member comprises a substantially conical frustum member that has a mostly closed top and an open base, wherein the substantially conical frustum member is interrupted by a cylindrical-region that is more cylindrical than conical, wherein a portion above the cylindrical-region of the trim-casing-member is conical and a portion below the cylindrical-region of the trim-casing-member is conical.

15. The light fixture according to claim 13, wherein the lens is housed within the cylindrical-region of the trim-casing-member.

16. The light fixture according to claim 14, wherein the reflector and the light-emitting-diode-circuit are both housed above the lens in an upper-portion of the trim-casing-member that is conical.

17. The light fixture according to claim 13, wherein an outside diameter of the cylindrical-region of the trim-casing-member is the same as or smaller than an outside diameter of the heat-sink.

18. The light fixture according to claim 1, wherein the trim-casing-member does not extend into a bottom of the heat-sink.

19. The light fixture according to claim 1, wherein a majority of an upper-portion of the trim-casing-member extends into an inside bottom portion of the heat-sink.

20. The light fixture according to claim 1, wherein the at least one spring-clip comprises a base, a spring, and a region-of-external-contact; wherein the base is attached an upper portion of the trim-casing-member; wherein the spring links the base to the region-of-external-contact; wherein the region-of-external-contact is disposed opposite from the base and is configured to frictionally engage an interior of the housing-can.

* * * * *